US008850753B2

(12) United States Patent
Tabibnia

(10) Patent No.: US 8,850,753 B2
(45) Date of Patent: Oct. 7, 2014

(54) APPARATUS FOR ESTABLISHING A PAVER SURFACE OVER A SUBSURFACE

(76) Inventor: Ramin Tabibnia, Los Angeles, CA (US)

( * ) Notice: Subject to any disclaimer, the term of this patent is extended or adjusted under 35 U.S.C. 154(b) by 0 days.

(21) Appl. No.: 13/564,628

(22) Filed: Aug. 1, 2012

(65) Prior Publication Data

US 2013/0219809 A1 Aug. 29, 2013

Related U.S. Application Data

(63) Continuation-in-part of application No. 12/732,755, filed on Mar. 26, 2010, now Pat. No. 8,453,391.

(51) Int. Cl.

| | |
|---|---|
| ***E04B 5/02*** | (2006.01) |
| ***E04F 15/02*** | (2006.01) |
| ***E04D 11/00*** | (2006.01) |
| ***E04F 15/024*** | (2006.01) |

(52) U.S. Cl.

CPC ..... *E04F 15/02464* (2013.01); *E04D 11/007* (2013.01); *E04F 15/02452* (2013.01)

USPC ..... 52/126.6; 52/263; 404/26; 248/188.2; 248/346.05

(58) Field of Classification Search

CPC ..... E04F 15/02447; E04F 15/02482; E04F 15/02476; E04F 15/02452; E04F 15/02464; E04D 11/007

USPC ..... 52/126.6, 263; 404/26; 248/188.2, 248/346.05

See application file for complete search history.

(56) References Cited

U.S. PATENT DOCUMENTS

| | | | | |
|---|---|---|---|---|
| 6,332,292 | B1 * | 12/2001 | Buzon | 52/126.6 |
| 6,520,471 | B2 * | 2/2003 | Jones et al. | 248/346.5 |
| 6,983,570 | B2 * | 1/2006 | Mead | 52/263 |
| 7,866,096 | B2 * | 1/2011 | Lee et al. | 52/126.6 |
| 7,918,059 | B2 * | 4/2011 | Repasky | 52/263 |
| 8,297,004 | B2 * | 10/2012 | Knight et al. | 52/126.6 |
| 8,302,356 | B2 * | 11/2012 | Knight et al. | 52/263 |
| 8,429,860 | B2 * | 4/2013 | Kugler et al. | 52/126.6 |
| 8,438,805 | B2 * | 5/2013 | Repasky | 52/263 |
| 2002/0148173 | A1 * | 10/2002 | Kugler | 52/126.6 |
| 2004/0035064 | A1 * | 2/2004 | Kugler et al. | 52/126.6 |
| 2005/0193660 | A1 * | 9/2005 | Mead | 52/263 |
| 2007/0017173 | A1 * | 1/2007 | Kim et al. | 52/263 |
| 2007/0186498 | A1 * | 8/2007 | Buzon | 52/263 |
| 2008/0222973 | A1 * | 9/2008 | Lee et al. | 52/126.1 |

FOREIGN PATENT DOCUMENTS

| | | | | |
|---|---|---|---|---|
| DE | 19635820 | A1 * | 3/1998 | |
| DE | 19631880 | C2 * | 7/1998 | |
| FR | 2598779 | A1 * | 11/1987 | E04D 11/00 |
| WO | WO 2007011179 | A1 * | 1/2007 | |
| WO | WO 2007048204 | A1 * | 5/2007 | E04F 15/024 |
| WO | WO 2007121529 | A1 * | 11/2007 | |
| WO | WO 2008105012 | A1 * | 9/2008 | E04F 15/04 |

* cited by examiner

*Primary Examiner* — Robert Canfield

(74) *Attorney, Agent, or Firm* — John K. Buche; Buche & Associates, P.C.

(57) ABSTRACT

Disclosed is an improved assembly for facilitating the elevated and leveled placement of a paver surface. Yet further disclosed are related methods of using the assembly.

5 Claims, 67 Drawing Sheets

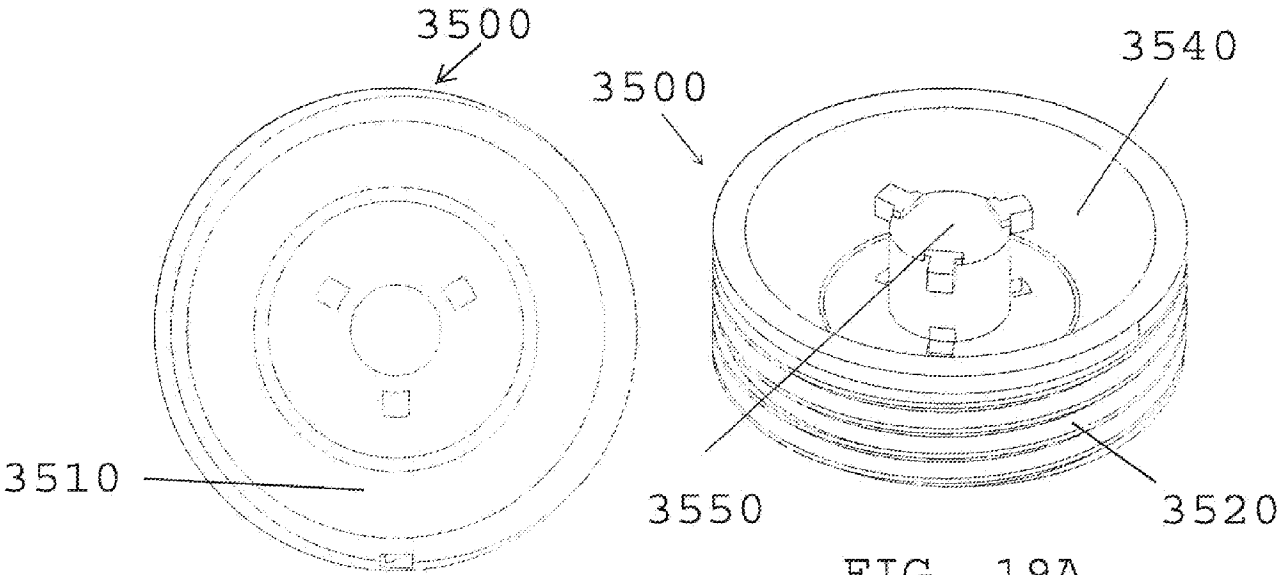
FIG. 19A
FIG. 19B
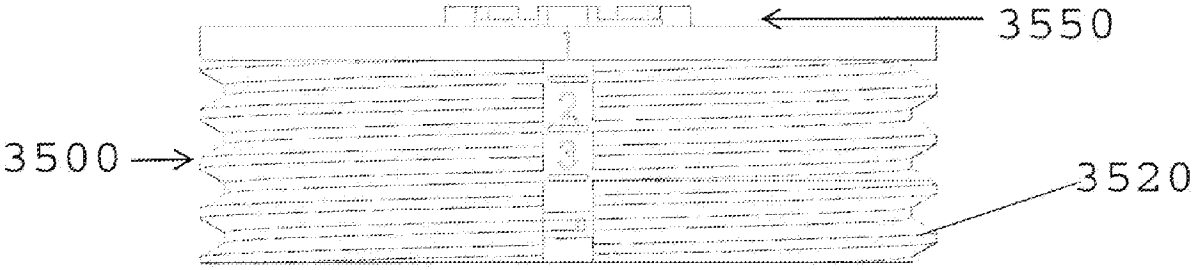
FIG. 19C

APPARATUS FOR ESTABLISHING A PAVER SURFACE OVER A SUBSURFACE

CROSS-REFERENCE TO RELATED APPLICATIONS

This application is a continuation in part of U.S. patent application Ser. No. 12/732,755 (filed Mar. 26, 2010) now U.S. Pat. No. 8,453,391 entitled "Apparatus for establishing a paver over a subsurface" and said patent application is hereby incorporated by reference in its entirety.

STATEMENT REGARDING FEDERALLY SPONSORED RESEARCH OR DEVELOPMENT

Not applicable.

BACKGROUND OF THE INVENTION

1. Field of Invention

The present application is in the field of methods and apparatus for establishing a paver surface. The present application is also in the field of methods and apparatus for elevating a paver surface with respect to a subsurface and/or compensating for the slope of the subsurface.

2. Background of the Invention

Frequently, it is desirable to establish a surface above a subsurface. For instance, a surface may be established over a subsurface to, in effect, adjust the aesthetic and/or physical properties of the subsurface. Commonly, such a surface is established via placing an array of pavers onto the subsurface. "Pavers" are, for example, items for covering a subsurface and may include, without being limited to, tiles, stones, bricks, molded concrete, and/or the like. Therefore, there is a need for an apparatus and related methods which facilitate the placement of a paver array onto a subsurface.

The aesthetic appearance of a paver surface can depend on the spacing, shape, and orientation of the component pavers. Notably, a surface comprising a tessellated array of pavers will typically be more aesthetically pleasing when the component pavers are evenly and uniformly spaced and oriented. For this reason, there is a need for an apparatus and related methods which facilitate the placement of a paver array onto a subsurface with even and uniform spacing and orientation.

Circumstances exist that may necessitate the leveling and/or elevation of the established paver surface relative to the subsurface. For example, it may be necessary to position and/or level the paver surface above the subsurface in order to: facilitate drainage of the established surface when the component pavers are sensitive to water; provide for air circulation between the surface and the subsurface to prevent the buildup or mold or other residue; or to level the surface above an undesirably irregular or sloped undersurface. Accordingly, there is a need for an apparatus and related methods which facilitate the elevated and leveled placement of a paver array onto a subsurface with even and uniform spacing and orientation.

Various apparatus are known which facilitate the uniformly spaced and oriented placement of a paver array onto a subsurface. For example, U.S. Pat. No. D259,283 (issued May 19, 1981), U.S. Pat. No. 6,702,515 (issued Mar. 9, 2004), and U.S. Pat. No. D557,830 (issued Dec. 18, 2007) disclose apparatus featuring four uniformly dimensioned projections which are normal to the paver support surface whereby the projections divide the support surface into quadrants. See e.g., U.S. Pat. No. 6,702,515, FIG. 1. Referring to the same example, the disclosed apparatus, in operation: receive a corner of a square paver within each quadrant until the received pavers abut the projections whereby the received pavers are uniformly spaced; and, orient the pavers via rotating the entire apparatus, typically before the pavers are received, until the received pavers are aligned with the desired paver surface array. While such apparatus are suitable for spacing square pavers, the subject apparatus are not adequate since non-square pavers are often used when constructing a paver surface. Furthermore, shifting the entire apparatus to orient the paver array may be tedious. To improve upon the above mentioned limitations, apparatus are known which feature detachable projections whereby the orientation of the pavers may be manipulated via merely orienting the attachment of the detachable projections. See e.g., U.S. Pat. No. 6,625,951 (issued Sep. 30, 2003) and U.S. Pub. Pat. App. No. US2008/0222973 (published Sep. 18, 2008). However, these apparatus designs are still limited and may involve tedious attachment methods. Accordingly, there is still a need for an apparatus and related methods which facilitate the placement of a paver array onto a subsurface with even and uniform spacing and orientation.

Various apparatus are further known which facilitate the elevated placement of a paver array onto a subsurface. Referring once again to U.S. Pat. Nos. D259,283, and 6,702,515 for examples, the disclosed apparatus may elevate a paver surface via stacking a plurality of apparatus in vertical alignment before placing the paver array thereon. While such manner of paver surface elevation may be suitable for incremental increases in surface levels, stacking apparatus in the described manner is limiting of the ultimate height to which the stack may raise the surface since the base apparatus features the same dimensions as the top-most apparatus in the stack. Stacking apparatus to increase paver surface elevation is also limited because the exact adjustment of paver surface height depends on the thickness of the individual apparatus within the stack (i.e., exact adjustment of paver surface height requires multiple apparatus of different thickness or the shaving-off of apparatus thickness). To improve upon the above mentioned limitations, apparatus are known which feature: screw jack mechanisms (see e.g., U.S. Pat. No. 3,223,415 (issued Dec. 14, 1965), U.S. Pat. No. 3,318,057 (issued May 9, 1967), U.S. Pat. No. 5,588,264 (issued Dec. 31, 1996), and U.S. Pat. No. 6,332,292 (issued Dec. 25, 2001)); telescoping pedestal (see e.g., U.S. Pat. No. 4,570,397 (issued Feb. 18, 1986)); or central riser units which are measured to an exact desired height (see e.g., U.S. Pat. No. 6,520,471 (issued Feb. 18, 2003)). Screw-jack mechanisms are not completely satisfactory for raising the height of a paver surface since screw jack mechanisms are expensive to fabricate and the surface height cannot be increased beyond two-times the apparatus thickness without the addition of multiple components. See, e.g., U.S. Pat. No. 5,588,264, FIG. 4; see also US20080105172 (published. May 8, 2008) wherein multiple component screw jacks are combined to increase overall height. A telescoping pedestal is unsatisfactory because it requires the manufacture of different sized levels or complex assembly methods (see e.g., U.S. Pat. No. 4,570,397 wherein a fill is added). Central riser designs are not adequate because accommodations cannot be made for inaccurate measurements or unanticipated changes in desired paver heights. Further, central riser designs are inadequate because such designs often require the existence of multiple distinct components for supporting the central riser, including base and cap members, which are expensive and tedious to fabricate due to the requirement of differing molds or other fabrication tools. Accordingly, there is a need for an apparatus and related methods which facilitate the elevated and leveled placement of a paver array onto a subsurface with even and uniform spacing and orientation.

Various apparatus are yet further known which facilitate the leveled placement of a paver array onto a sloping subsurface. For example, apparatus are known which feature: cooperating twist slope adjustment (see e.g., U.S. Pat. No. 6,332,292); concave/convex interacting surfaces (see e.g., U.S. Pat. No. 3,318,057). Twist slope manipulation has not been suitable for compensating for a sloping subsurface because it only allows for slope adjustment at the paver support surface without permitting adjustment at the apparatus base. Concave/convex surface slope compensation is not adequate since the concave/convex surface interactions are relatively frictionless and unstable and therefore require additional components to keep the paver support surface from shifting orientation. See U.S. Pat. No. 3,318,057, FIG. 2, element 70; see also U.S. Pub. Pat. App. No. US2008/0222973, FIGS. 4 and 5, element 132, 134 and 72. Accordingly, there is a need for an apparatus and related methods which facilitate the elevated and leveled placement of a paver array onto a subsurface with even and uniform spacing and orientation.

Yet still, further drawbacks of the heretofore mentioned apparatus are the non-existence of a single component which may: (1) itself support a paver surface; (2) be stacked upon a like component to raise the height of a paver surface; (3) interact with a like component(s) to change the slope of the paver support surface relative to a sub surface; (4) cooperate with a like component to receive a riser therebetween whereby either of the like components may provide the paver support surface or the assembly base surface; (5) be assembled to multiple like components and a riser, wherein two of said like components define the assembly base and paver support surface, and whereby (i) the paver support surface may be elevated above a subsurface via a combination of the riser and stacked components and (ii) the slope of the elevated paver support surface relative to the subsurface may be manipulated at either the base of the assembly or at the paver support surface; (6) receive an attachment on its paver support surface for orienting and/or uniformly spacing adjacently positioned pavers provided to the component's paver support surface; and (7) receive an attachment(s) on its paver support surface for incrementally raising one or more pavers with respect to another paver to account for discrepancies in paver thickness. In other words, none of the heretofore known apparatus for elevating, leveling, and/or orienting a paver surface disclose a single component for accomplishing the referenced functionalities. On the contrary, apparatus heretofore known for establishing a paver surface require multiple and diverse components while yet only providing a fraction of the referenced functionalities. None of the heretofore known apparatus can adjust for slope, orient and space a paver, vertically support a paver surface while being composed of multiple like components for providing the recited functionalities. Accordingly, there is a need for an improved apparatus for establishing a paver surface without the deficiencies of apparatus which are presently known.

SUMMARY OF THE INVENTION

It is an object of the present application to disclose apparatus and related methods for facilitating the elevated and leveled placement of a paver array onto a subsurface with even and uniform spacing and orientation in a manner that alleviates the problems associated with apparatus heretofore known for the same purpose. In particular, it is an object of the present application to disclose assemblies that may be for establishing a level paver support surface; for adjusting the height of a paver support surface; for manipulating the slope of a paver support surface with respect to a subsurface; and for receiving attachments for orienting and spacing adjacent pavers.

In one non-limiting example, the assembly may comprise: a base; a concave surface; a cap with a convex surface and a paver support surface; and, a key for maintaining an interface between the concave and convex surface. In another embodiment, the assembly may further comprise: a threaded collar threaded with a threaded insert with a concave surface; and wherein the key is for maintaining an interface between the second concave and the convex surfaces. The assembly may be for establishing an elevated and slope adjusted surface. Finally, the assembly may be for elevating and leveling a paver surface. Further disclosed are exemplary methods of establishing a paver surface.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which:

FIG. 19A is a top perspective view of a threaded insert 3500;

FIG. 19B is a top plan view of the threaded insert 3500;

FIG. 19C is a side profile view of the threaded insert 3500;

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, preferred embodiments of the present disclosure may be assemblies of components for facilitating the elevated and leveled placement of a paver array onto a subsurface. Suitably, the disclosed assemblies may be apparatus for supporting a paver surface or may interact with assembly components for establishing an elevated and slope adjusted surface. Yet still, the assemblies may suitably incorporate a riser to produce an apparatus for elevating and leveling a paver surface. The disclosed assemblies may receive attachments for orienting and spacing an array of pavers to be supported by the assemblage. Other embodiments of the present disclosure may be methods of establishing a paver surface using the assemblies. The details of the preferable assemblies are best disclosed by reference to FIGS. 1 through 28E.

Figure 1A:
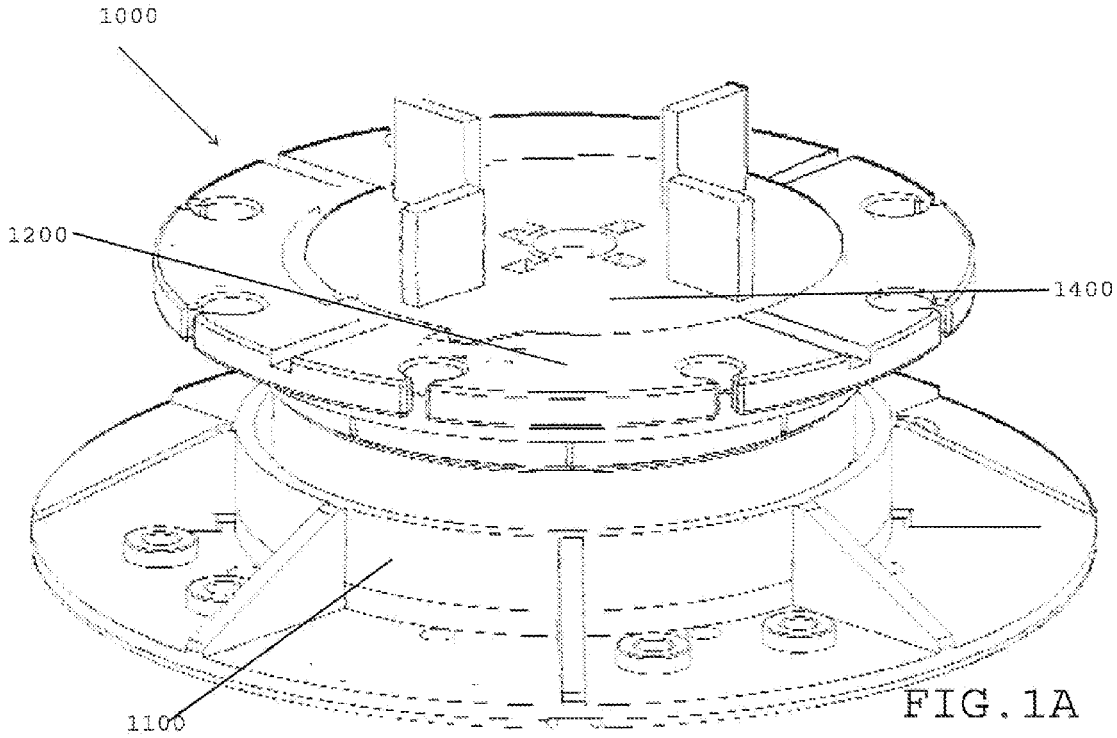
FIG. 1A is a perspective view of the first embodiment of an assembly 1000.
Figure 1B:
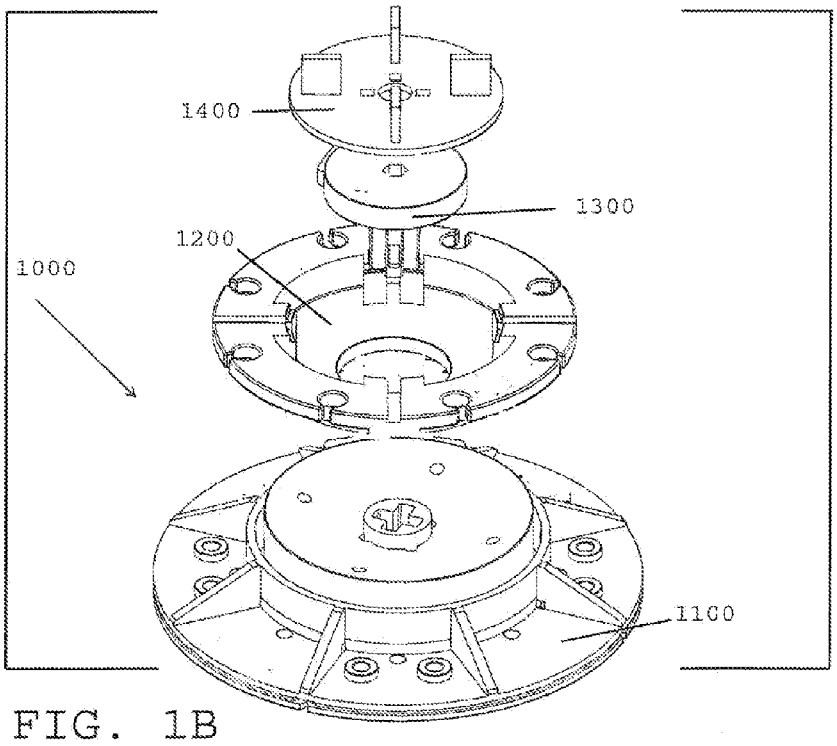
FIG. 1B is an exploded view of the first embodiment of the assembly 1000.

FIGS. 1A and 1B depict a first embodiment of an assembly 1000 for facilitating the elevated and leveled placement of a paver array onto a substrate. FIG. 1A is a perspective view of the assembly 1000 and FIG. 1B is an exploded view of the same. As seen in the figures the assembly 1000 comprises: a base 1100; a cap 1200; a pin 1300; and, a tile spacer 1400.

FIGS. 2A through 2E depict different views of a preferable embodiment of the base 1100 component of the assembly 1000 depicted in FIGS. 1A and 1B. Specifically, FIGS. 2A through 2E respectively depict a top perspective, bottom perspective, top plan, bottom plan, and side profile view of the base 1100. As can be seen in the referenced drawings, the base 1100 is generally a truncated cylinder and may comprise: a foot 1110; a support cylinder 1120; a riser socket 1130 around the cylinder 1120; a concave surface 1140 defining the top of the cylinder 1120; and a key socket 1150 through the concave surface 1140 along the axis of the cylinder 1120.

FIGS. 3A through 3E depict different views of a preferable embodiment of the cap 1200 component of the assembly 1000 depicted in FIGS. 1A and 1B. Specifically, FIGS. 3A through 3E respectively depict a top perspective, bottom perspective, top plan, bottom plan, and side profile view of the cap 1200. As can be seen in the referenced drawings, the cap 1200 is generally a disc with a convex surface on its bottom side. Still referring to FIGS. 3A through 3E, the cap 1200 may comprise: a paver support surface 1210; a cylinder 1220 extending from the bottom of the paver support surface 1210; a convex surface 1230 defining the bottom of the cylinder 1220; a tile spacer receptacle 1240 that is coaxial to the tile support surface 1210; and, a key socket access hole 1250 through the convex surface 1140 along the axis of the cylinder 1220.

Figure 4A:
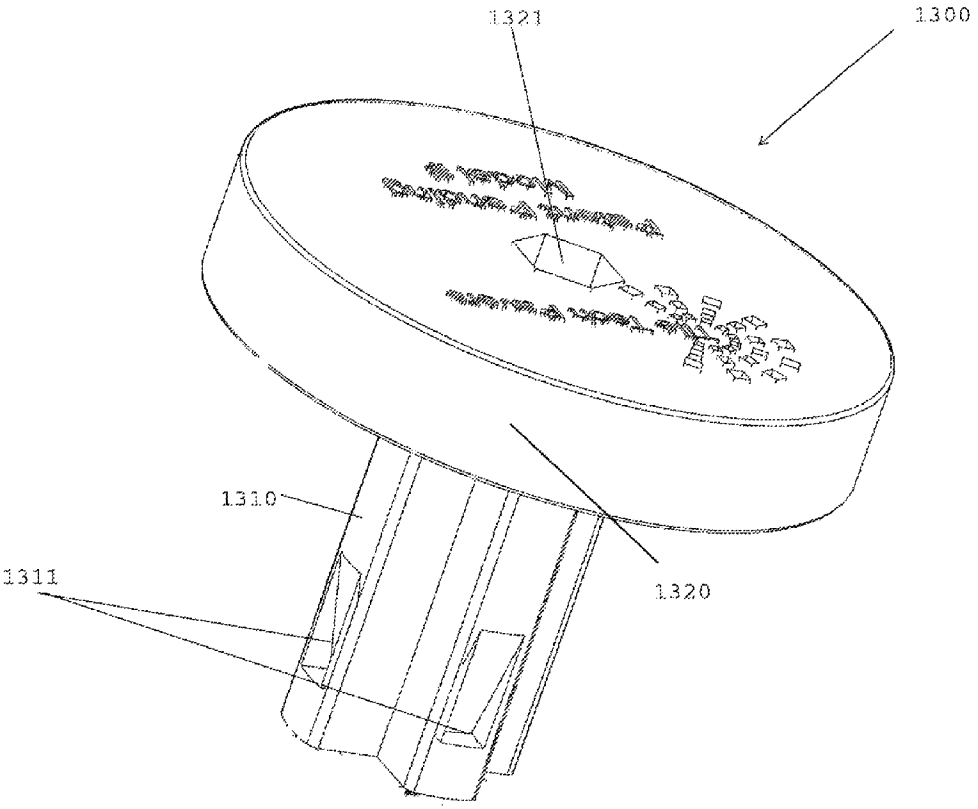
FIG. 4A is a top perspective view of a key 1300.
Figure 4B:
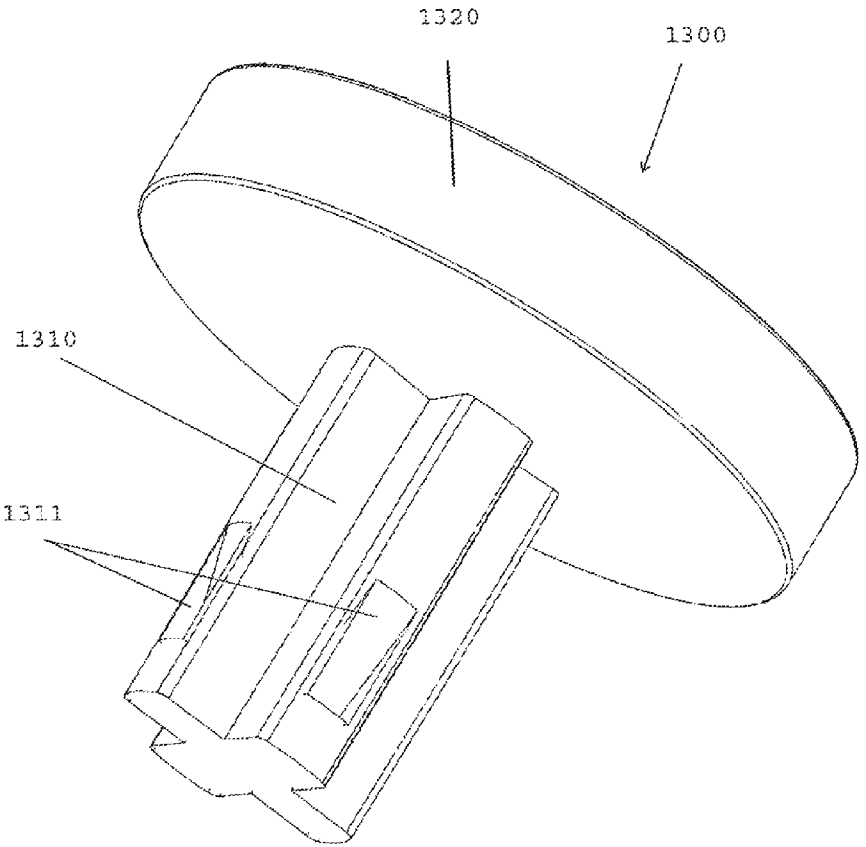
FIG. 4B is a bottom perspective view of the key 1300.
Figure 4C:
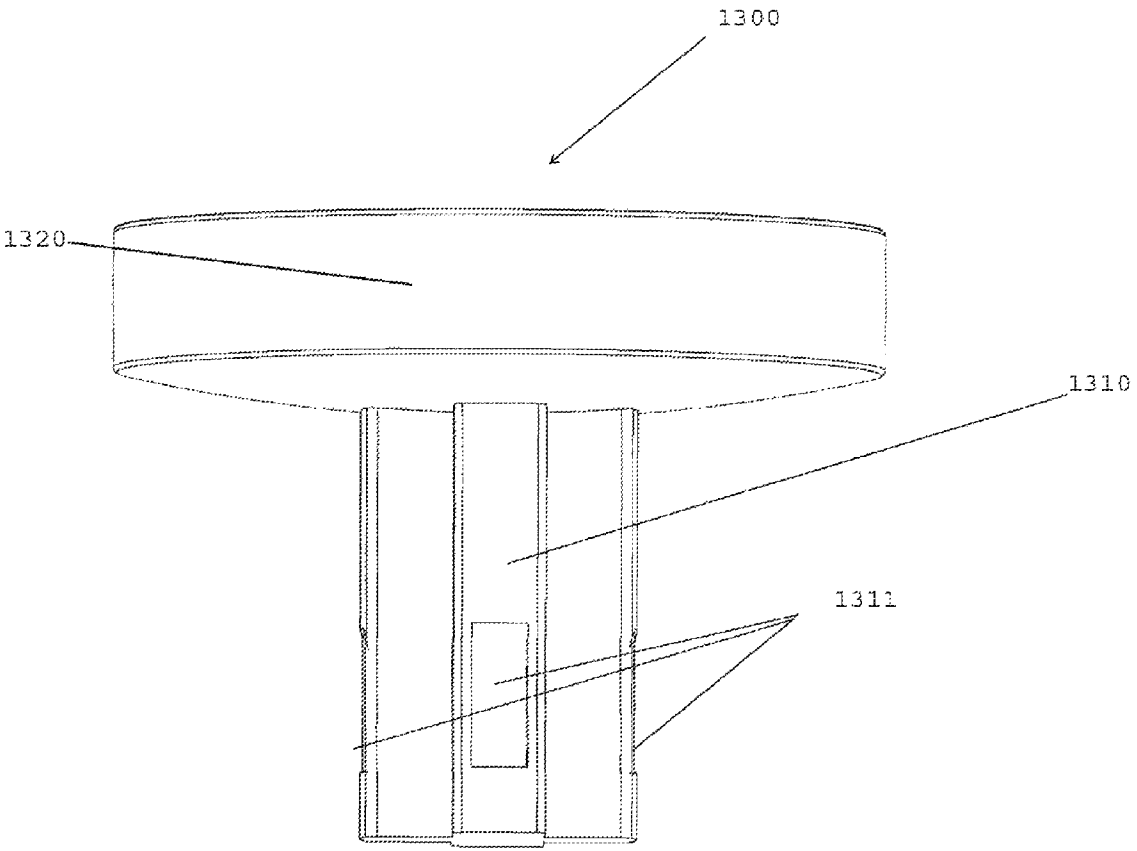
FIG. 4C is a side profile view of the key 1300.
Figure 5A:
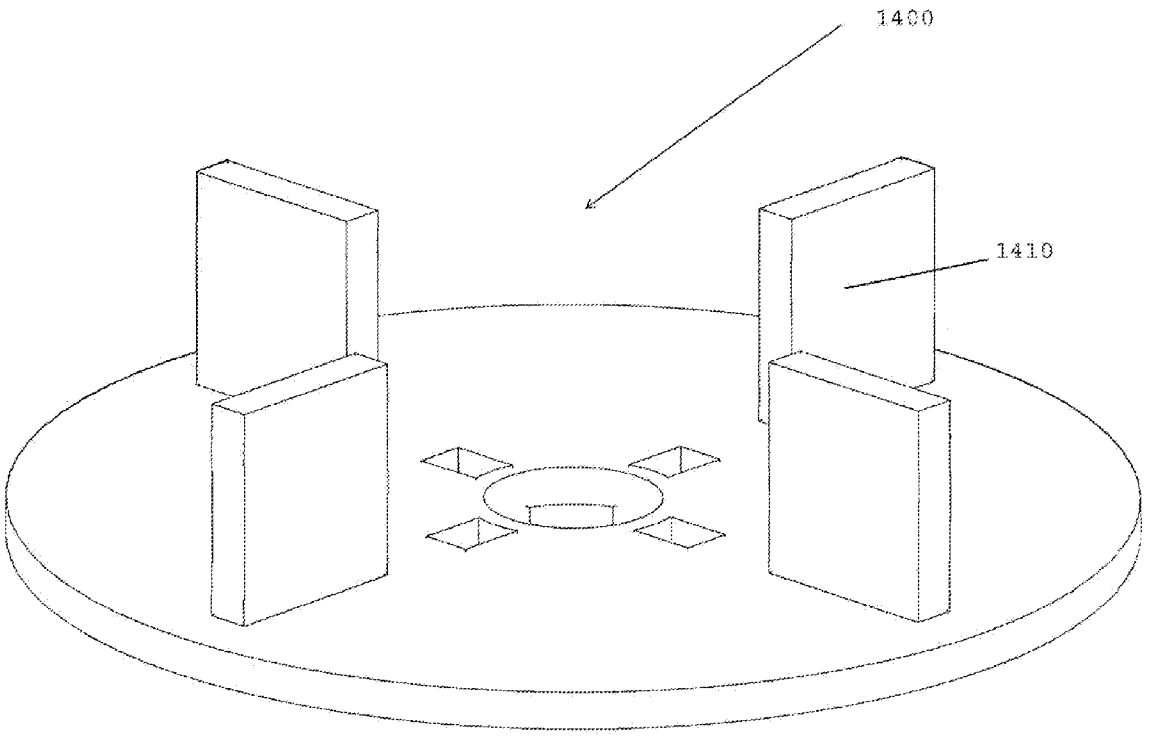
FIG. 5A is a top perspective view of a spacer 1400.
Figure 5B:
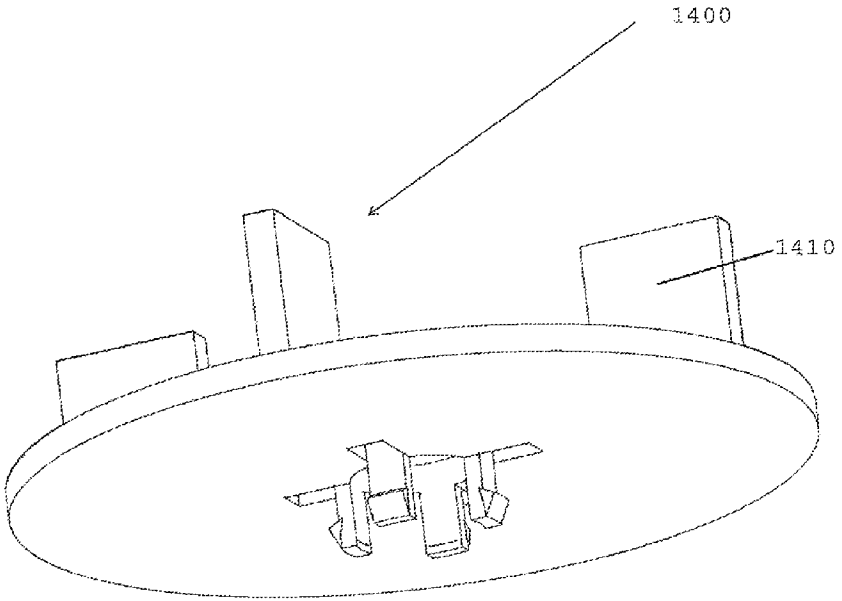
FIG. 5B is a bottom perspective view of the spacer 1400.
Figure 5C:
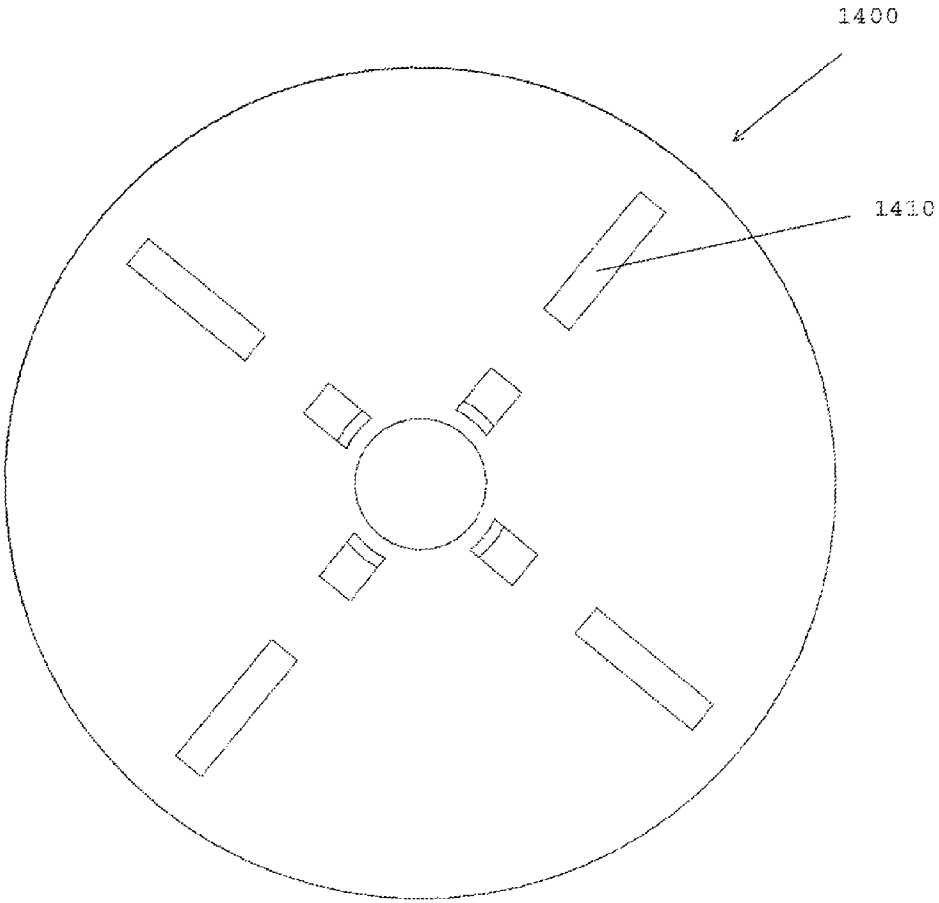
FIG. 5C is a top plan view of the spacer 1400.
Figure 5D:
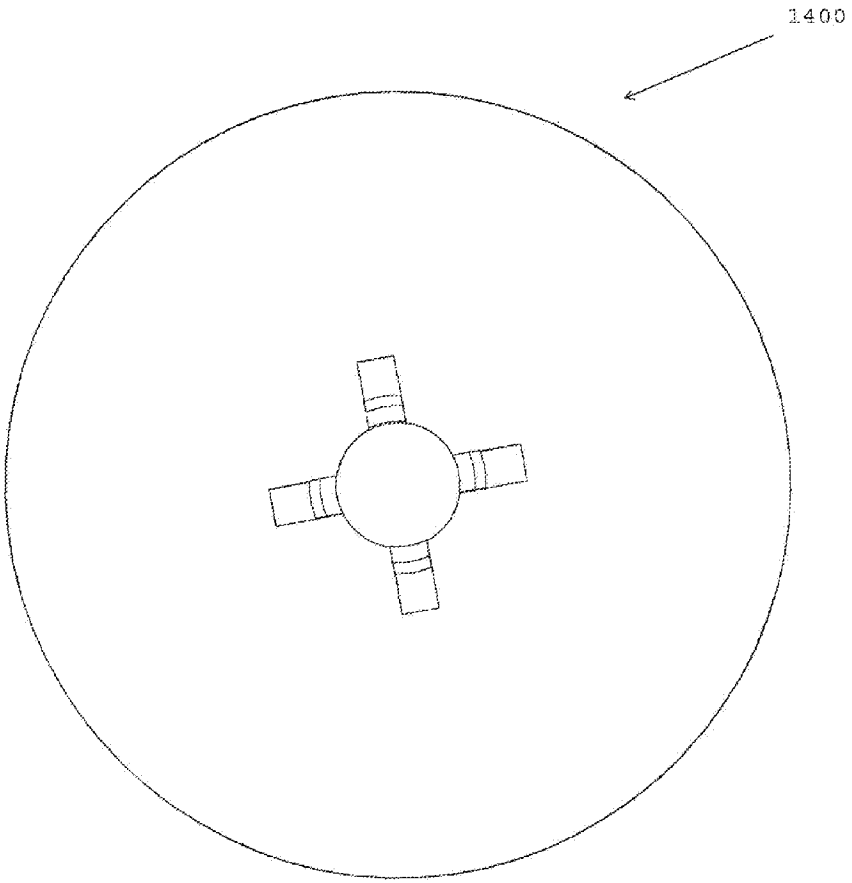
FIG. 5D is a bottom plan view of the spacer 1400.
Figure 5E:
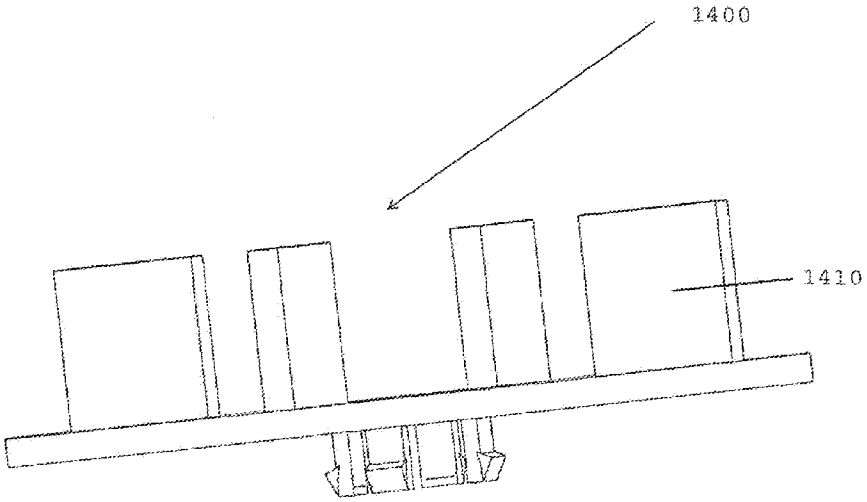
FIG. 5E is a side profile view of the spacer 1400.

FIGS. 4A through 4C depict different views of a preferable embodiment of the key 1300 component of the assembly 1000 depicted in FIGS. 1A and 1B. Specifically, FIGS. 4A through 4C respectively depict a top perspective, bottom perspective, and side profile view of the key 1300. As can be seen in the referenced drawings, the key 1300 is generally an elongated x-shaped member 1310 with a flange 1320. Referring to FIG. 4A, the elongated x-shaped member 1310 features locking lugs 1311 at its lower end and the flange 1320 features a coaxial wrench socket 1321.

FIGS. 5A through 5E depict different views of a preferable embodiment of the tile spacer 1400 component of the assembly 1000 depicted in FIGS. 1A and 1B. Specifically, FIGS. 5A through 5E respectively depict a top perspective, bottom perspective, top plan, bottom plan, and side profile view of the spacer 1400. As can be seen FIG. 1, the spacer 1400 is generally a disc that features projections 1410 that operate to divide the paver support surface 1230 of the cap 1200 into evenly spaced paver receptacles whereby pavers provided to the assembly 1000 may be uniformly oriented and spaced.

FIG. 1B shows a preferable method for assembling the assembly 1000. First, the base 1100 may be positioned so that the bottom side of the foot 1110 interfaces with a subsurface and wherein the cylinder 1120 extends outwardly and transversely relative to a plane of the subsurface. Second, the cap 1200 may be positioned on top of the cylinder 1120 of the base 1100 so that the concave surface 1140 of the base interfaces with the convex surface 1230 of the cap 1200 and wherein the key socket 1150 of the base 1100 is located within the key socket receptacle 1250. Third, the x-shaped member 1310 of the key 1300 may be inserted through the key socket receptacle 1250 and into the key socket 1150 until the locking teeth 1151 inside the key socket 1150 interact with the locking lug 1311 of the key 1300 so that: (1) the key 1300 is retained inside the key socket 1150; and (2) the cap 1200 is movably (e.g., slidably and/or rotatably) retained between the flange 1320 of the key 1300 and the concave surface 1140 of the base 1100. Finally, the tile spacer 1400 may be provided to the spacer receptacle 1240 of the cap 1200 whereby the spacer 1400 surface and the support surface 1230 of the cap 1200 generally form a plane.

Referring to FIG. 1, a paver may be supported above a subsurface via: positioning an assembly 1000, foot 1110 down, on the subsurface; rotating the cap 1200 around the key 1300 until the orientation of the projections 1410 of the spacer 1400 align with a planned paver surface; and providing a corner of the paver to the paver support surface 1230 whereby the sides of the paver abut the projections 1410. See FIG. 9 wherein the depicted pavers are supported, spaced, and oriented by an assembly 1000 with projections 1410.

It should be noted that although the spacer 1400 is depicted with four projections 1410 for dividing the surface 1230 into quadrants, the attachment may feature less or more projections 1410 to accommodate the orientation and spacing of non-square pavers. It should further be noted that the projections 1410 may feature perforations (not shown) whereby the projections 1410 may be individually removed from the spacer 1400. For instance, two of the four projections 1411 may be removed from the attachment whereby the side of a square paver, instead of its corner, may be received by the paver support surface 1240 of the cap 1200. Finally: the dimensions of the assembly 1000 will vary with the size of the paver to be retained by the paver support surface 1230. In particular, the height of the projections may vary depending on the thickness of a paver, e.g. in a range of about 0 to 20 inches.

It should be noted that, now, and throughout the application the terms "top" and "bottom" or "lower" and "upper", or any other orientation defining term should in no way be construed as limiting of the possible orientations of the assembly 1000 (i.e., the assembly may be positioned sideways, or in reversed vertical orientations even though the specification refers to a "top" and "bottom" parts).

Figure 2A:
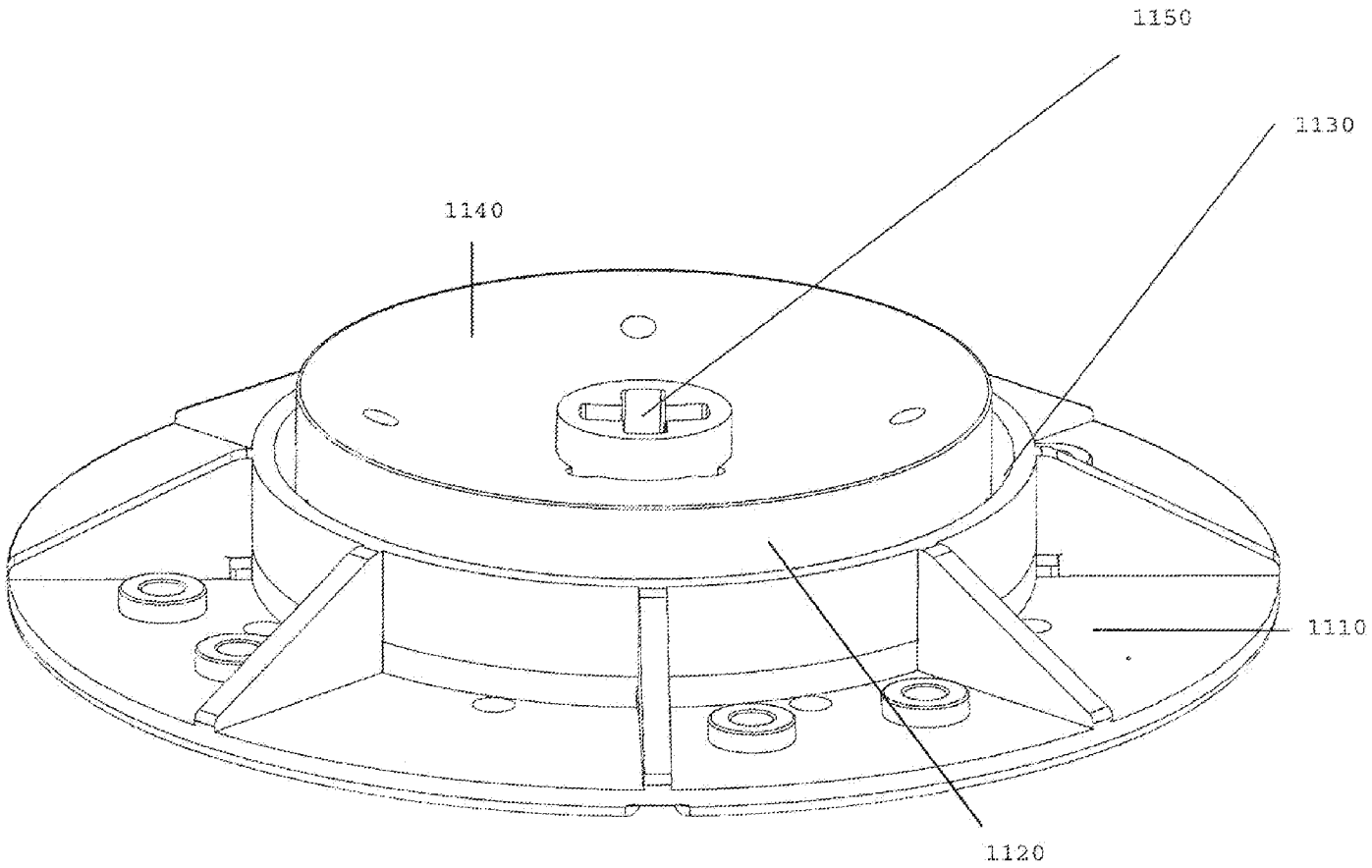
FIG. 2A is a top perspective view of a base 1100.
Figure 2B:
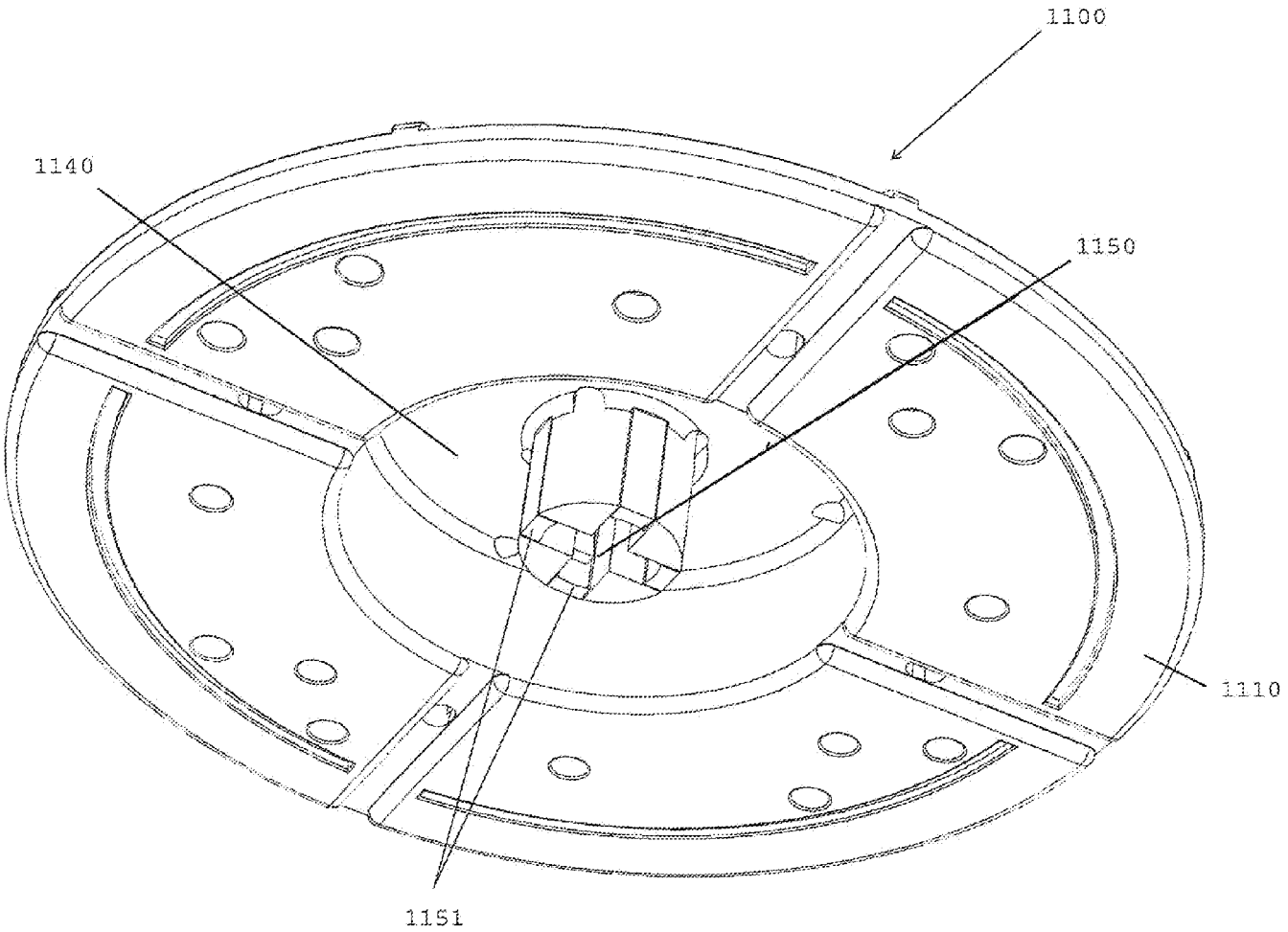
FIG. 2B is a bottom perspective view of the base 1100.
Figure 2C:
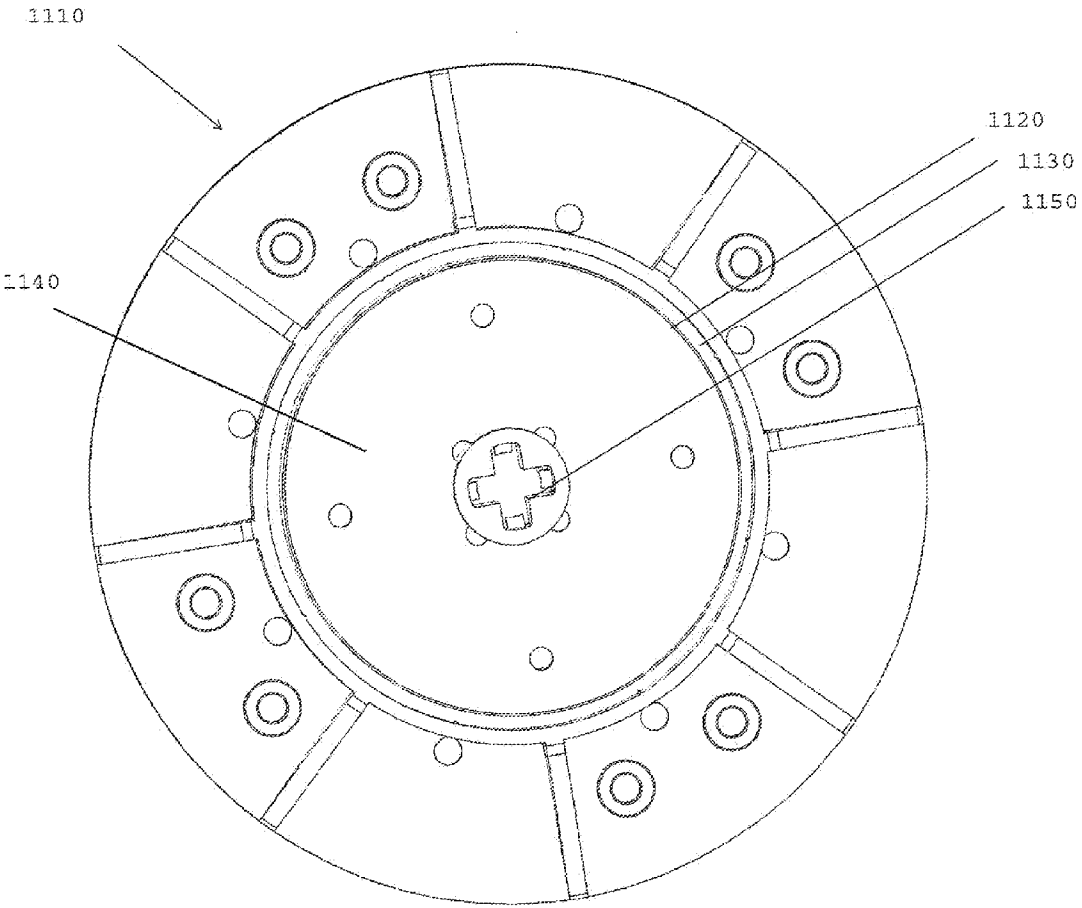
FIG. 2C is a top plan view of the base 1100.
Figure 2D:
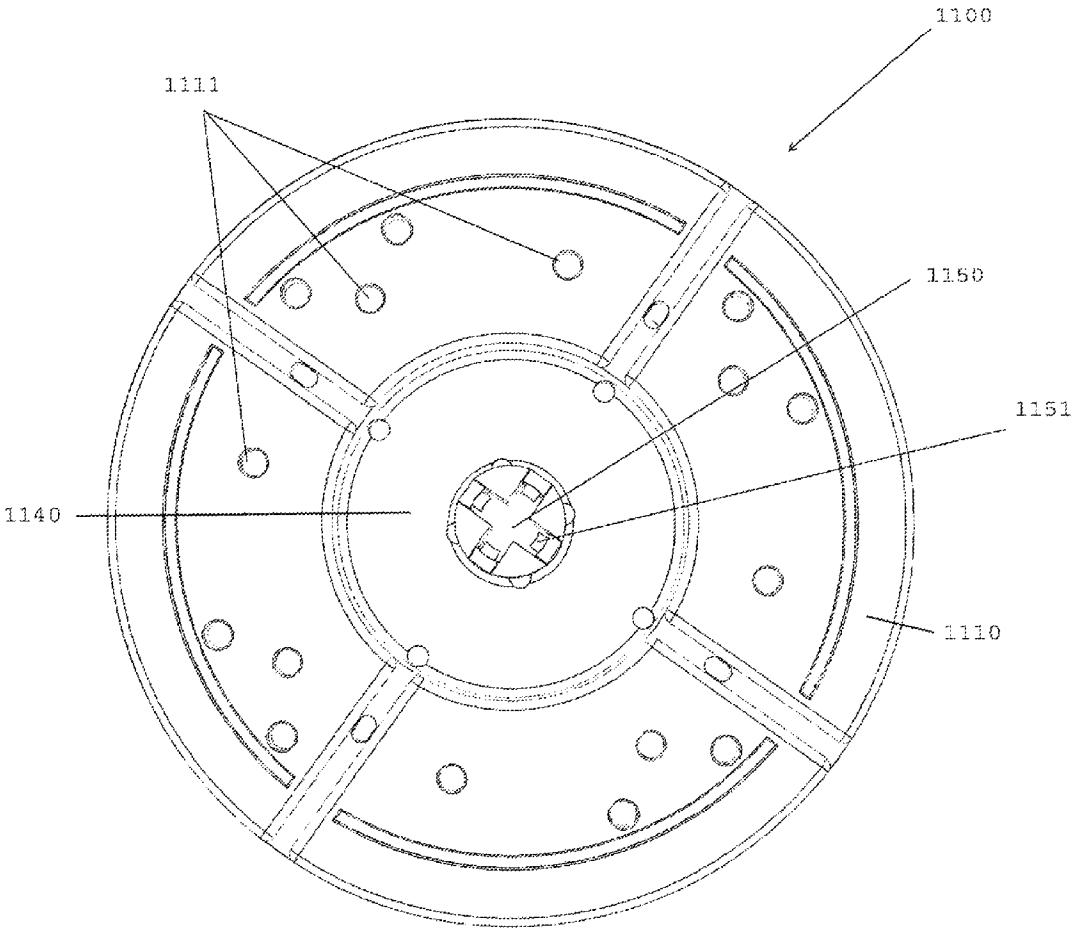
FIG. 2D is a bottom plan view of the base 1100.
Figure 2E:
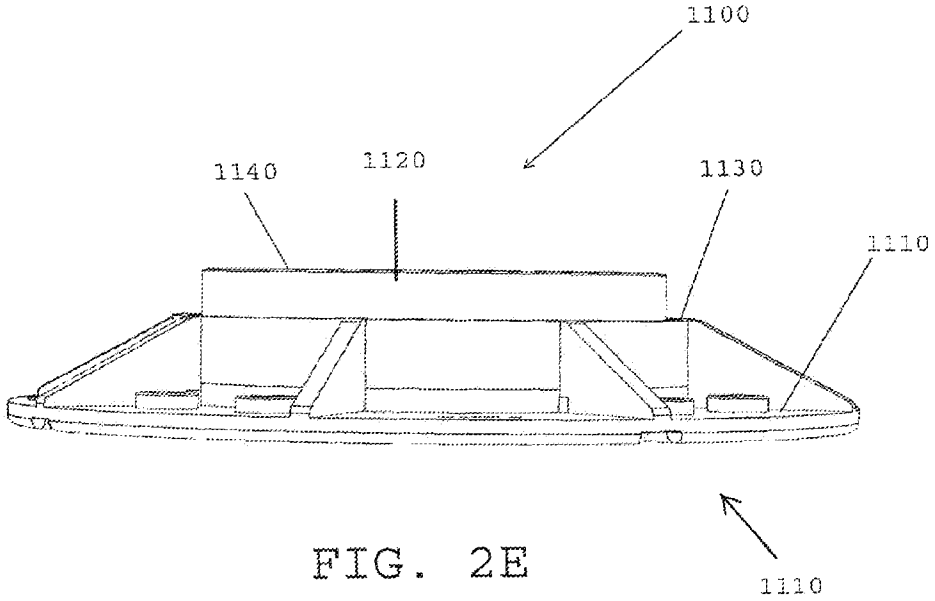
FIG. 2E is a side profile view of the base 1100.
Figure 6A:
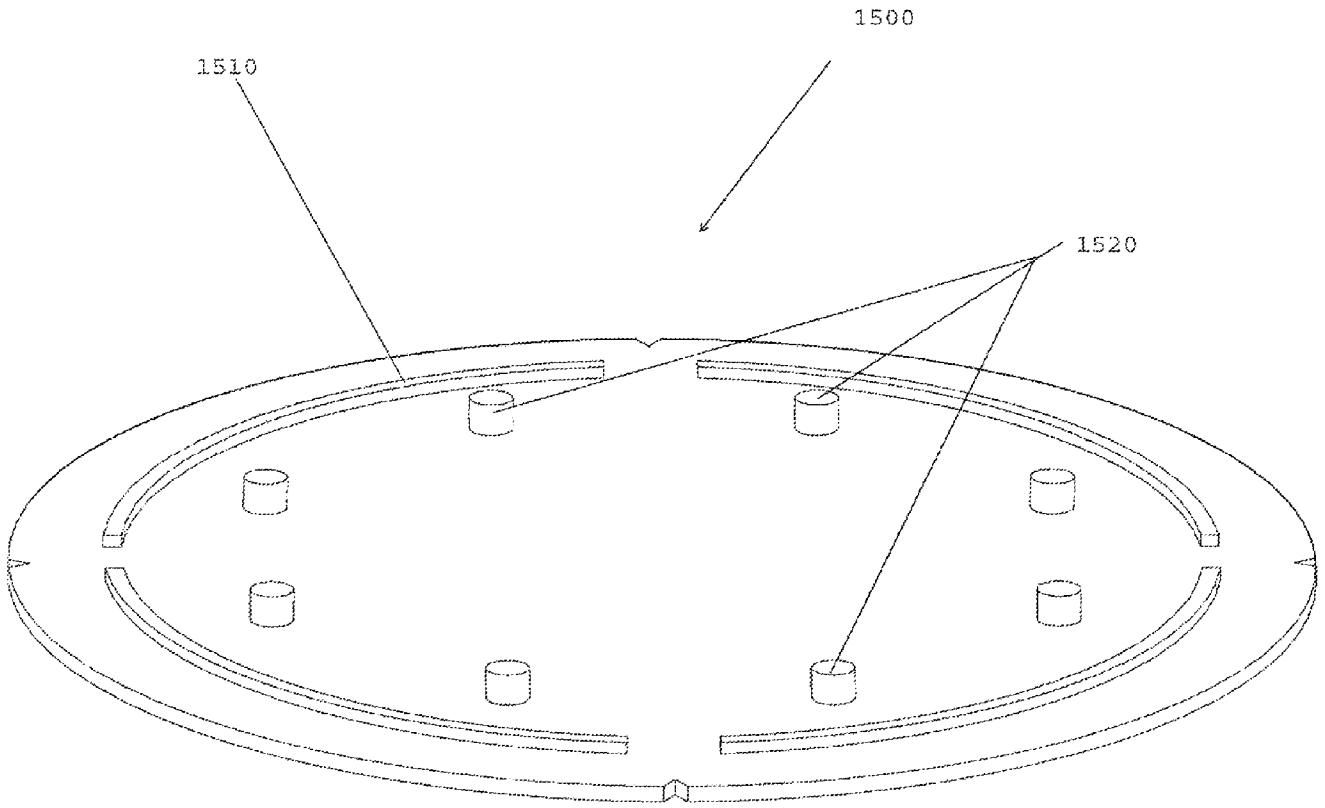
FIG. 6A is a top perspective view of a buffer 1500.
Figure 6B:
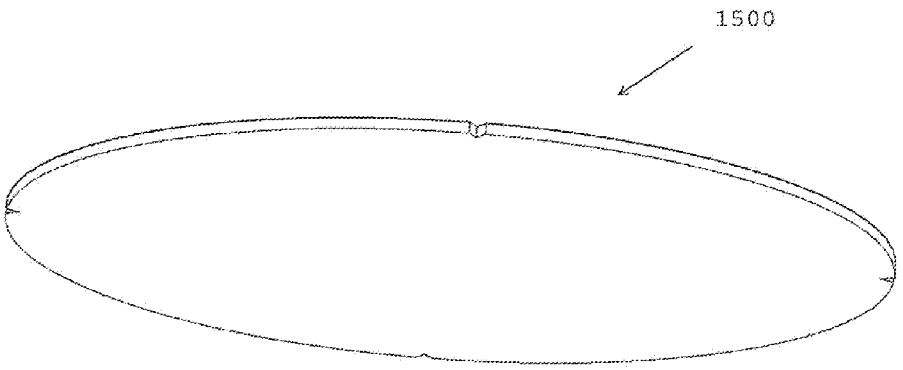
FIG. 6B is a bottom perspective view of the buffer 1500.
Figure 6C:
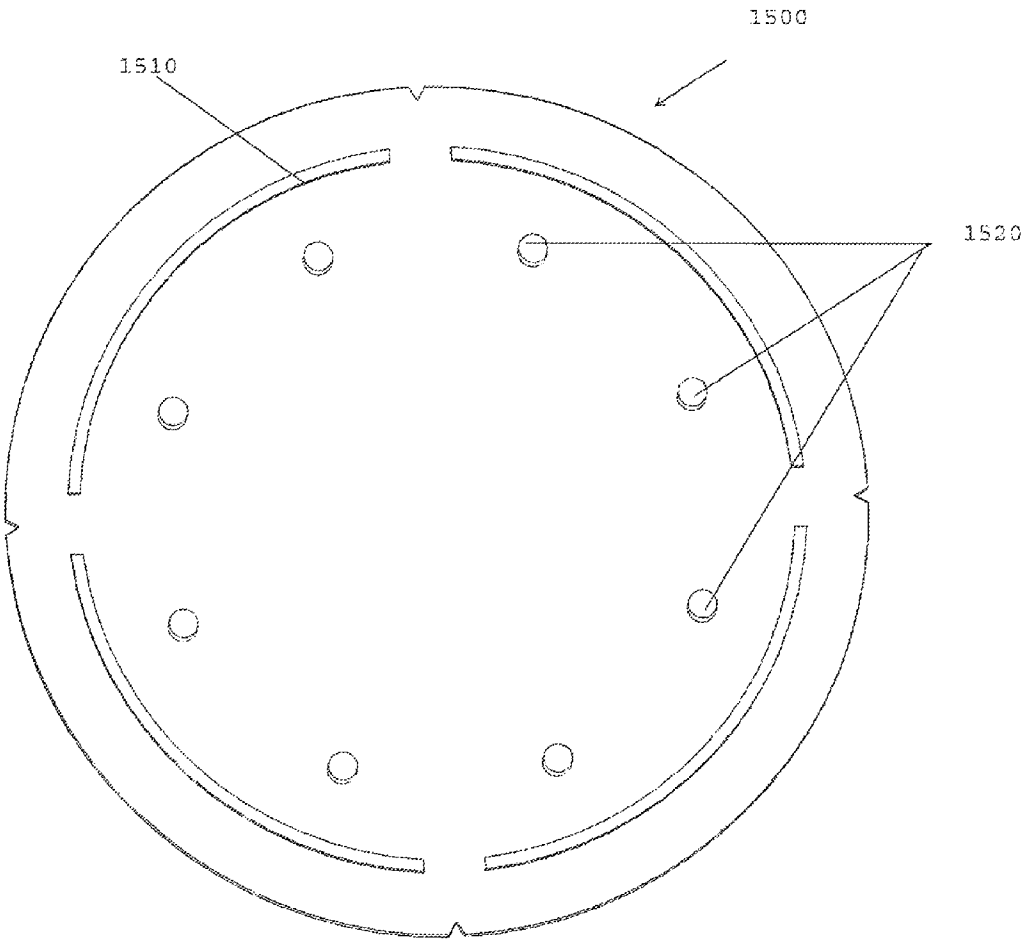
FIG. 6C is a top plan view of the buffer 1500.
Figure 6D:
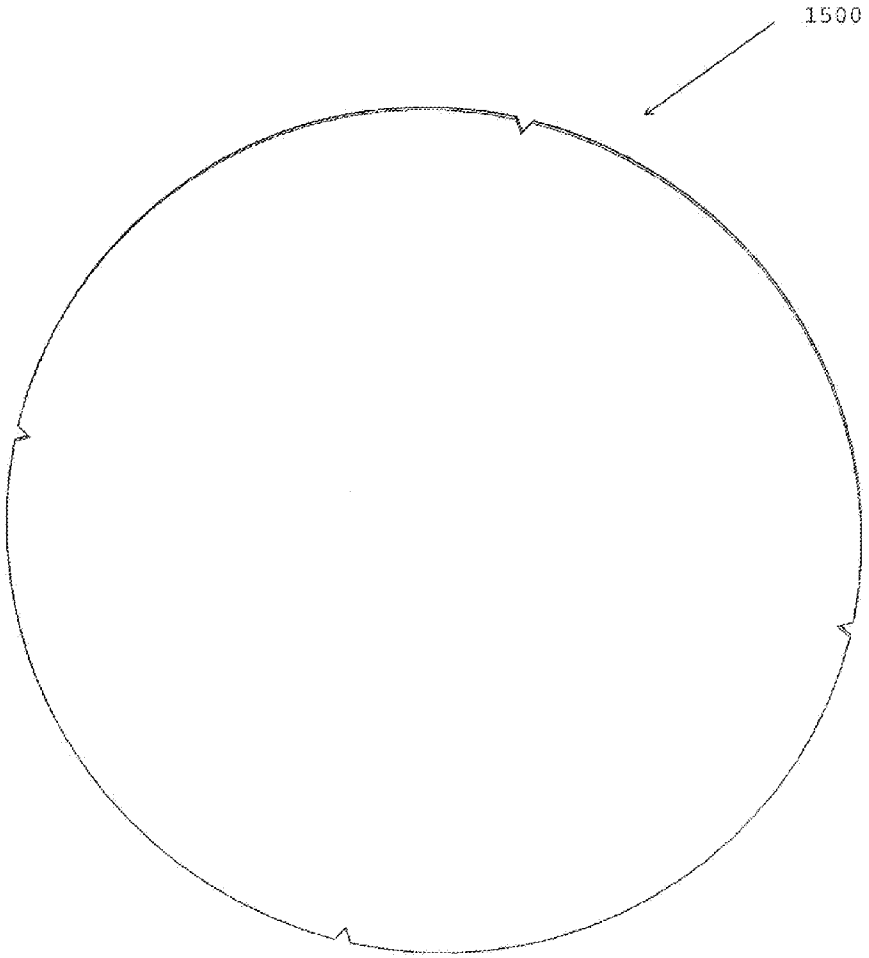
FIG. 6D is a bottom plan view of the buffer 1500.
Figure 6E:
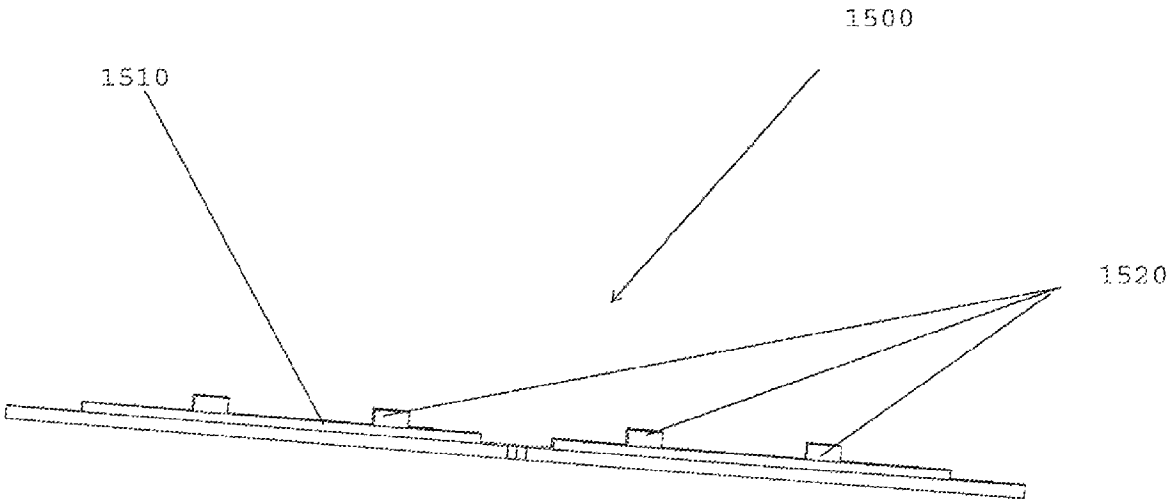
FIG. 6E is a side profile view of the buffer 1500.

Referring still to FIG. 1, the foot 1110 of is adapted to support the assembly 1000 on a substrate or subsurface. This said, there may be instances where the substrate may be sensitive and require a larger footprint than that provided by the foot 1110. For instance, the substrate may feature a waterproofing means that may be punctured by the weight of a paver on the assembly 1000. In such a circumstance, the foot print of the foot 1110 may be supplemented with a buffer, 1500 as best depicted in FIGS. 6A, through 6E, which respectively depict a top perspective, bottom perspective, top plan, bottom plan, and side profile view of the buffer 1500. Referring to FIGS. 1A and 6A, the buffer 1500 may generally be a disc with an upward projection 1510 of slightly larger plan than the plan of foot 1110 of the assembly 1000 whereby the foot 1110 may be retained therein and where the disc of the buffer 1500 distributes the footprint of the assembly 1000 over a wider area. In one embodiment, the underside of the foot 1110, as seen in FIG. 2D, features tenons 1111 which may cooperate with mortise 1520, shown in FIG. 6A, so that the assembly may be positioned on the buffer 1500 with greater stability. Other features of the buffer 1500 will be set forth in greater detail below.

Figure 3A:
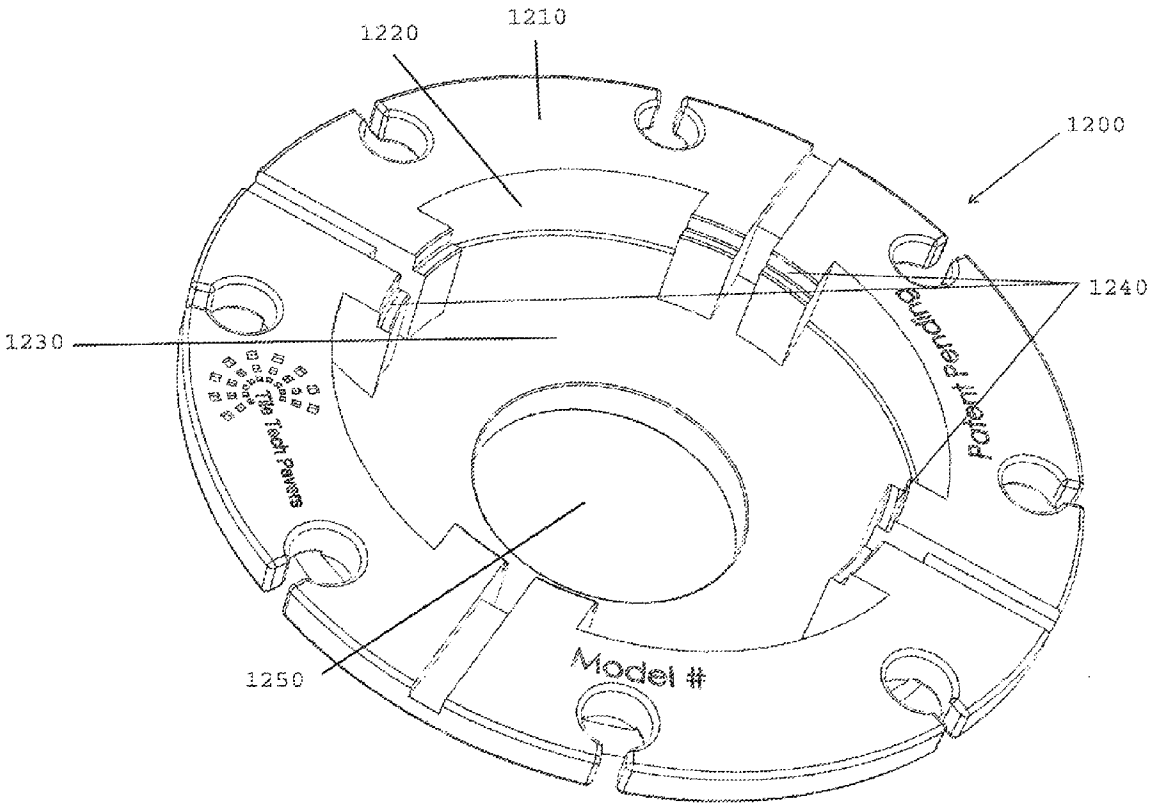
FIG. 3A is a top perspective view of a cap 1200.
Figure 3B:
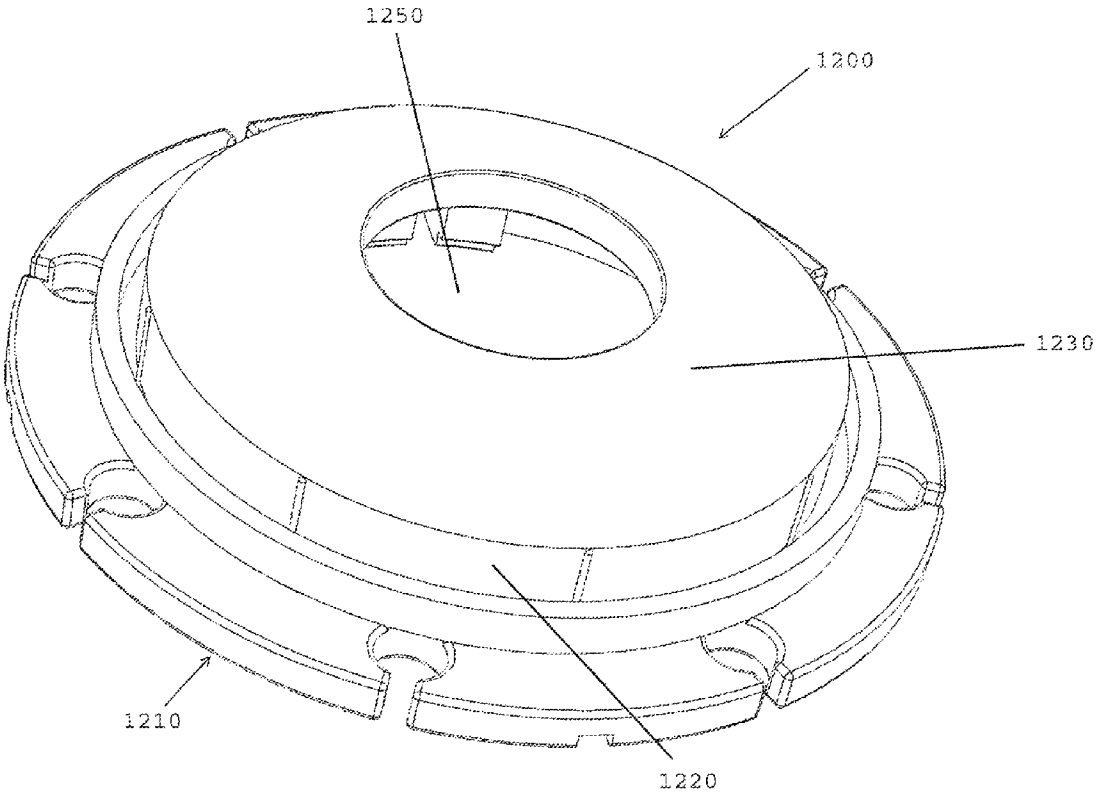
FIG. 3B is a bottom perspective view of the cap 1200.
Figure 3C:
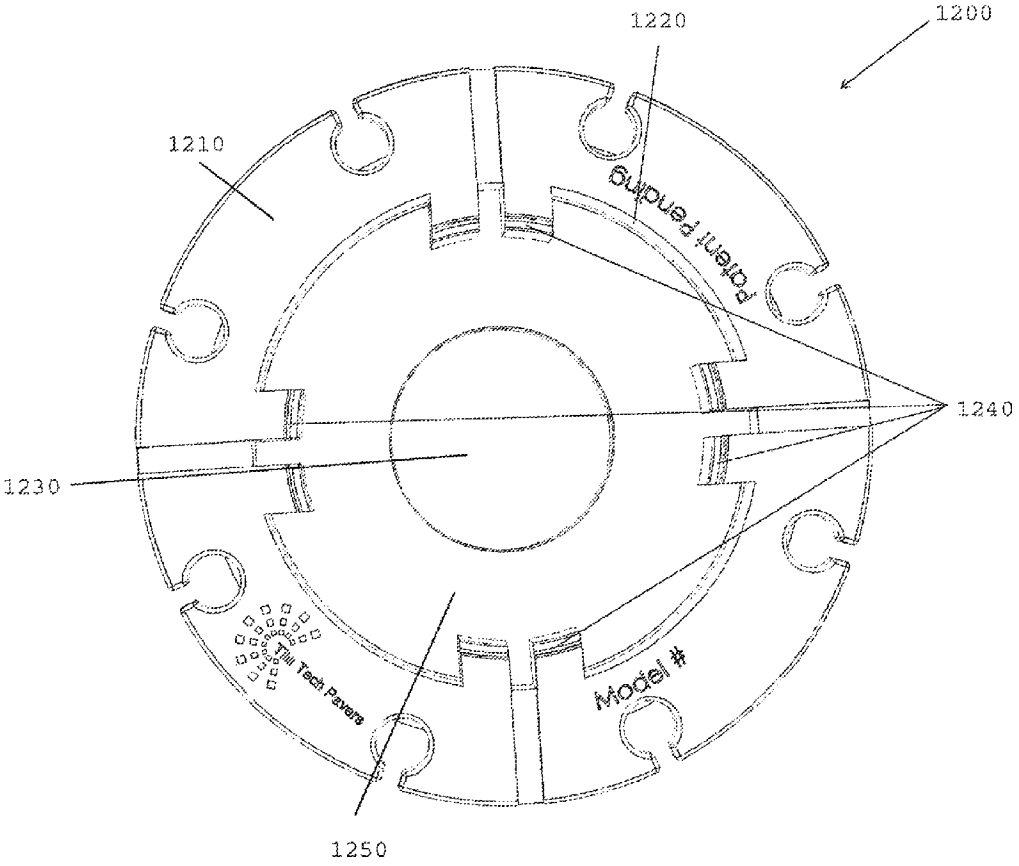
FIG. 3C is a top plan view of the cap 1200.
Figure 3D:
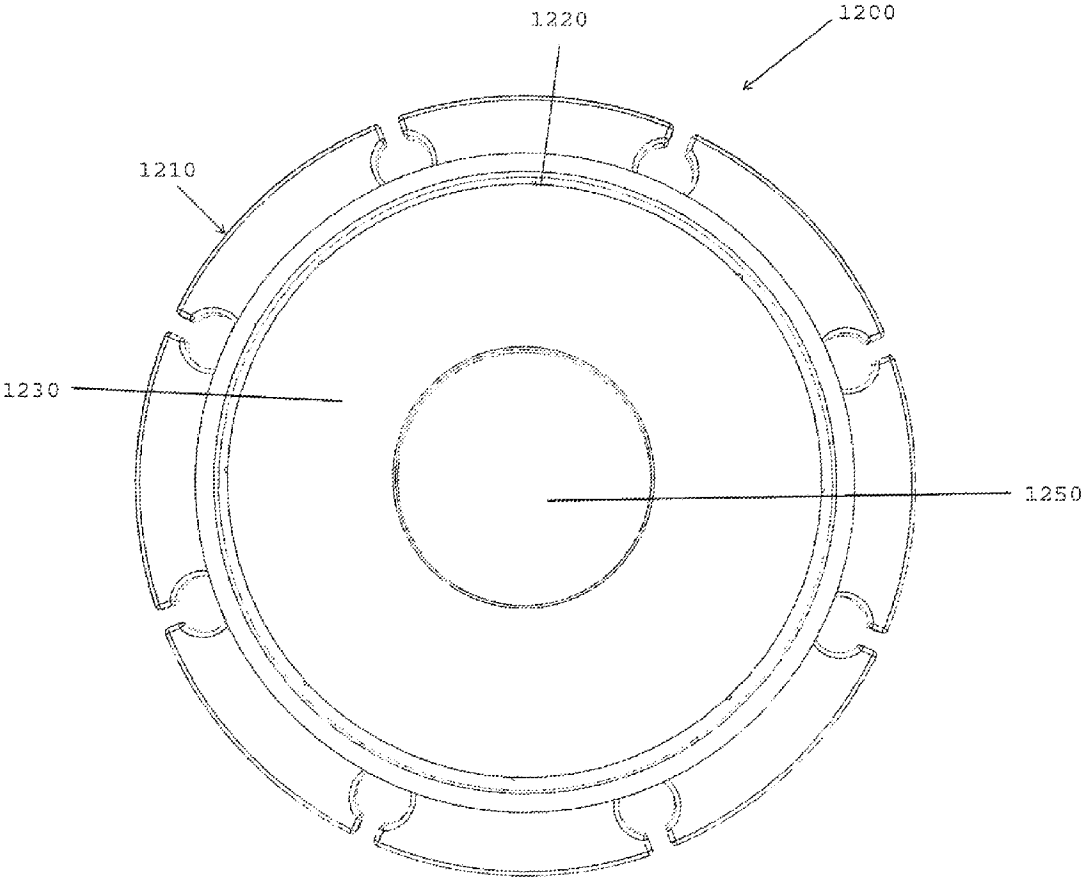
FIG. 3D is a bottom plan view of the cap 1200.
Figure 3E:
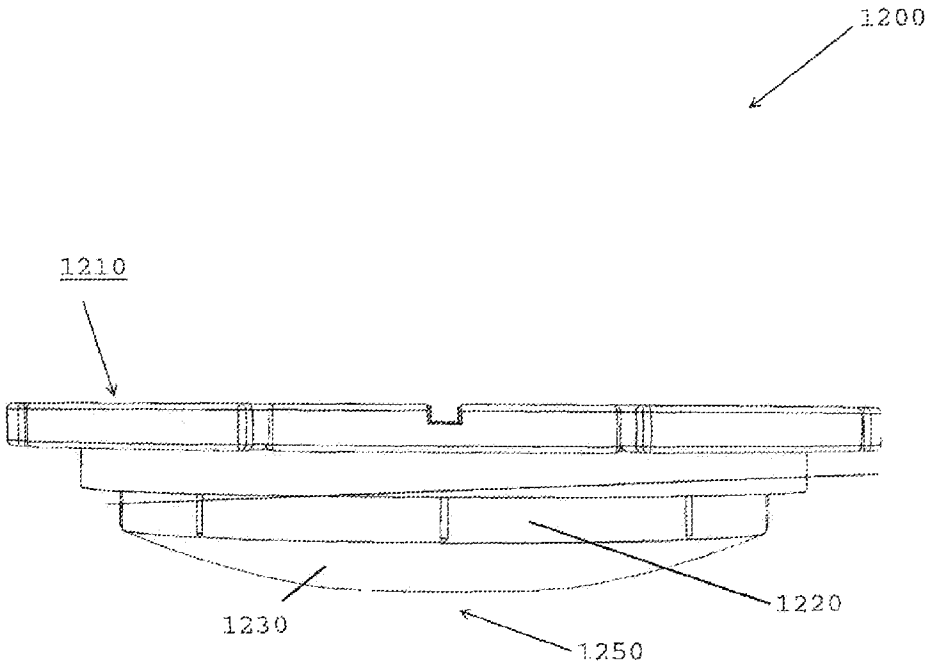
FIG. 3E is a side profile view of the cap 1200.
Figure 7:
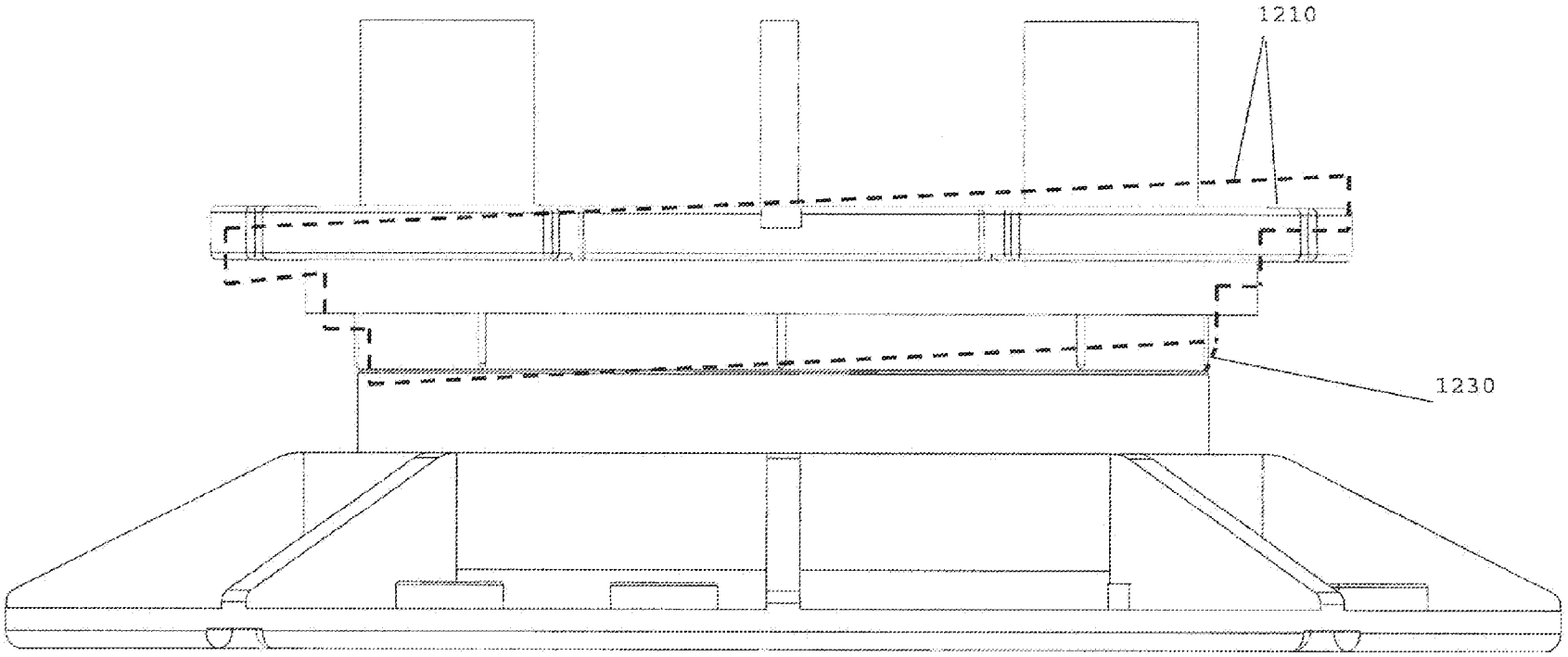
FIG. 7 depicts a side view of the assembly 1000 and illustrates one mode establishing a leveled surface.

As alluded to above, the disclosed assembly may used for establishing a level paver surface over a sloped subsurface. FIG. 7 depicts a side view of the assembly 1000 and illustrates one mode establishing such leveled surface. Referring first to FIGS. 7, 2A and 3E, the base 1100 suitably features a concave surface 1140 and the cap 1200 suitably features a convex surface whereby the slope of the paver support surface 1230 may be skewed in any direction relative to the plane of the foot 1110 of the base 1100 via sliding the convex surface 1230 of the cap 1200 along the concave surface 1140 of the base 1100. In one embodiment, the paver support surfaces 1230 of four assemblies 1000 positioned at the four corners of a square paver will self level with respect to one another under the weight of the pavers installed thereon the assemblies 1000.

Figure 8C:
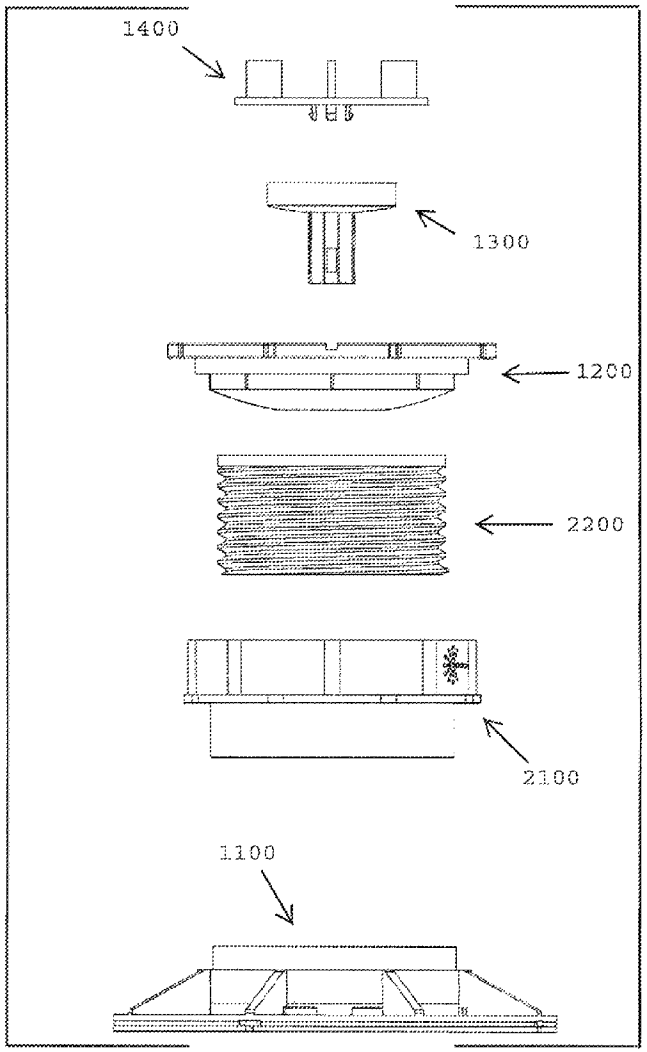
FIG. 8C is an exploded view of the second embodiment of the assembly 2000.
Figure 8A:
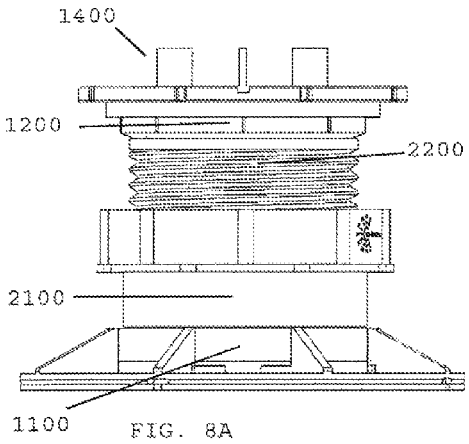
FIG. 8A is a perspective view of the second embodiment of an assembly 2000 in a first configuration.
Figure 8B:
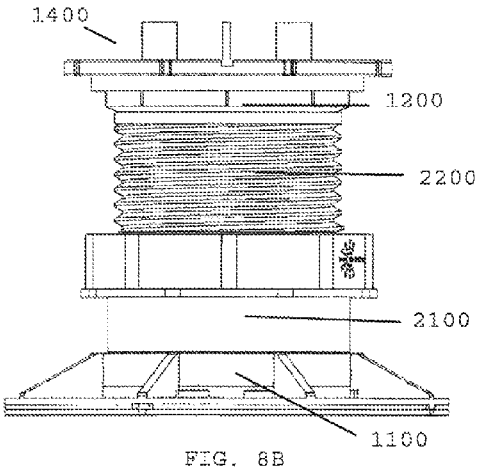
FIG. 8B is a perspective view of the second embodiment of the assembly 2000 in a second configuration.
Figure 9A:
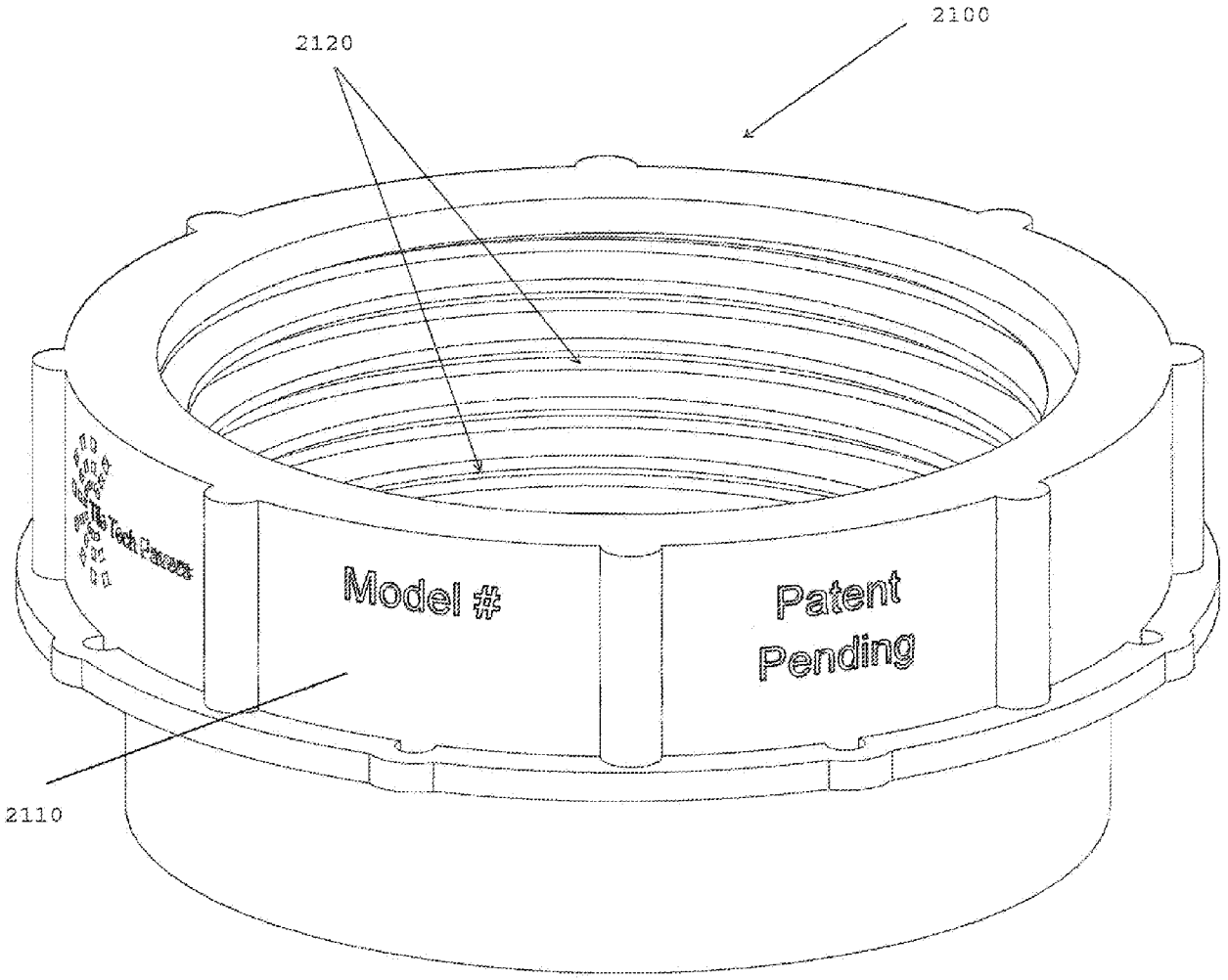
FIG. 9A is a top perspective view of a threaded collar 2100.
Figure 9B:
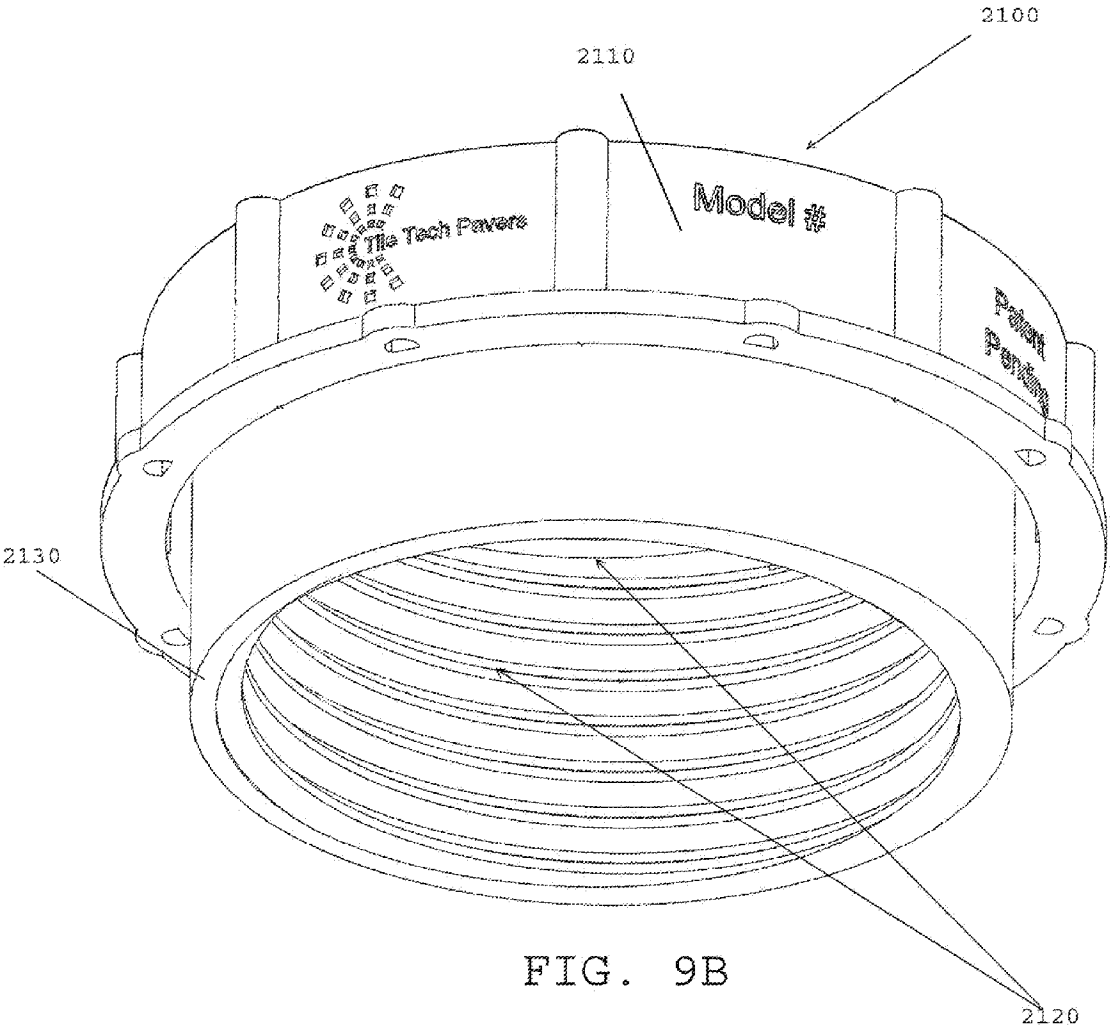
FIG. 9B is a bottom perspective view of the threaded collar 2100.
Figure 9C:
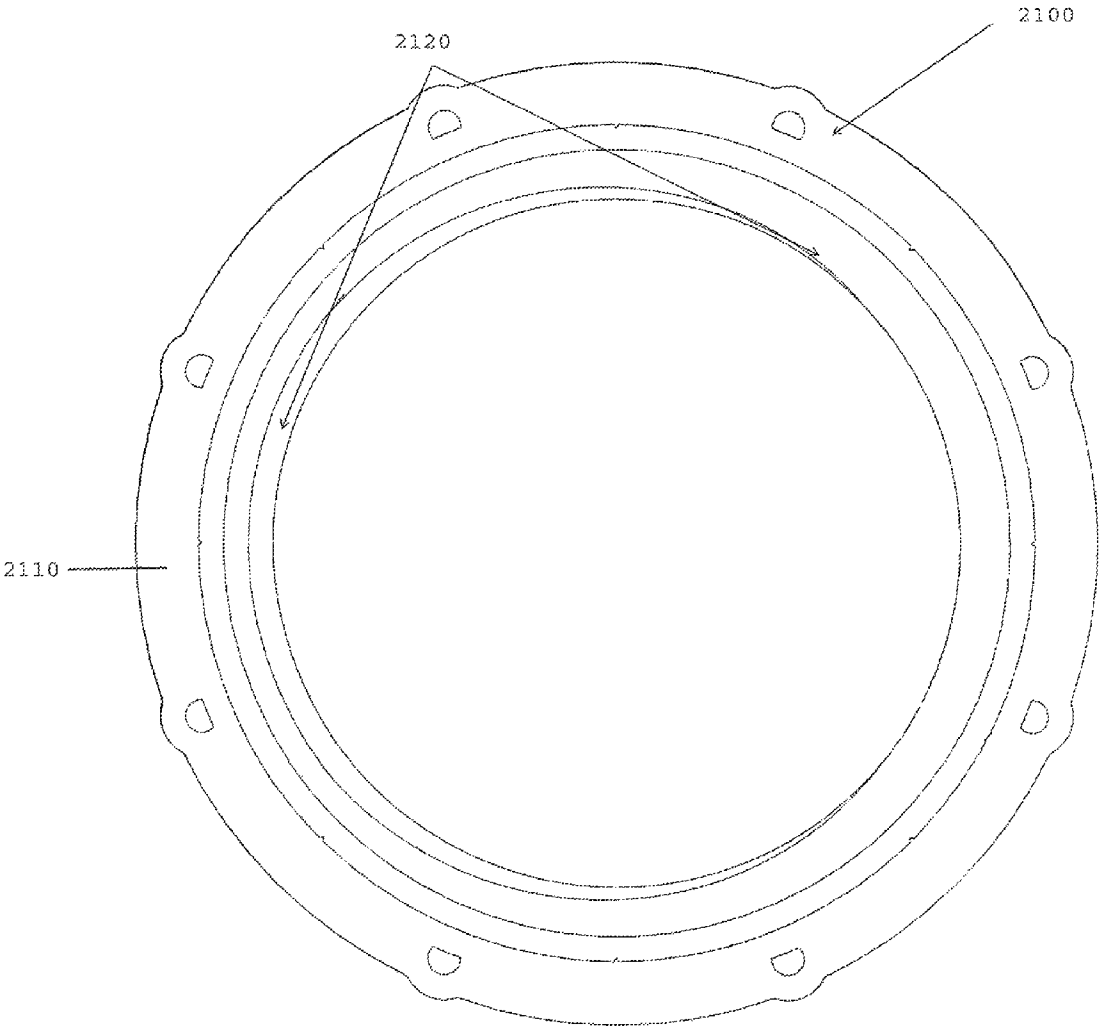
FIG. 9C is a top plan view of the threaded collar 2100.
Figure 9D:
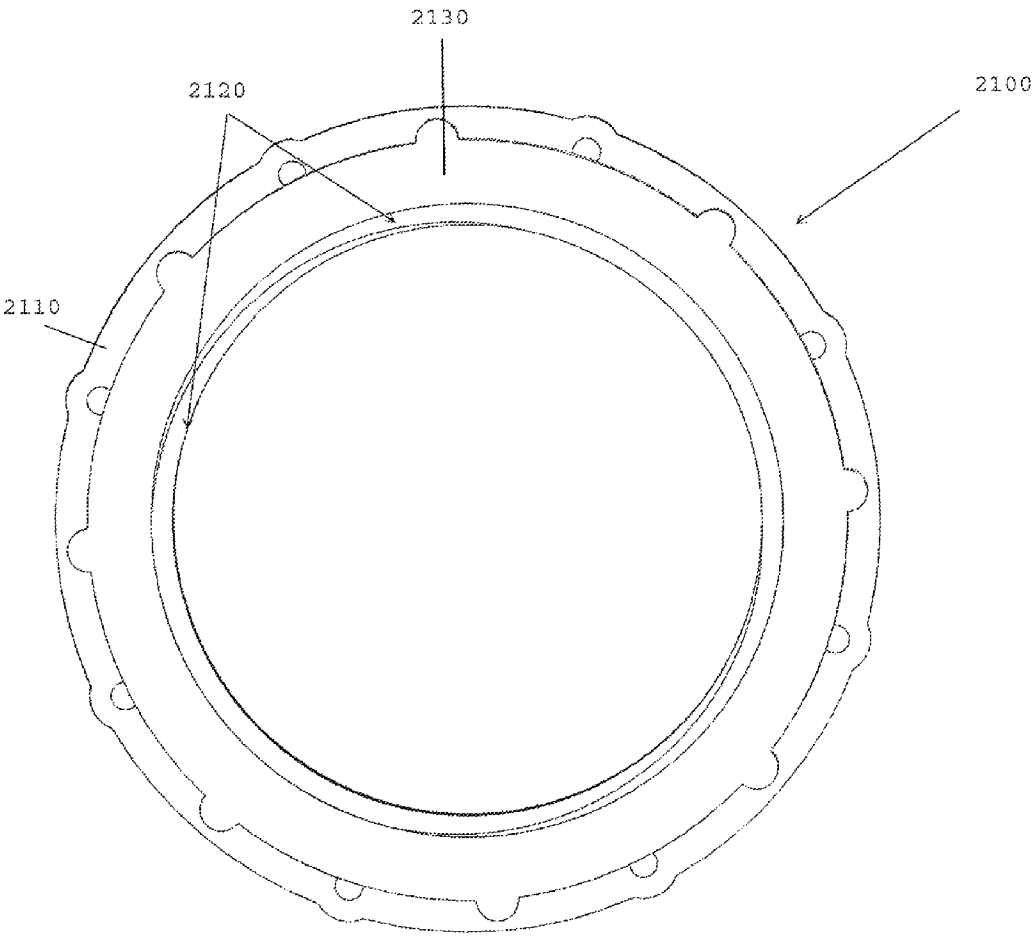
FIG. 9D is a bottom plan view of the threaded collar 2100.
Figure 9E:
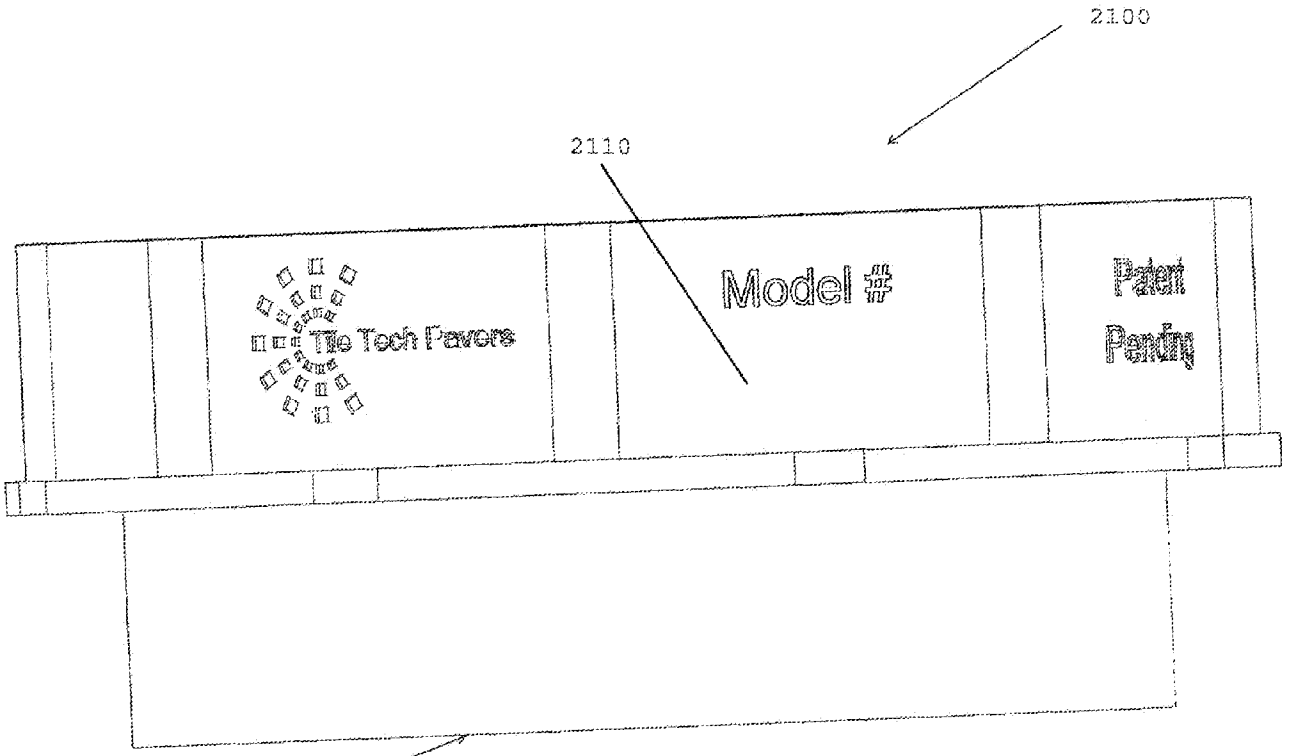
FIG. 9E is a side profile view of the threaded collar 2100.

FIGS. 8A through 8C depict a second embodiment of an assembly 2000 for facilitating the elevated and leveled placement of a paver array onto a subsurface. FIG. 8A is a perspective view of the assembly 2000 in a first configuration; FIG. 8B is a perspective view of the assembly 2000 in a second configuration; and FIG. 8C is an exploded view of the assembly 2000. As seen in the figures the assembly 2000, like the assembly of FIGS. 1A and 1B, comprises: a base 1100; a cap 1200; a key 1300; and, a tile spacer 1400. The structure and operability of those components are the same as described above in connection with the first embodiment of an assembly 1000. Unlike the assembly 1000 of FIGS. 1A and 1B, the assembly 2000 further comprises a female threaded collar 2100; and a male threaded insert 2200.

FIGS. 9A through 9E depict different views of a preferable embodiment of the threaded collar 2100 component of the apparatus 2000 depicted in FIGS. 8A through 8C. Specifically, FIGS. 9A through 9E respectively depict a top perspective, bottom perspective, top plan, bottom plan, and side profile view of the threaded collar 2100. As can be seen in the referenced drawings, the threaded collar 2100 is generally a truncated tubiform with; a grip flange 2110; female threads 2120 on the inside of its tubiform; and a foot 2130.

FIGS. 10A through 10E depict different views of a preferable embodiment of the threaded insert 2200 component of the apparatus 2000 depicted in FIGS. 8A through 8C. Actually, FIGS. 10A through 10E respectively depict a top perspective, bottom perspective, top plan, bottom plan, and side profile view of the threaded insert 2200. As can be seen in the referenced drawings, the threaded insert is generally a truncated cylinder and may comprise: a foot 2210; a male threads 2220 on the outside surface of its cylinder shape; a concave surface 2240 defining the top of the cylinder; and a key socket 2250 through the concave surface 2240 along the axis of the cylinder.

FIG. 8C shows a preferable method for assembling the first embodiment of the assembly 1000. First, the base 1100 may be positioned so that the bottom side of the foot 1110 interfaces with a subsurface and wherein the cylinder 1120 extends outwardly and transversely relative to a plane of the subsurface. Second, a riser 4200 (e.g., a pipe section) may be positioned within the riser receptacle 2130 of the base 2100.

Third, the foot 2130 of the threaded collar 2100 may be provided to the top of the riser 4200 so that the foot 2130 of the threaded collar 4100 is positioned inside of the riser 4200. Fourth, the foot 2210 of the threaded insert 2200 may be provided to the top of the threaded collar 2100 so that the threads 2120 of the collar 2100 and the threads 2220 of the insert 2200 cooperate to drive the insert 2200 to within the tubiform of the collar 4100. Fifth, the foot 2210 of the threaded insert 2200 may be provided to the top of the threaded collar 2100 so that the threads 2120 of the collar 2100 and the threads 2220 of the insert 2200 cooperate to drive the insert 2200 to within the tubiform of the collar 2100. sixth, the cap 1200 may be positioned on top of the threaded insert 2200 so that the concave surface 2240 of the insert 2200 interfaces with the convex surface 1230 of the cap 1200 and wherein the key socket 2250 of the insert 2200 is located within the key socket receptacle 1250 of the cap 1200. seventh, the x-shaped member 1310 of the key 1300 may be inserted through the key socket receptacle 1250 and into the key socket 2250 until the locking teeth 2251 inside the key socket 2250 interact with the locking lug 1311 of the key 1310 so that: (1) the key 1300 is retained inside the key socket 2250; and (2) the cap 1200 is movably (e.g., slidably and/or rotatably) retained between the flange 1320 of the key 1320 and the concave surface 2240 of the threaded insert 2200. Finally, the tile spacer 1400 may be provided to the spacer receptacle 1240 of the cap 1200 whereby the spacer 1400 surface and the support surface 1230 of the cap 1200 generally form a plane.

Referring to FIGS. 8A and 8B, a paver may be supported above a subsurface via: positioning an assembly 2000, foot 1110 down, on the subsurface; rotating the cap 1200 around the key 1300 until the orientation of the projections 1410 of the spacer 1400 align with a planned paver surface; and providing a corner of the paver to the paver support surface 1230 whereby the sides of the paver abut the projections 1410.

Figure 10A:
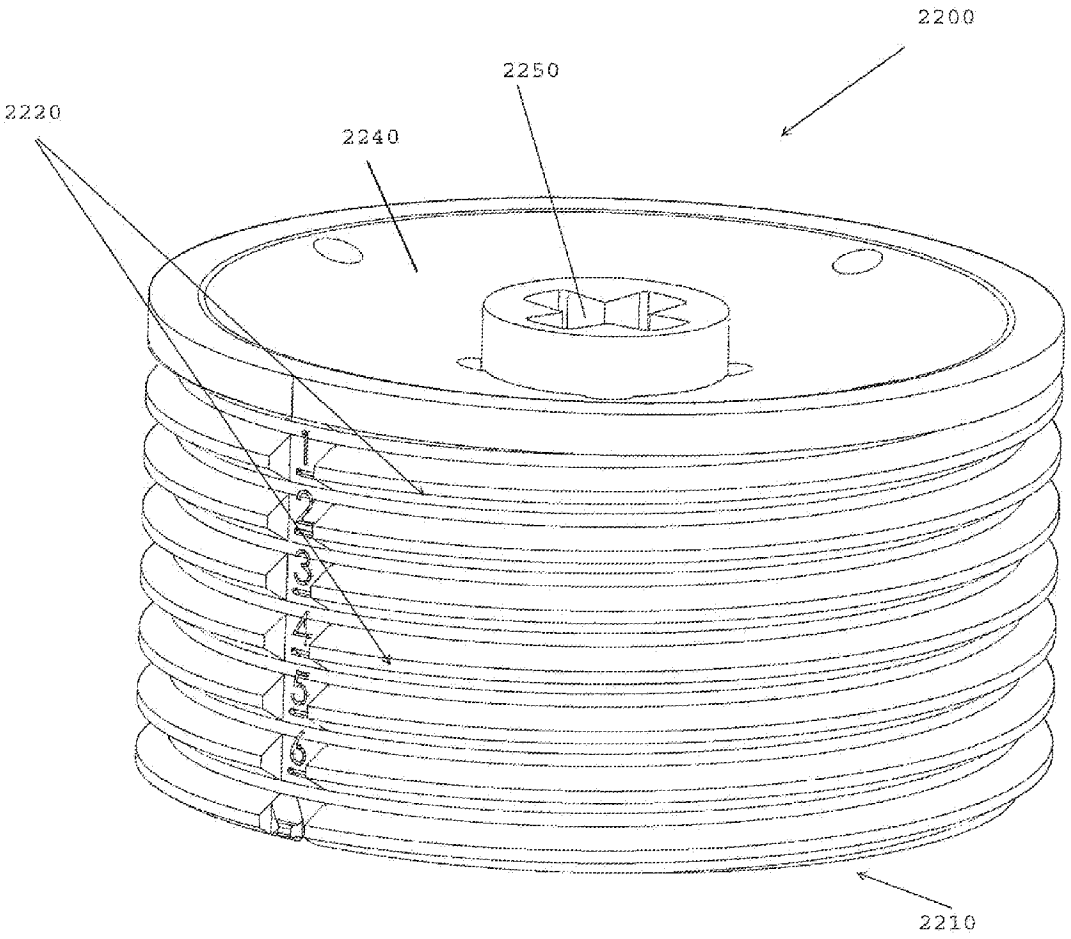
FIG. 10A is a top perspective view of a threaded insert 2200.
Figure 10B:
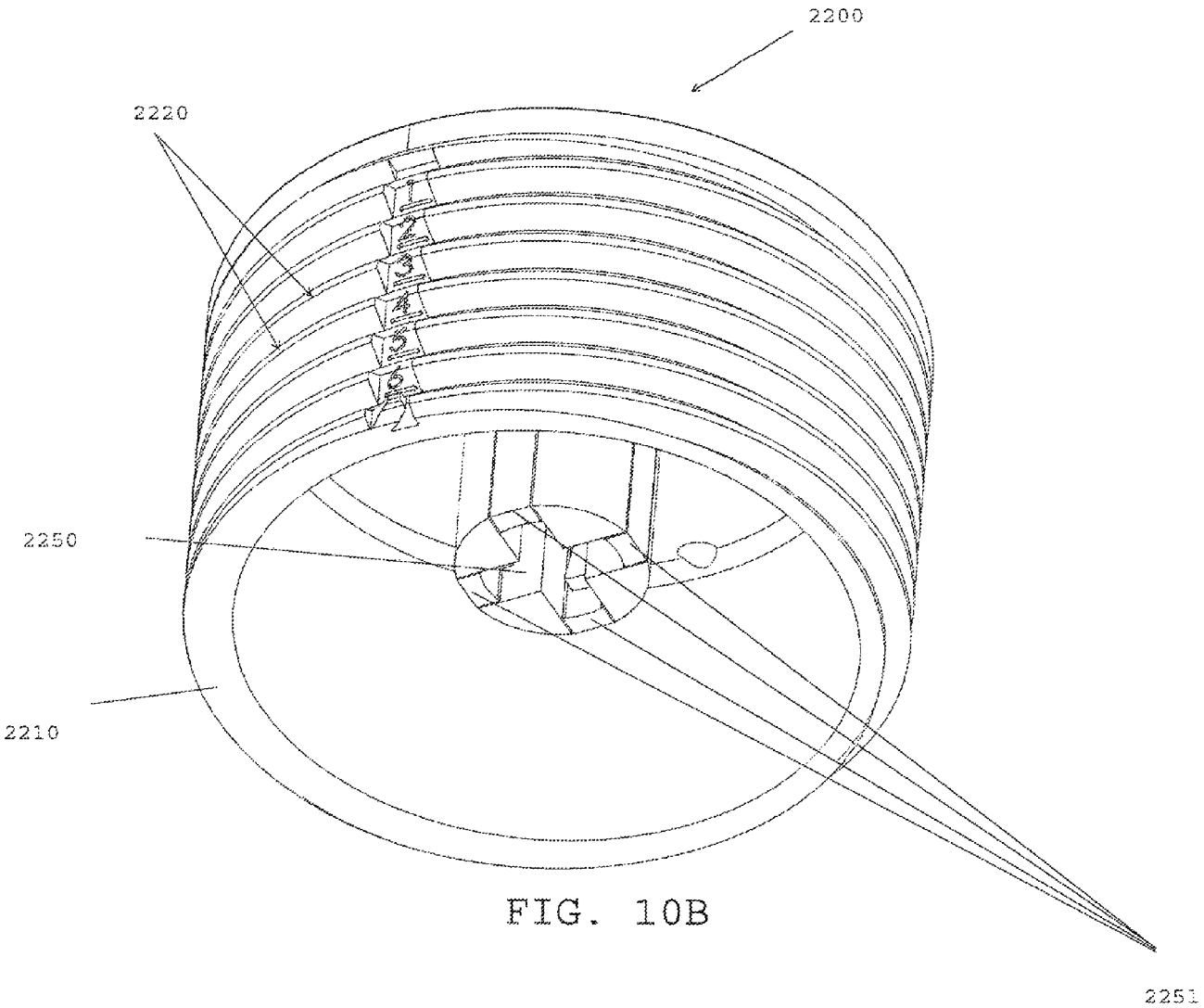
FIG. 10B is a bottom perspective view of the threaded insert 2200.
Figure 10C:
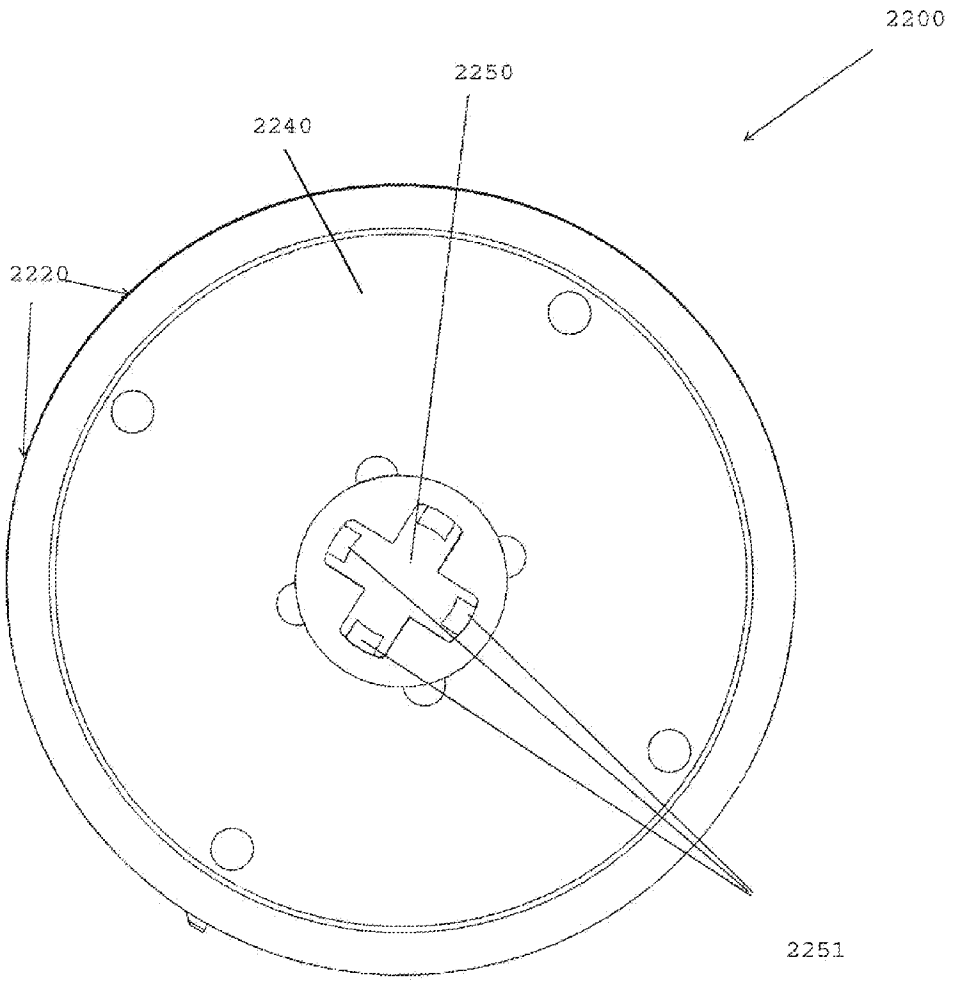
FIG. 10C is a top plan view of the threaded insert 2200.
Figure 10D:
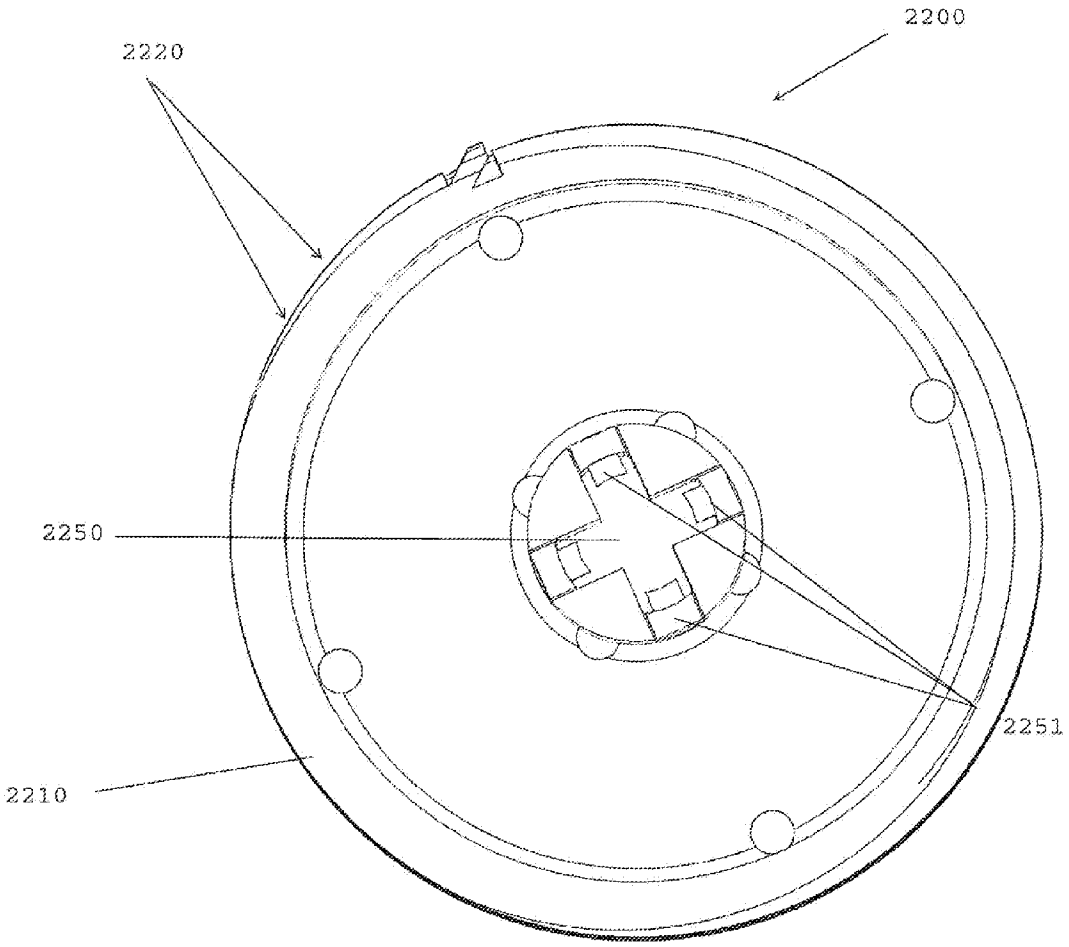
FIG. 10D is a bottom plan view of the threaded insert 2200.
Figure 10E:
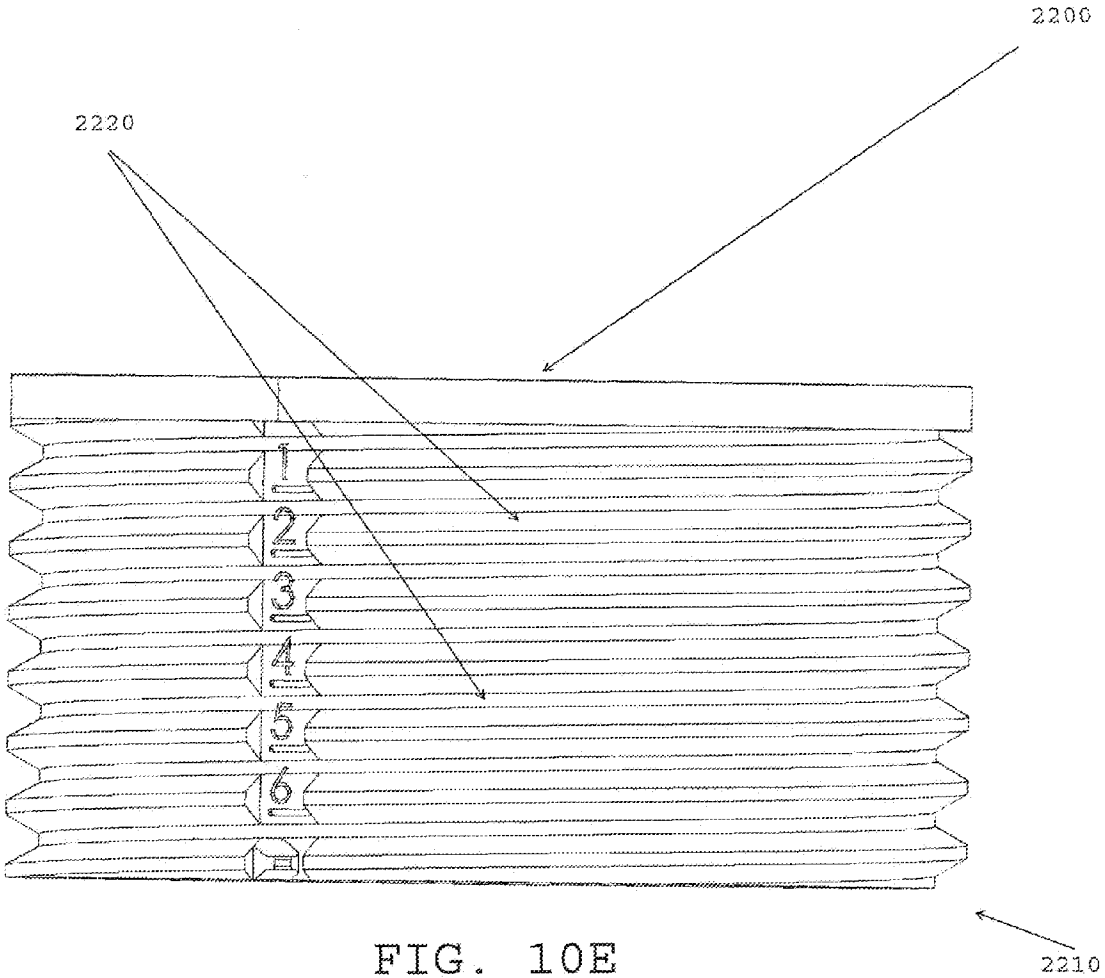
FIG. 10E is a side profile view of the threaded insert 2200.
Figure 11:
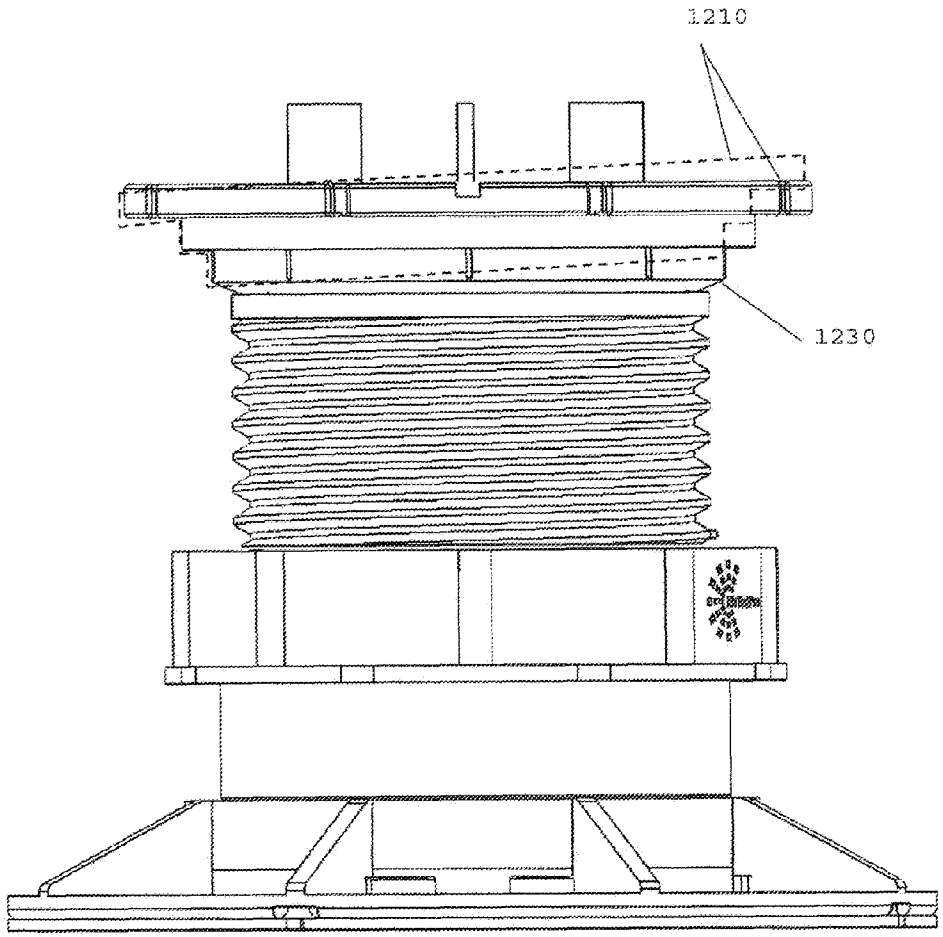
FIG. 11 depicts a side view of the second embodiment of the assembly 2000 and illustrates one mode establishing such leveled surface.

As alluded to above, the disclosed assembly may used for establishing a level paver surface over a sloped subsurface. FIG. 11 depicts a side view of the second embodiment of the assembly 2000 and illustrates one mode establishing such leveled surface. Referring first to FIGS. 10A and 3E, the threaded insert 2200 suitably features a concave surface 2240 and the cap 1200 suitably features a convex surface 1230 whereby the slope of the paver support surface 1230 may be skewed in any direction relative to the plane of the foot 1110 of the base 1100 via sliding the convex surface 1230 of the cap 1200 along the concave surface 2240 of the insert 2200. In one embodiment, the paver support surfaces 1210 of four assemblies 2000 positioned at the four corners of a square paver will self level with respect to one another under the weight of the pavers installed thereon the assemblies 2000.

In some instances, the caps 1200 of a four assembly system cannot, without more than sliding the convex surface 1230 of the cap 1200 along the concave surface 2240 of the insert 2200, be skewed enough in the applicable direction to accomplish a level surface of a square paver because the slope of the under surface may be too drastic. In such instances, a level paver surface may be accomplished via raising or lowering one or more of the paver support surface 1230 of the assemblies 2000 relative to one or more of the paver support surface 1230.*of* the other assemblies 2000. In one embodiment, such raising or lowering of the paver support surface 2210 of an assembly 2000 may be accomplished via: (1) removing the paver spacer 1400 from the assembly cap 1200 of the assembly 2000; (2) inserting an wrench into the wrench receptacle 1321 of the key 1300; (3) griping the flange grip 2110 of the collar 2100; and (3) torqueing the wrench so that the key 1300 turns the insert 2200 whereby the threads of the insert 2200 and collar 2100 interact to drive the insert 2200 further into or out of the tubiform of the collar 2100.

Figure 12A:
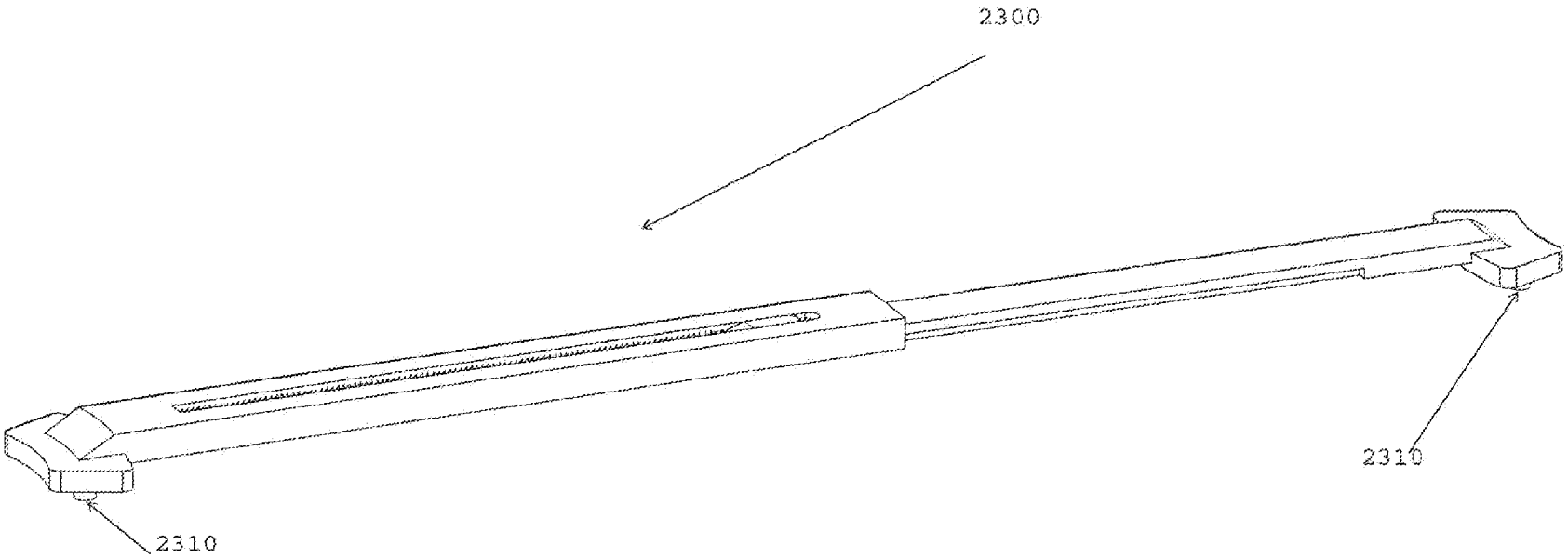
FIG. 12A is a top perspective view of an arm 2300.
Figure 12B:
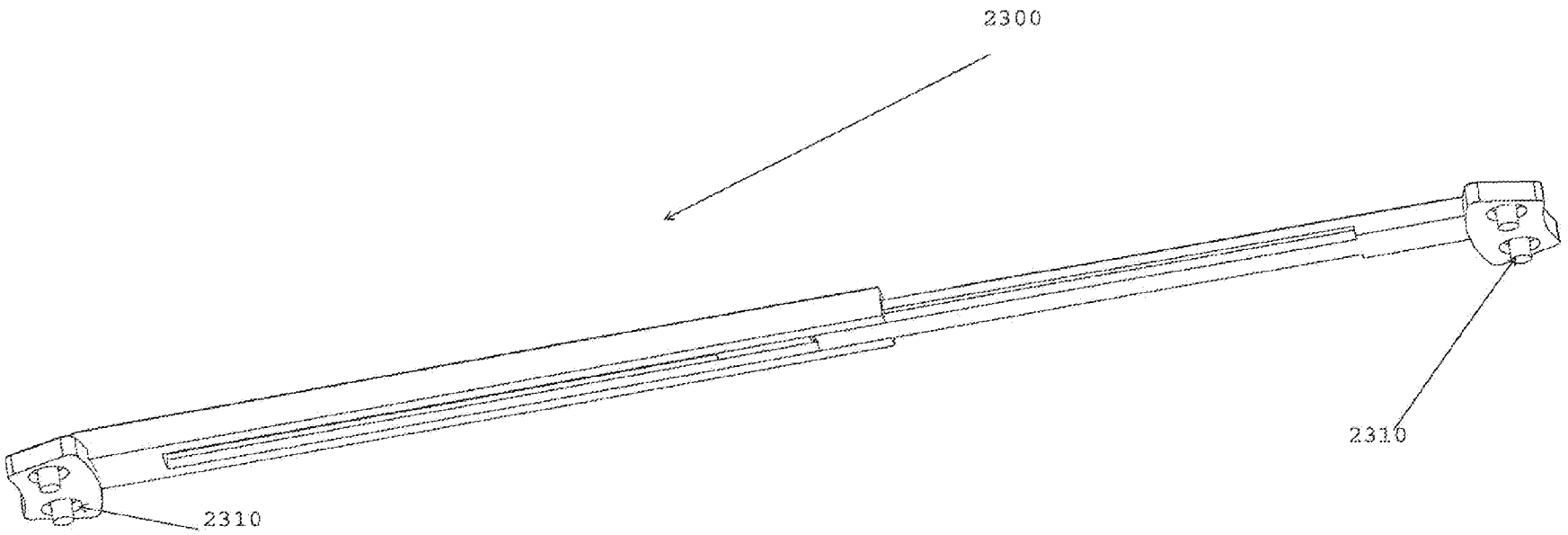
FIG. 12B is a bottom perspective view of the arm 2300.
Figure 12C:
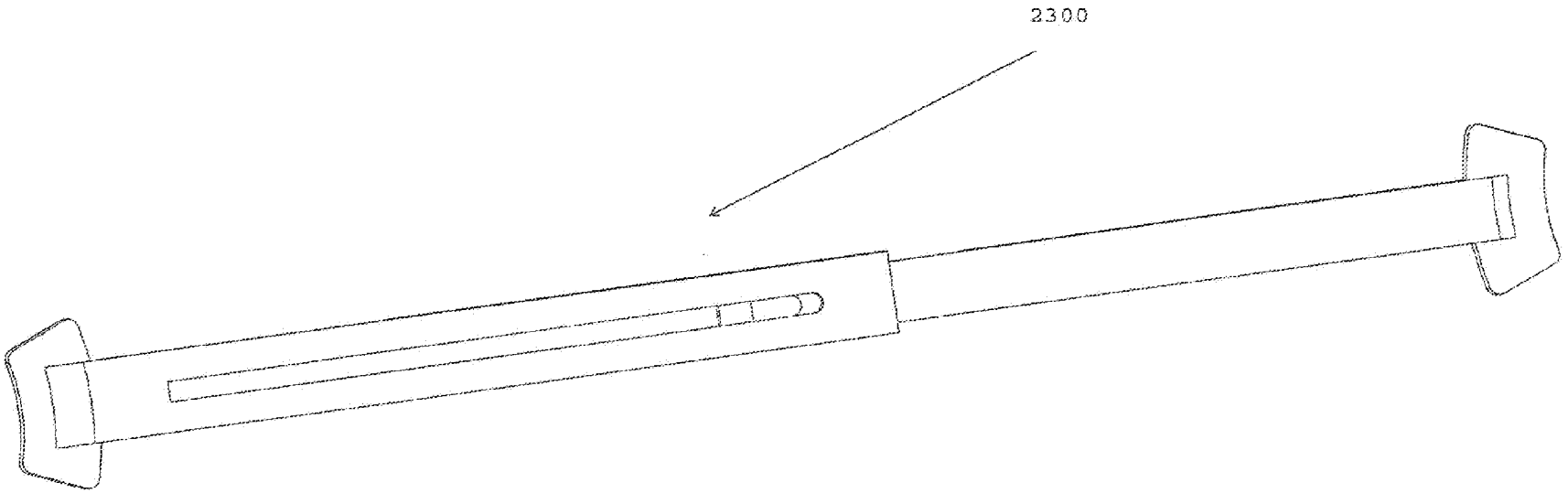
FIG. 12C is a top plan view of the arm 2300.
Figure 12D:
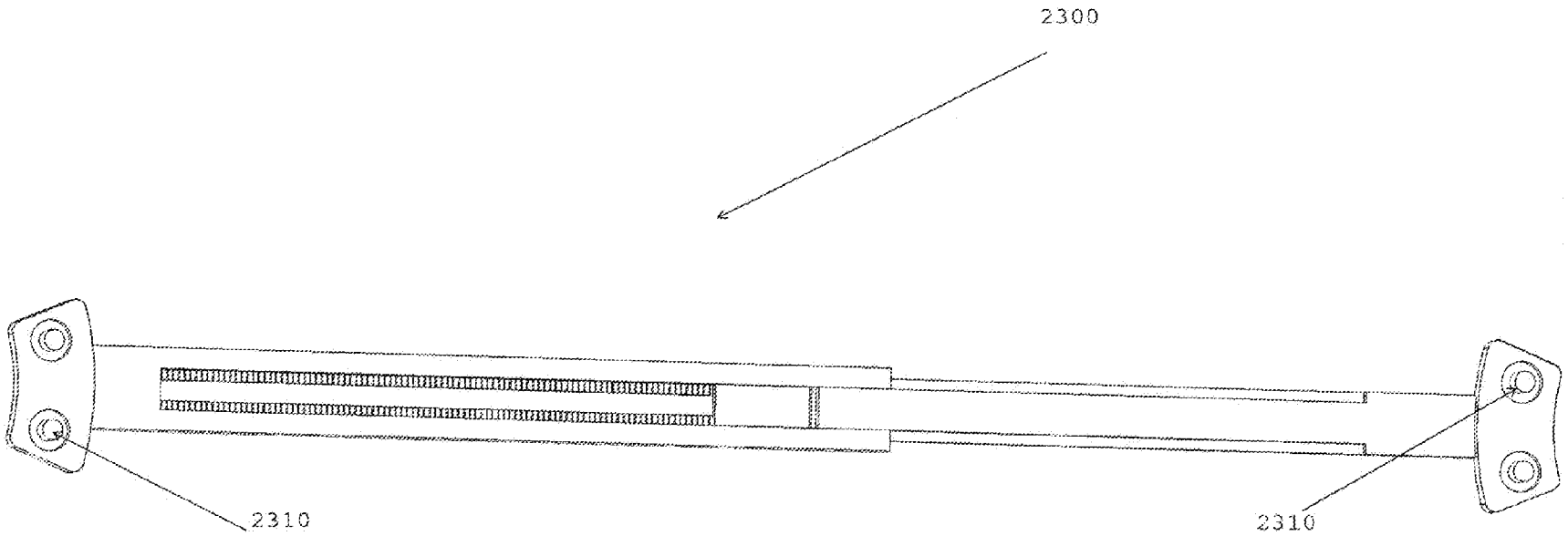
FIG. 12D is a bottom plan view of the arm 2300.
Figure 12E:
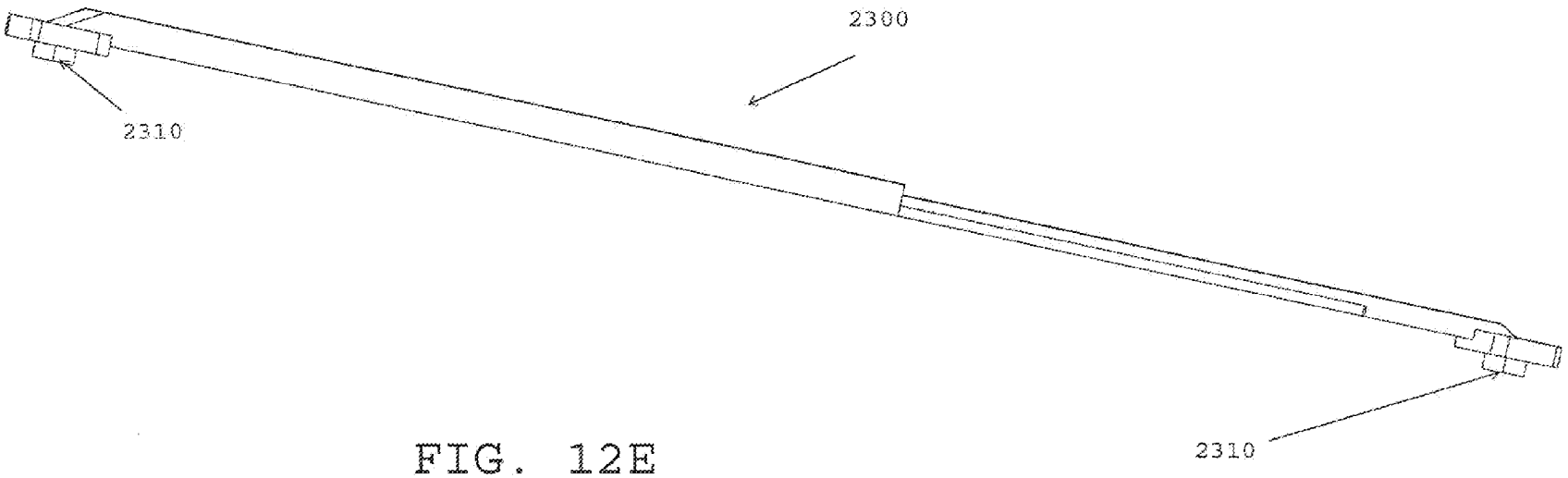
FIG. 12E is a side profile view of the arm 2300.
Figure 13:
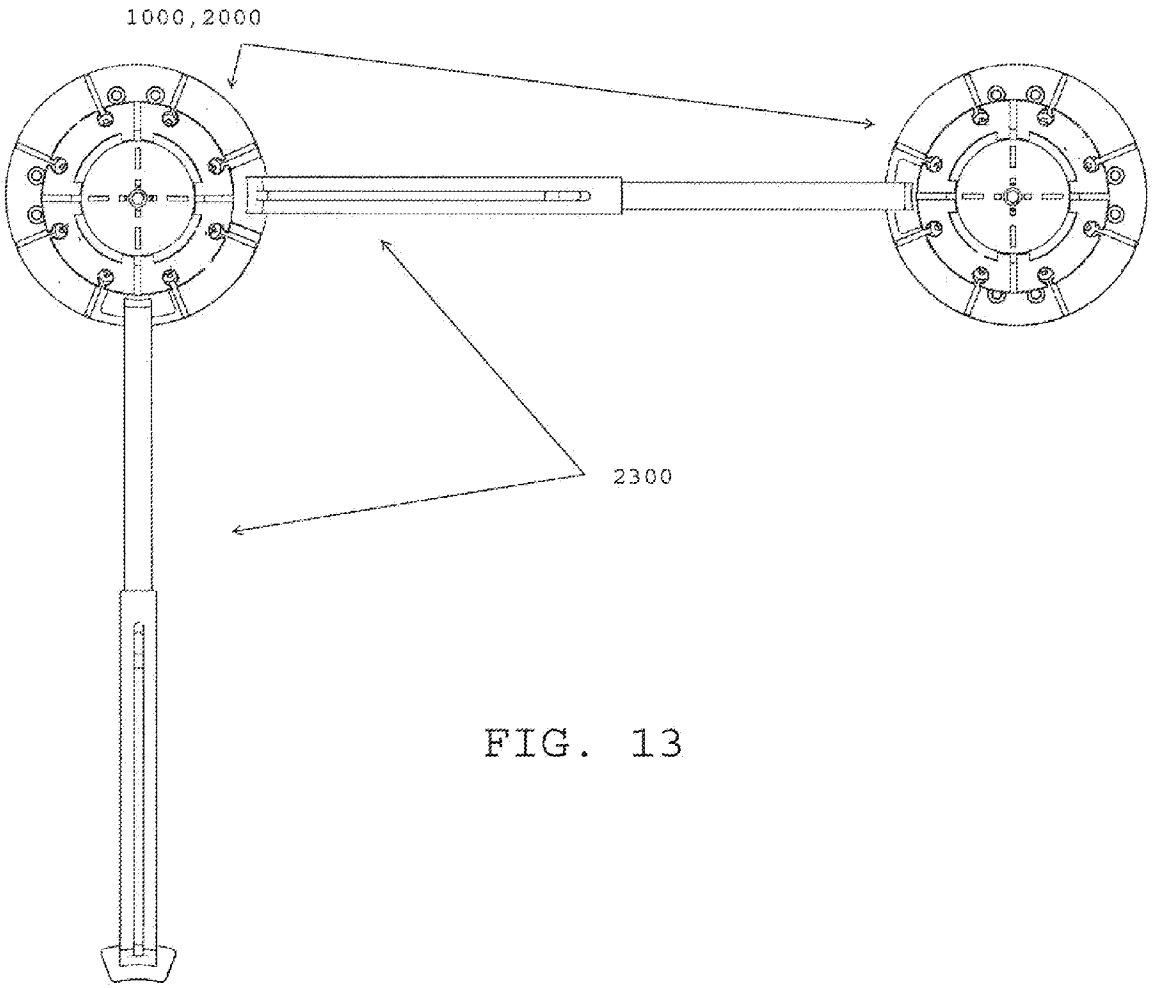
FIG. 13 is an environmental view of the arm 2300 used for fixing the space between two assemblies 1000, 2000.

In one embodiment, a plurality of assemblies 1000, 2000 may be used to support a paver surface. Frequently, the plurality of assemblies 1000, 2000 must be fixedly positioned at specific locations relative to one another for supporting the paver surface. To facilitate such positioning, an arm may be provided that connects to two pavers whereby their relative positions are so fixed. Such an arm 2300 is depicted in FIGS. 12A through 3. Specifically, FIGS. 12A through 12E respectively depict a top perspective, bottom perspective, top plan, bottom plan, and side profile view of the arm 2300. Generally referring to the figures, the arm 2300 is comprised of retractable extensions with mortise 2310 on either side. FIG. 13 is an environmental view of the arm 2300 used for fixing the space between two assemblies 1000, 2000. As shown in the figure, the mortise 2310 of the arm 2300 may receive tenons 2112 on the upperside of the foot 2110 of the bases 2100 of two adjacent assemblies 1000, 2000.

The components of the assemblies 1000, 2000, being or composing a paver load bearing apparatus, should preferably be fashioned out of materials that are capable of supporting the weight of a paver. As the weight of a paver may vary from extraordinarily heavy to very light, the materials which may be acceptable for fabricating the components will typically vary according to the applicable paver to be supported thereon the assemblies 1000, 2000. Depending on the circumstance, such materials will be readily known to one of skill in the art, and may include, without being limited to: plastics, polymers, PVC, polypropylene, polyethylene; metals; woods; ceramics; composites and other synthetic or natural materials whether molded, extruded, stamped or otherwise fabricated.

Similarly, the components of the assemblies 1000, 2000 being or composing a paver load bearing apparatus should preferably be dimensioned to a size that renders the assemblies 1000, 2000 capable of retaining a paver. As the size of a paver may vary from big to little, the physical dimensions of the components will typically vary according to the applicable paver to be supported thereon the apparatus. Depending on the circumstance, such dimensions will be readily known to one of skill in the art, and may include, without being limited to a cap having an diameter spanning of 1.36 inches. The dependence of the size and dimensions of the component apply equally well to the other aspects and parts of this disclosure.

Figure 14:
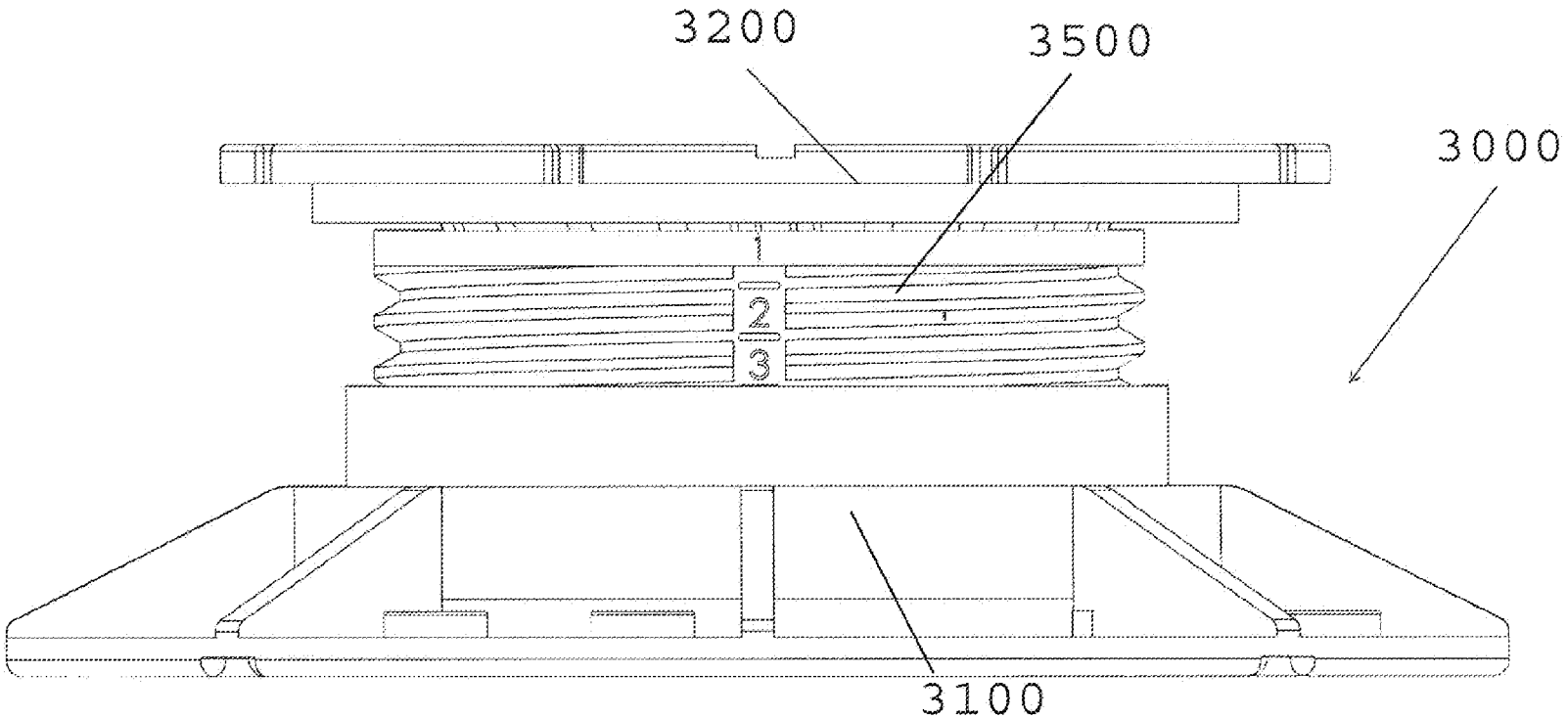
FIG. 14 is a side view of the third embodiment of an assembly 3000.
Figure 15:
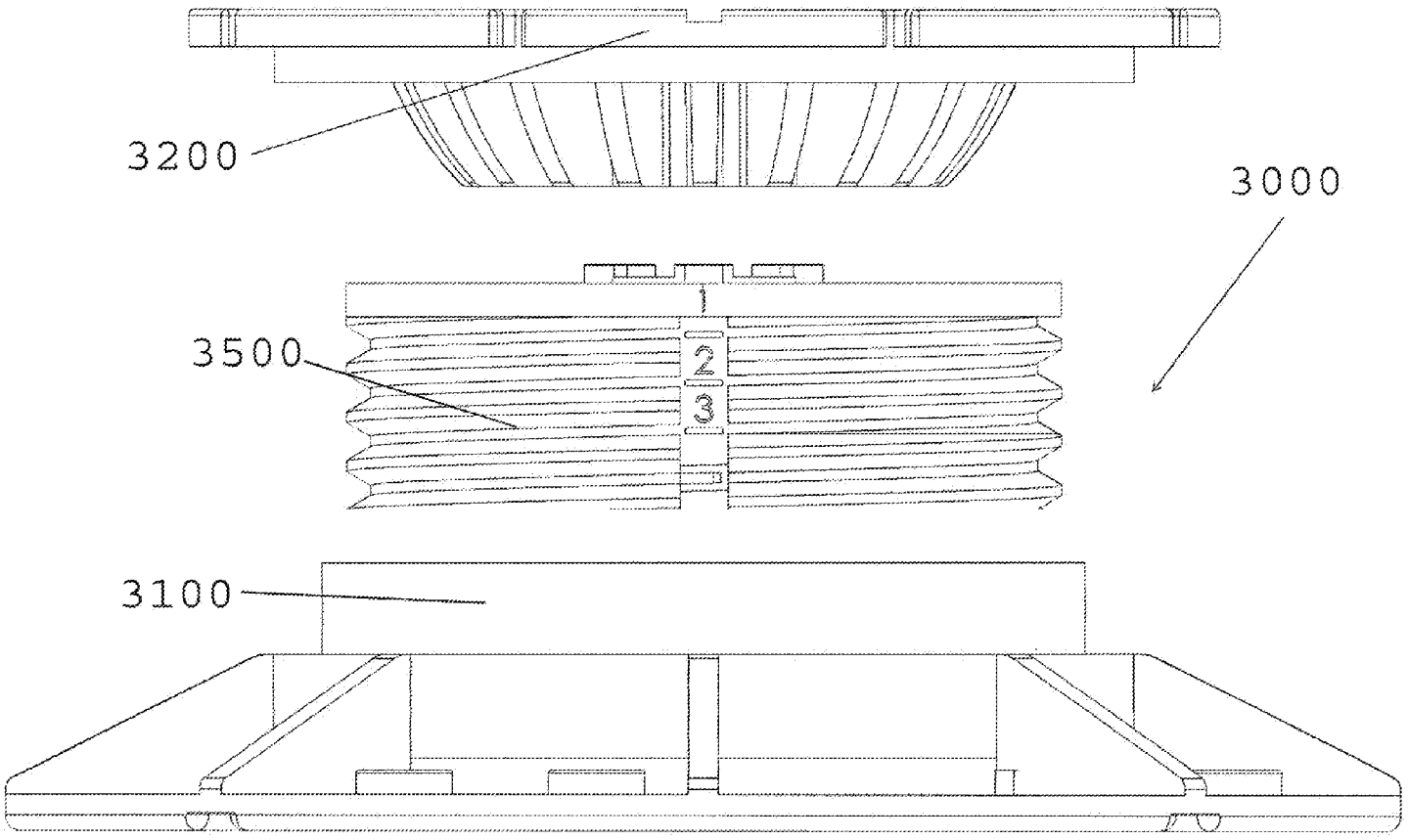
FIG. 15 is an exploded view of the third embodiment of the assembly 3000.
Figure 16A:
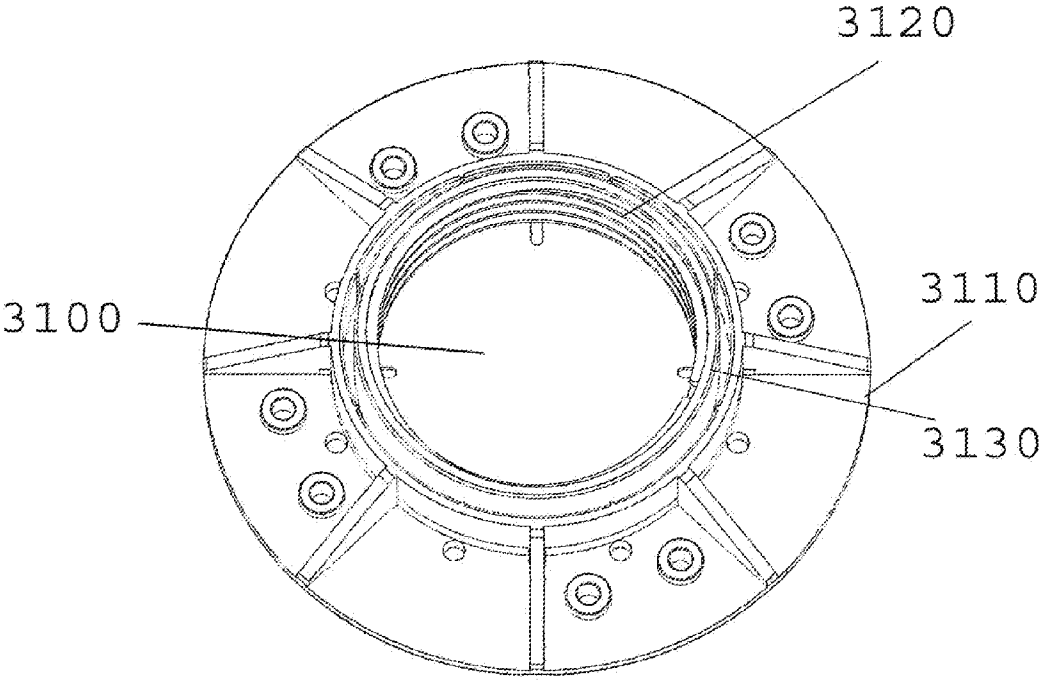
FIG. 16A is a top perspective view of a base 3100.
Figure 16B:
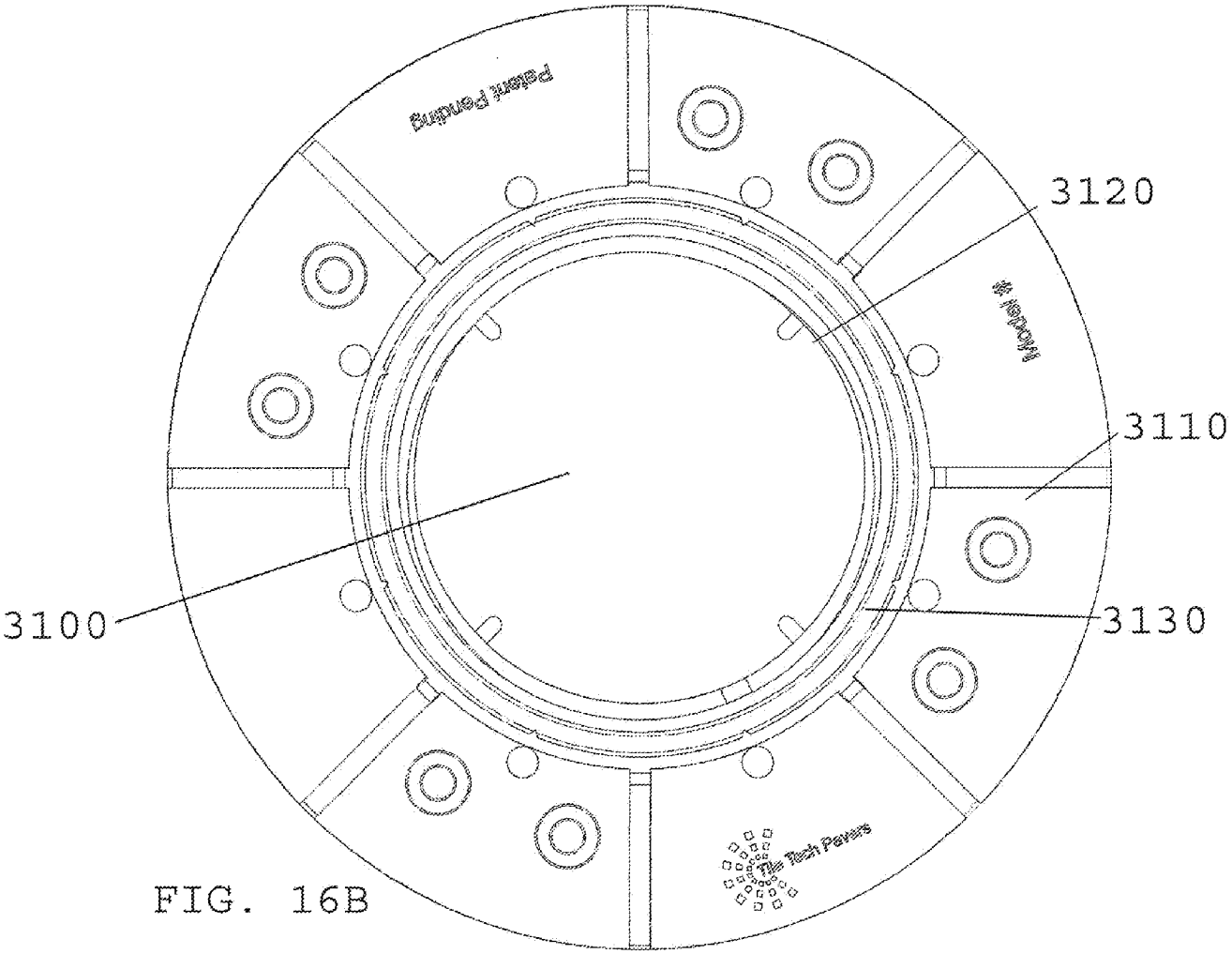
FIG. 16B is a top plan view of the base 3100.
Figure 16C:
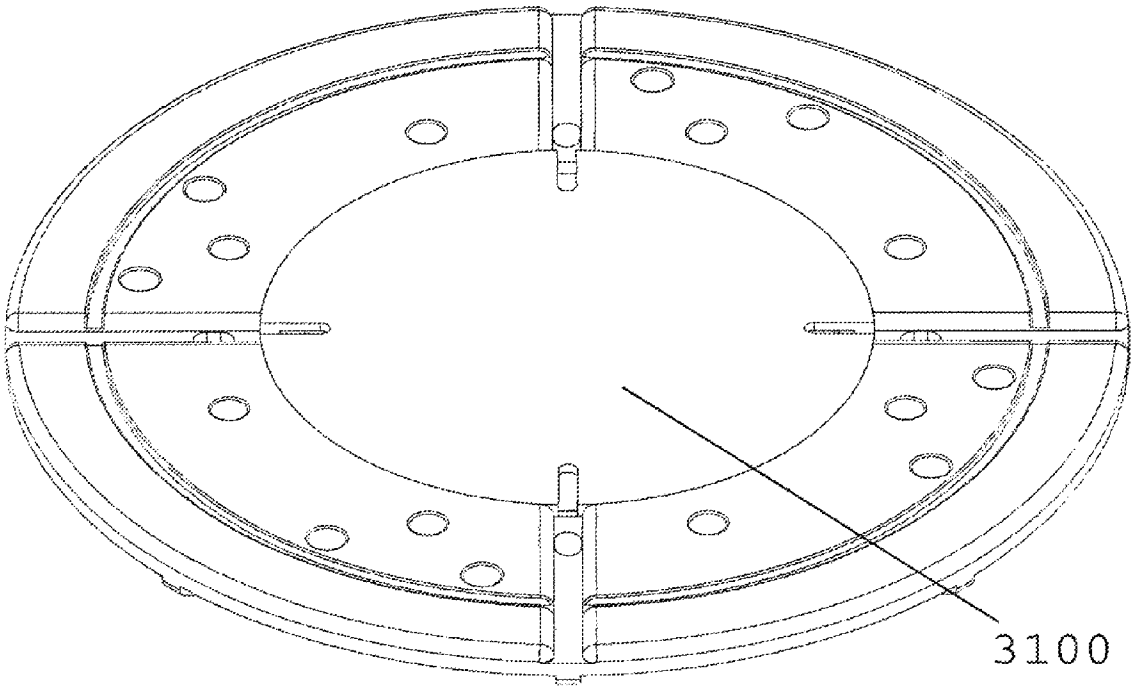
FIG. 16C is a bottom plan view of the base 3100.
Figure 16D:
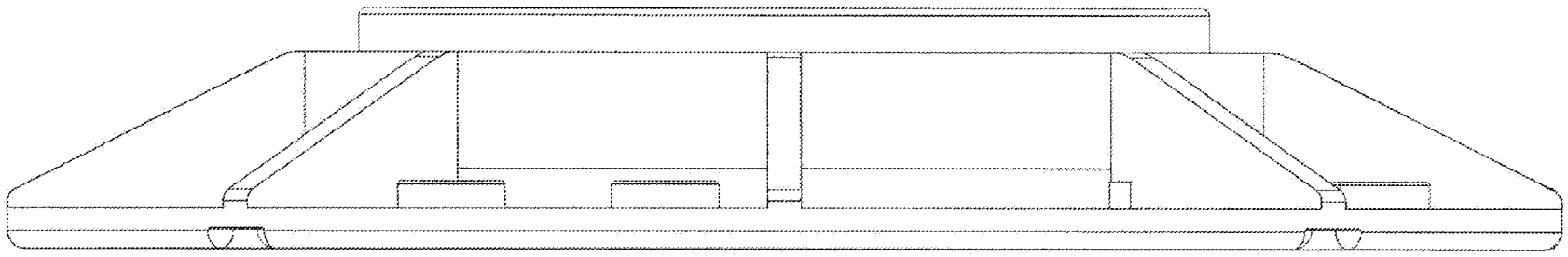
FIG. 16D is a side profile view of the base 3100.
Figure 17A:
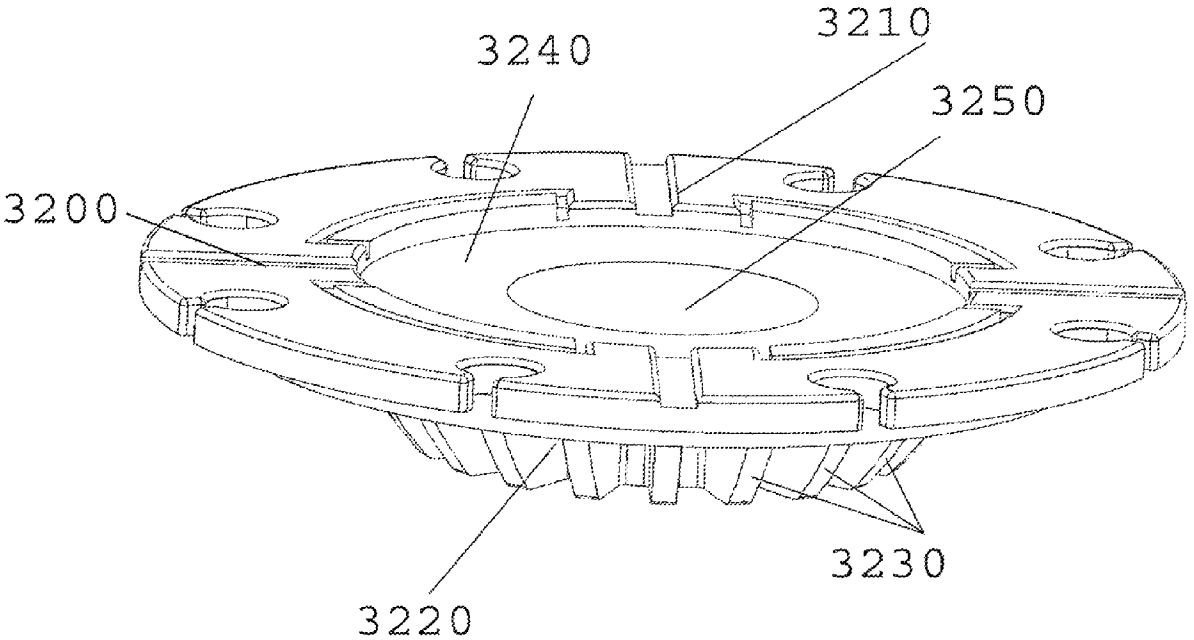
FIG. 17A is a top perspective view of a cap 3200.
Figure 17B:
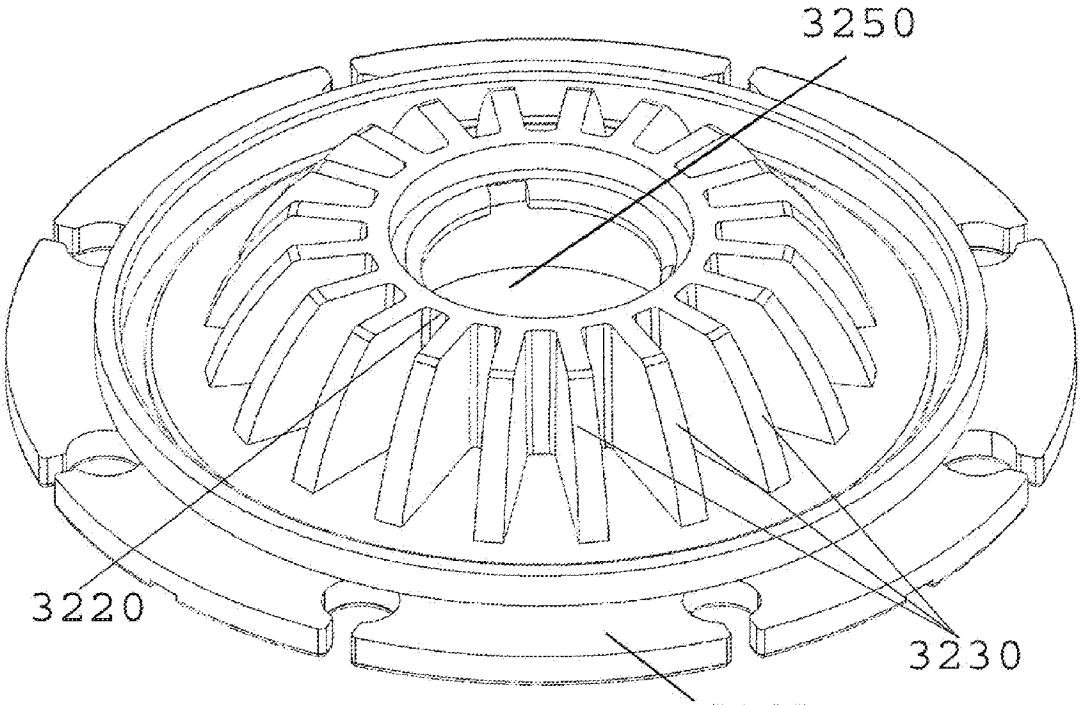
FIG. 17B is a bottom perspective view of the cap 3200.
Figure 17C:
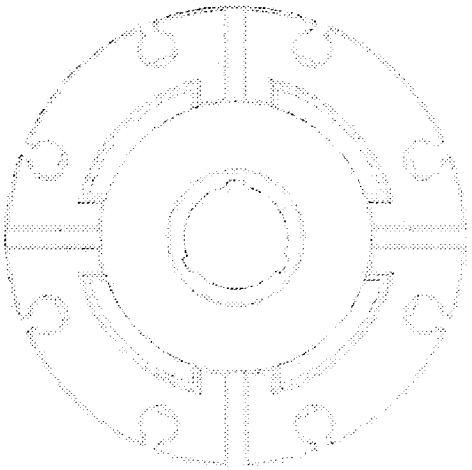
FIG. 17C is a top plan view of the cap 3200.
Figure 17D:
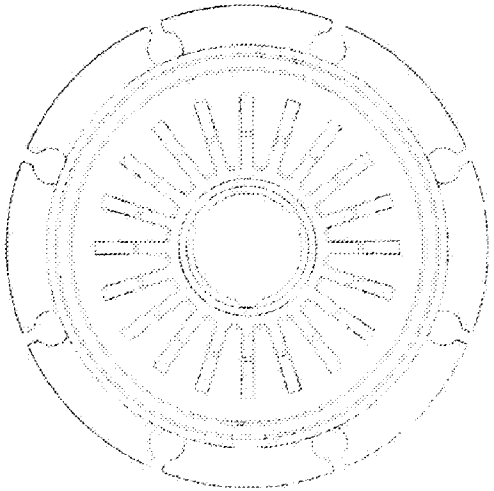
FIG. 17D is a bottom plan view of the cap 3200.
Figure 17E:
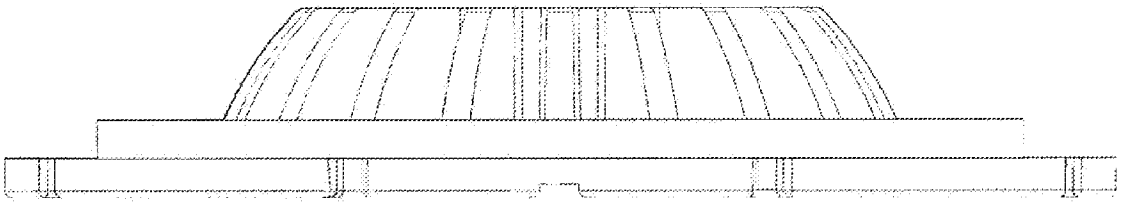
FIG. 17E is a side profile view of the cap 3200.

FIGS. 14 and 15 depict a third embodiment of an assembly 3000 for facilitating the elevated and leveled placement of a paver array onto a substrate. FIG. 14 is a side view of the assembly 3000 and FIG. 15 is an exploded view of the same. As seen in the figures the assembly 3000 comprises: a base 3100; a threaded insert 3500, and a cap 3200.

FIGS. 16A through 16D depict different views of a preferable embodiment of the base 3100 component of the assembly 3000 depicted in FIGS. 14 and 15. Specifically, FIGS. 16A through 16D respectively depict a top perspective, top plan, bottom plan, and side profile view of the base 3100. As can be seen in the referenced drawings, the base is generally a truncated cylinder and may comprise: a foot 3110; a femininely threaded support cylinder 3120; and, a riser socket 3130 around the cylinder 3120.

FIGS. 17A through 17E depict different views of a preferable embodiment of the cap 3200 component of the assembly 3000 depicted in FIGS. 14 and 15. Specifically, FIGS. 17A through 17E respectively depict a top perspective, bottom perspective, top plan, bottom plan, and side profile view of the cap 3200. As can be seen in the referenced drawings, the cap

3200 is generally a disc with a convex surface on its bottom side. Still referring to FIGS. 17A through 17E, the cap 3200 may comprise: a paver support surface 3210; a cylinder 3220 extending from the bottom of the paver support surface 3210; a convex surface 3230 defining the bottom of the cylinder 3220; a tile spacer receptacle 3240 that is coaxial to the tile support surface 3210; and, a key socket access hole 3250 through the convex surface 3140 along the axis of the cylinder 3220.

Figure 18:
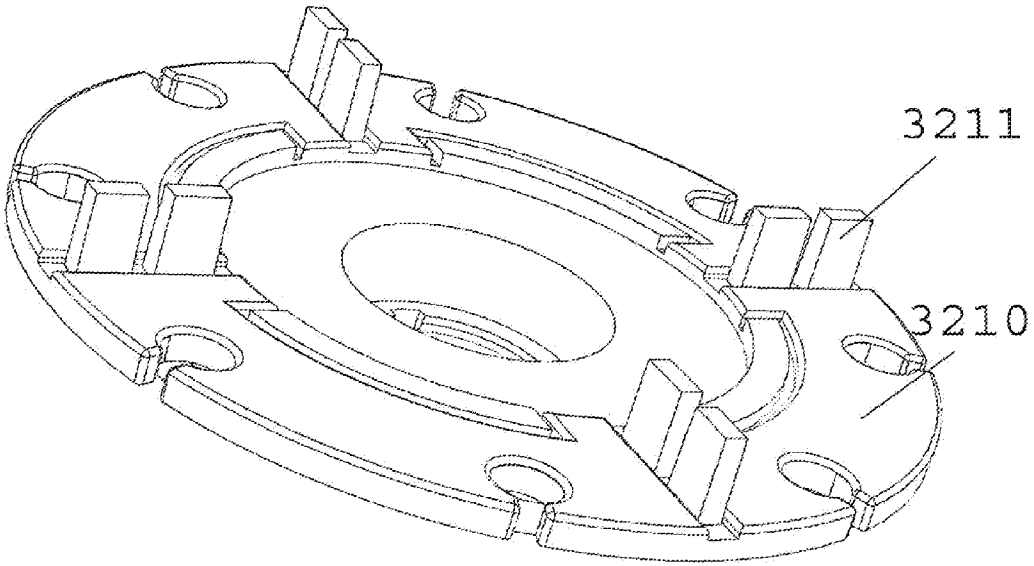
FIG. 18 is a top perspective view of an alternate embodiment of a cap 3400.

FIG. 18 depicts the tile support surface 3210 of the cap 3200 with tile spacers 3211 provided thereto.

FIGS. 19A through 19C depict different views of a preferable embodiment of the threaded insert 3500 component of the assembly 3000 depicted in FIGS. 14 through 15. Actually, FIGS. 19A through 19C respectively depict a top perspective, top plan, and side profile views of the threaded insert 3500. As can be seen in the referenced drawings, the threaded insert is generally a truncated cylinder and may comprise: a foot 3510; a male threads 3520 on the outside surface of its cylinder shape; a concave surface 3540 defining the top of the cylinder 3500; and a key 3550 extending coaxially from the concave surface 3540 along the axis of the cylinder 3500.

FIGS. 14 through 19C show a preferable method for assembling the assembly 3000. First, the base 3100 may be positioned so that the bottom side of the foot 3110 interfaces with a subsurface and wherein the cylinder 3120 extends outwardly and transversely relative to a plane of the subsurface. Second, the foot 3510 of the threaded insert 3500 may be provided to the top of the base 3100 so that the threads 3120 of the base 3100 and the threads 3220 of the insert 3200 cooperate to drive the insert 3200 to within the tubiform of the base 3100. Fourth, the cap 3200 may be positioned on top of the threaded insert 3500 so that the concave surface 3540 of the insert 3200 interfaces with the convex surface 3230 of the cap 1200 and wherein the key 3250 of the insert 3200 is located within the key socket receptacle 3250 of the cap 3200 so that: (1) the key 3250 is retained inside the key socket 3250; and (2) the cap 3200 is movably (e.g., slidably and/or rotatably) retained between the flange of the key 3550 and the concave surface 3540 of the threaded insert 3500.

Referring to FIGS. 14 through 19C, a paver may be supported above a subsurface via: positioning an assembly 3000, foot 3110 down, on the subsurface; and providing a corner of the paver to the paver support surface 3230 whereby the sides of the paver abut. It should be noted that the dimensions of the assembly 3000 will vary with the size of the paver to be retained by the paver support surface 3230. In particular, the height of the projections may vary depending on the thickness of a paver, e.g. in a range of about 0 to 20 inches. It should be also noted that, now, and throughout the application the terms "top" and "bottom" or "lower" and "upper", or any other orientation defining term should in no way be construed as limiting of the possible orientations of the assembly 3000 (i.e., the assembly may be positioned sideways, or in reversed vertical orientations even though the specification refers to a "top" and "bottom" parts).

Figure 20B:
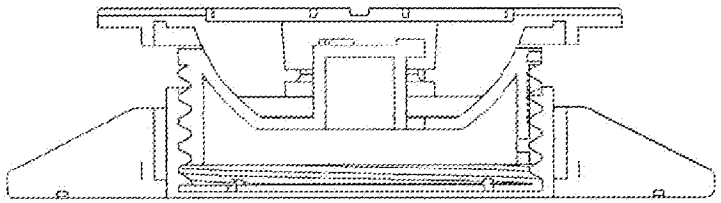
FIGS. 20A and 20B depicts a side cross-section view of the third embodiment of the assembly 3000 and illustrates one mode establishing a leveled surface.
Figure 20A:
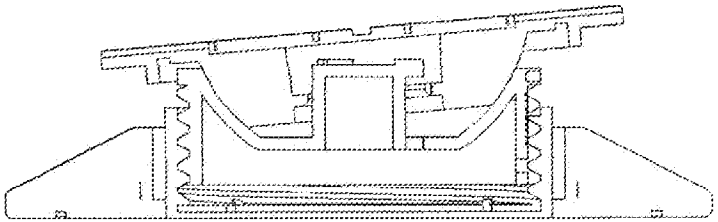

As alluded to above, the disclosed assembly may used for establishing a level paver surface over a sloped subsurface. FIGS. 20A and 20B depict side cross-section views of the assembly 3000 and illustrate one mode establishing such leveled surface. Referring first to FIGS. 20A and 20B, the base 3100 suitably features a concave surface 3140 and the cap 3200 suitably features a convex surface 3230 whereby the slope of the paver support surface 3230 may be skewed in any direction relative to the plane of the foot 3110 of the base 3100 via sliding the convex surface 3230 of the cap 3200 along the concave surface 3140 of the base 3100. In one embodiment, the paver support surfaces 3230 of four assemblies 3000 positioned at the four corners of a square paver will self level with respect to one another under the weight of the pavers installed thereon the assemblies.

Figure 21A:
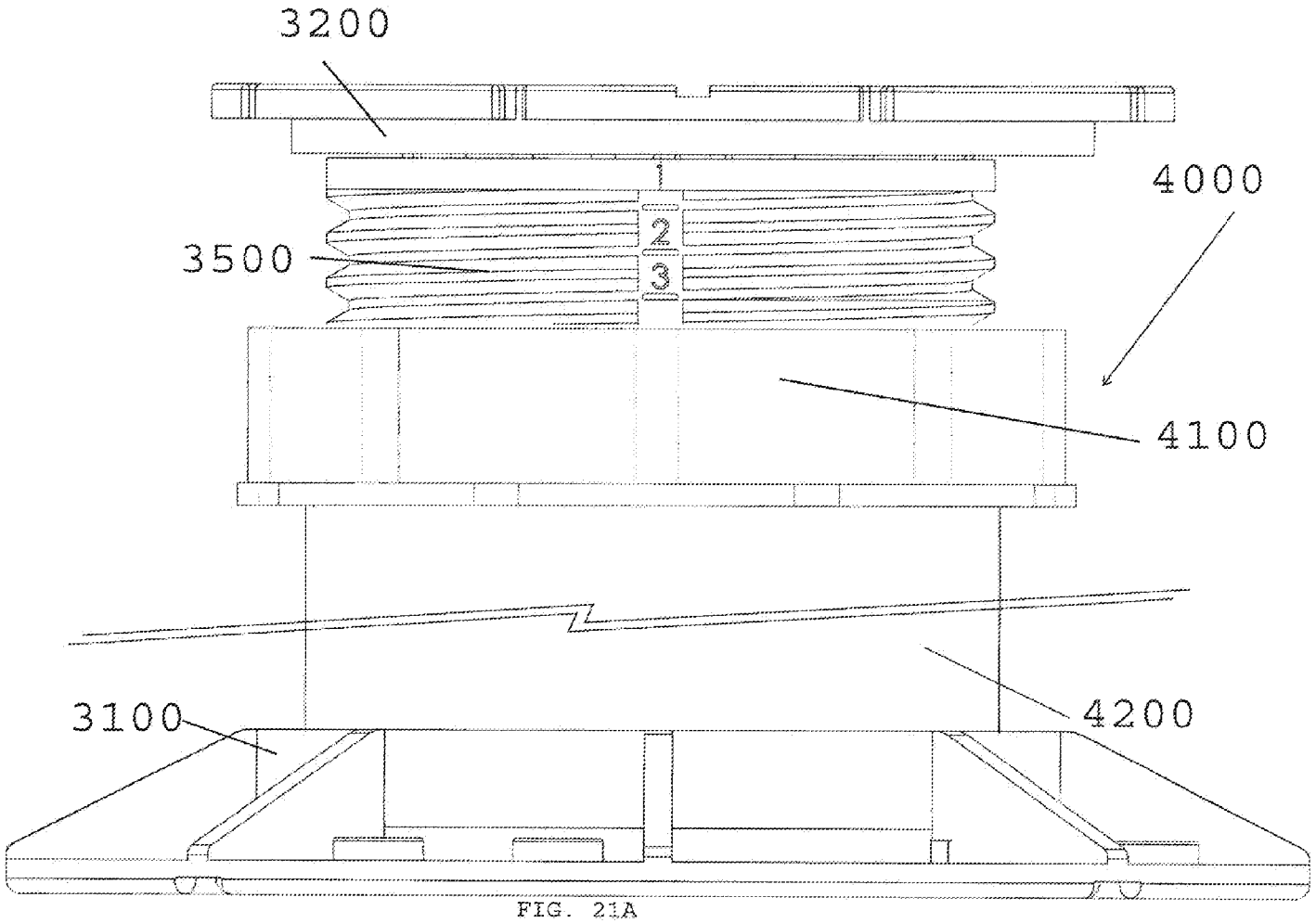
FIG. 21A is a side view of an assembly 4000.
Figure 21B:
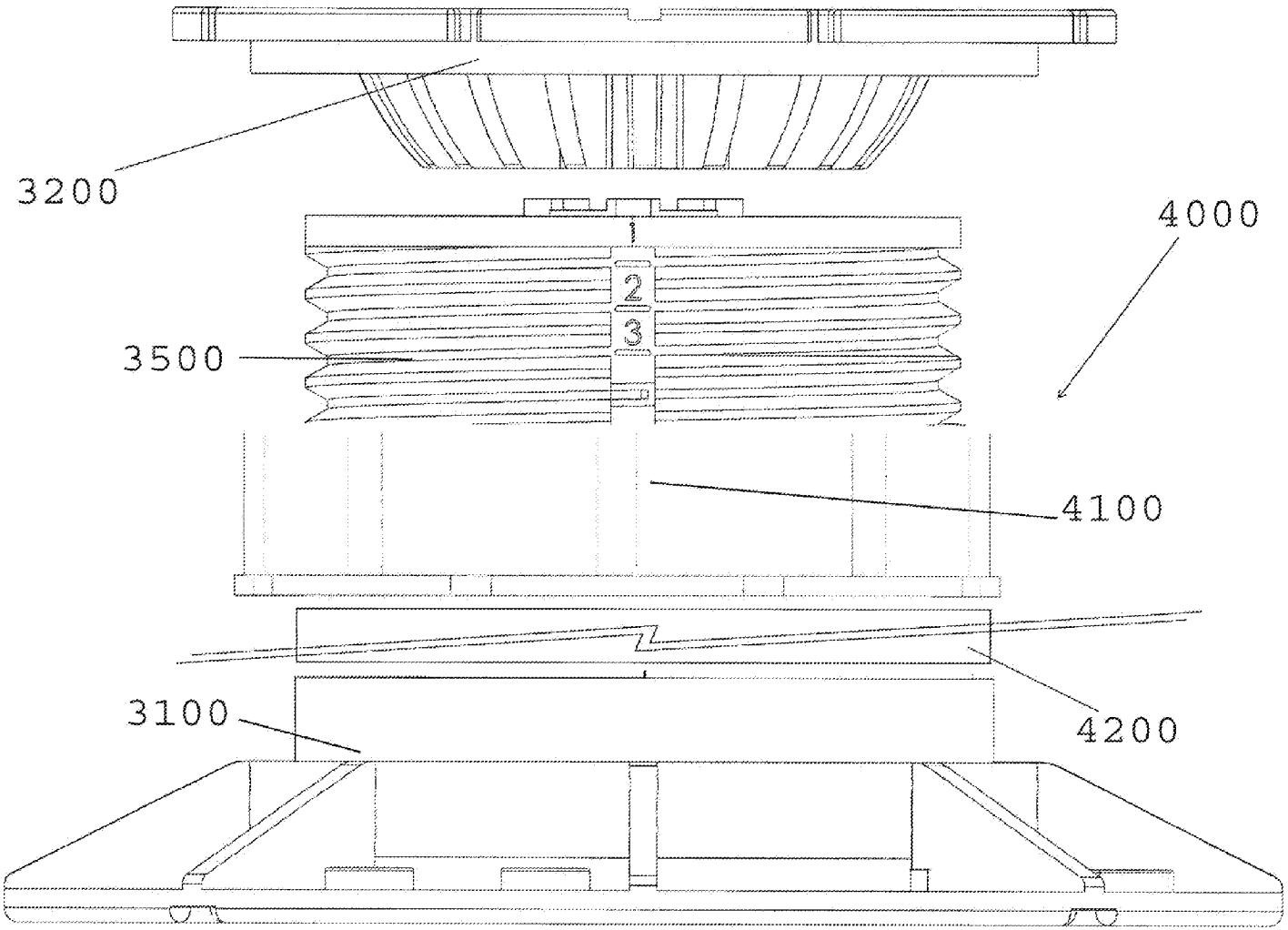
FIG. 21B is an exploded view of the assembly 4000.

FIGS. 21A through 21B depict a fourth embodiment of an assembly 4000 for facilitating the elevated and leveled placement of a paver array onto a subsurface. FIG. 21A is a side view of the assembly 4000; FIG. 21B is an exploded side view of the assembly 4000 of FIG. 21A. As seen in the figures the assembly 2000, like the assembly of FIGS. 14 and 15, comprises: a base 3100; a threaded insert 3500, and a cap 3200. The structure and operability of those components are the same as described above in connection with the third embodiment of an assembly 3000 shown in FIGS. 14 and 15. Unlike the assembly 3000 of FIGS. 14 and 15, the assembly 4000 further comprises a female threaded collar 4100 and a riser 4200.

Figure 22A:
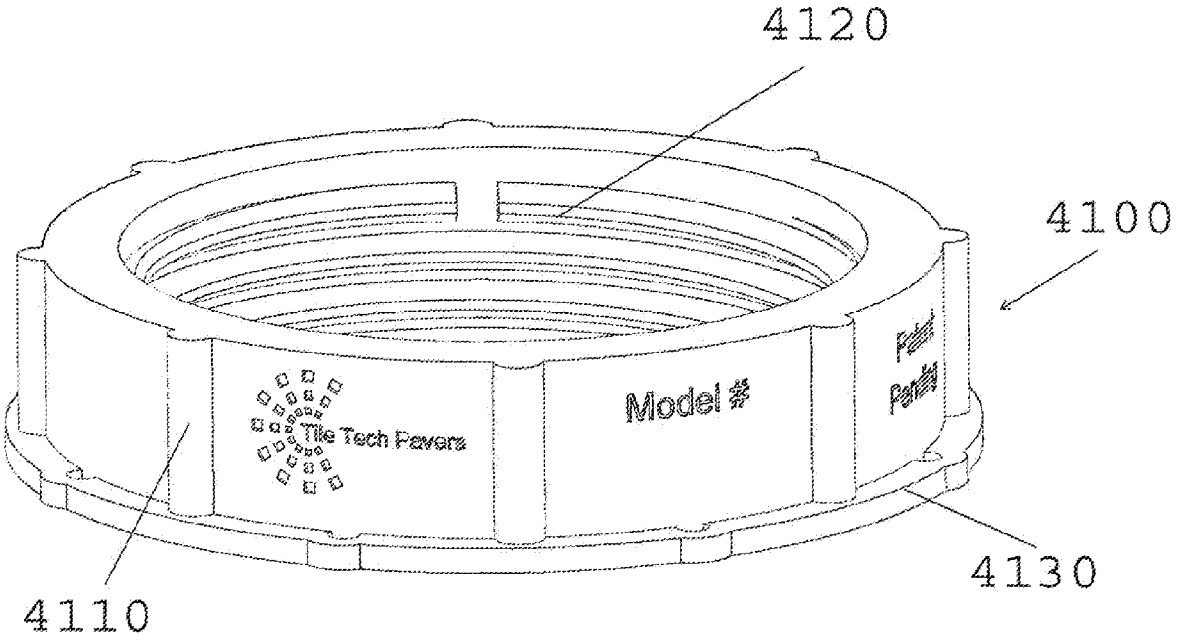
FIG. 22A is a top perspective view of a threaded collar 4100.
Figure 22B:
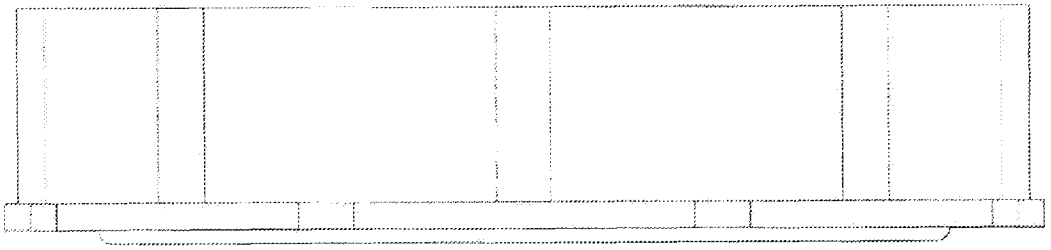
FIG. 22B is a bottom plan view of the threaded collar 4100.
Figure 22C:
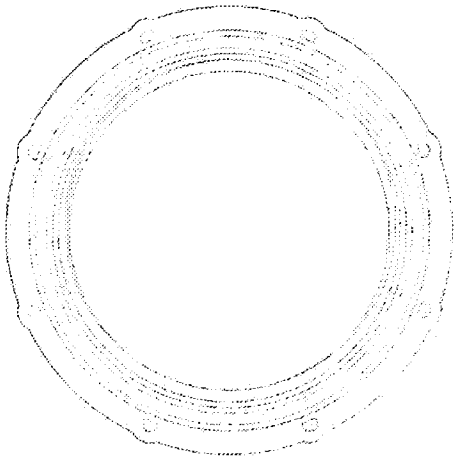
FIG. 22C is a side view of the threaded collar 4100.

FIGS. 22A through 22C depict different views of a preferable embodiment of the threaded collar 4100 component of the assembly 4000 depicted in FIGS. 20A through 20B. Specifically, FIGS. 20A through 20C respectively depict a top perspective, bottom plan, and side profile view of the threaded collar 4100. As can be seen in the referenced drawings, the threaded collar 4100 is generally a truncated tubiform with; a grip flange 4110; female threads 4120 on the inside of its tubiform; and a foot 4130.

FIG. 21A through FIG. 22D show a preferable method for assembling the assembly 4000. First, the base 3100 may be positioned so that the bottom side of the foot 4110 interfaces with a subsurface and wherein the cylinder 3120 extends outwardly and transversely relative to a plane of the subsurface. Second, a riser 4200 (e.g., a pipe section) may be positioned within the riser receptacle 3130 of the base 3100. Third, the foot 4130 of the threaded collar 4100 may be provided to the top of the riser 4200 so that the foot 4130 of the threaded collar 4100 is positioned inside of the riser 4200. Fourth, the foot 3210 of the threaded insert 3500 may be provided to the top of the threaded collar 4100 so that the threads 4120 of the collar 4100 and the threads 3220 of the insert 3200 cooperate to drive the insert 3500 to within the tubiform of the collar 4100. Fifth, the cap 3200 may be positioned on top of the threaded insert 3500 so that the concave surface 3240 of the insert 3500 interfaces with the convex surface 3230 of the cap 3200 and wherein the key 3250 of the insert 3500 is located within the key socket receptacle 3250 of the cap 3200 and wherein the cap 1200 is movably (e.g., slidably and/or rotatably) retained between the flange of the key 3250 and the concave surface 3240 of the threaded insert 3500. Finally, the tile spacer 1400 may be provided to the spacer receptacle 3240 of the cap 3200 whereby the spacer 1400 surface and the support surface 3230 of the cap 3200 generally form a plane.

Referring to FIGS. 21A and 21B, a paver may be supported above a subsurface via: positioning an assembly 4000, foot 3110 down, on the subsurface; rotating the cap 3200 around the key 3250 until the orientation of the projections 1410 of the spacer 1400 align with a planned paver surface; and providing a corner of the paver to the paver support surface 1230 whereby the sides of the paver abut the projections 1410.

As alluded to above, the disclosed assembly may used for establishing a level paver surface over a sloped subsurface. FIG. 21A depicts a side view of the assembly 2000 and illustrates one mode establishing such leveled surface. Referring first to FIGS. 21A and 21B, the threaded insert 3500 suitably features a concave surface 3240 and the cap 3200 suitably features a convex surface 3230 whereby the slope of the paver support surface 3230 may be skewed in any direction relative to the plane of the foot 3110 of the base 3100 via sliding the convex surface 3230 of the cap 3200 along the concave surface 3240 of the insert 3500. In one embodiment, the paver support surfaces 3210 of four assemblies 4000 positioned at the four corners of a square paver will self level with respect to one another under the weight of the pavers installed thereon the assemblies 2000.

In some instances, the caps 3200 of a four assembly 3000, 4000 system cannot, without more than sliding the convex surface 3230 of the cap 1200 along the concave surface 3540 of the insert 3500, be skewed enough in the applicable direction to accomplish a level surface of a square paver because the slope of the under surface may be too drastic. In such instances, a level paver surface may be accomplished via raising or lowering one or more of the paver support surface 3230 of the assemblies 3000, 4000 relative to one or more of the paver support surface 3230 of the other assemblies 3000, 4000. In one embodiment, such raising or lowering of the paver support surface 3210 of an assembly 3000,4000 may be accomplished via: (1) removing the paver spacer from the assembly cap 3200 of the assembly 3000; (2) inserting an wrench into the wrench receptacle 1321 of the key; (3) griping the flange grip 3110 of the collar 3100; and (3) torqueing the wrench so that the key 3300 turns the insert 3500 whereby the threads of the insert 3500 and collar 4100 interact to drive the insert further into or out of the tubiform of the collar 4100.

Figure 23A:
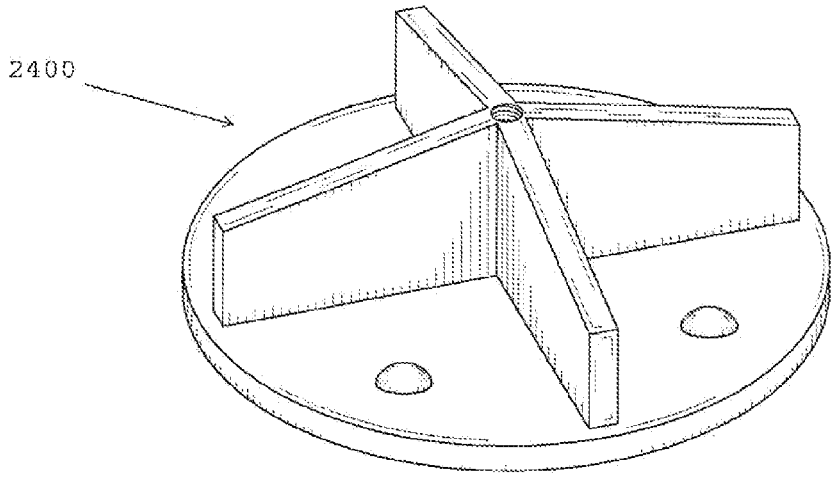
FIG. 23A through 23 C are views of a top surface of a spacer 2400.
Figure 24:
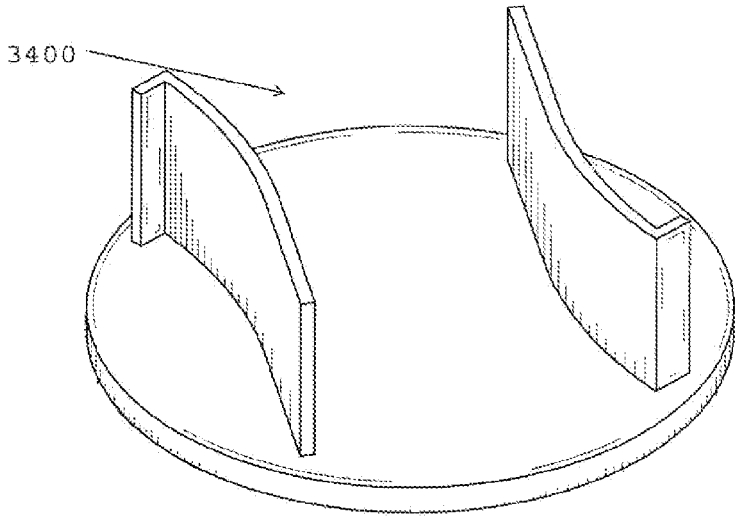
FIG. 24 is a view of a top surface of a spacer 3400.
Figure 23B:
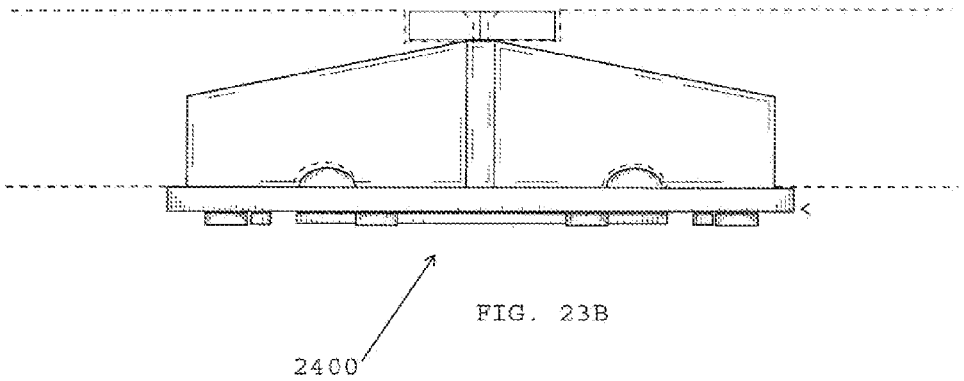
Figure 23C:
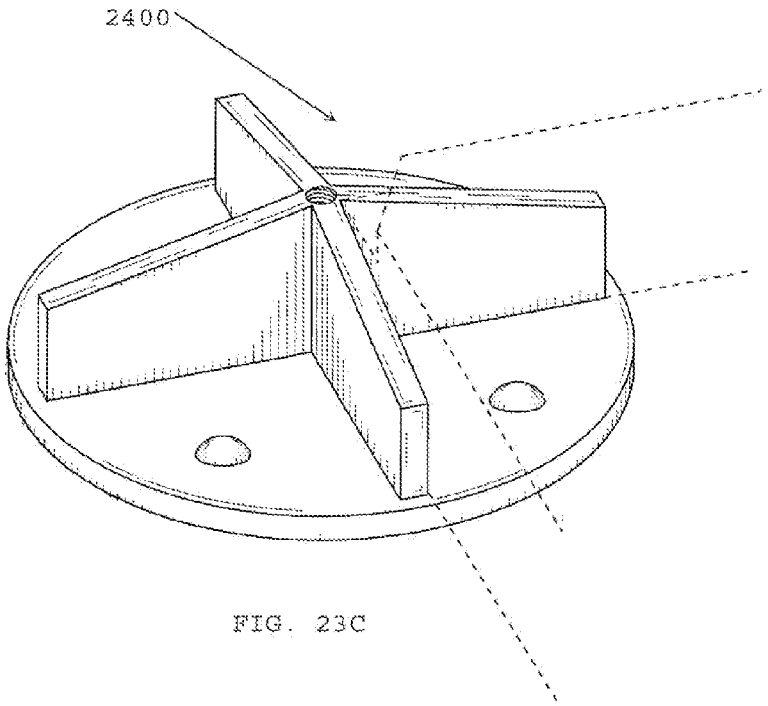
Figure 25A:
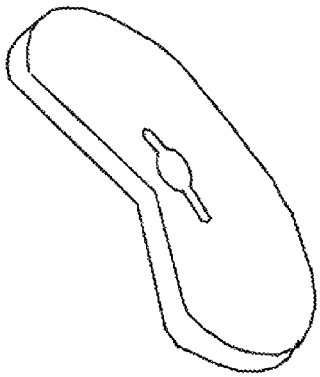
FIGS. 25A and 25B are respectively a view of an anchoring washer for securing wooden tiles and an environmental view of the same.
Figure 25B:
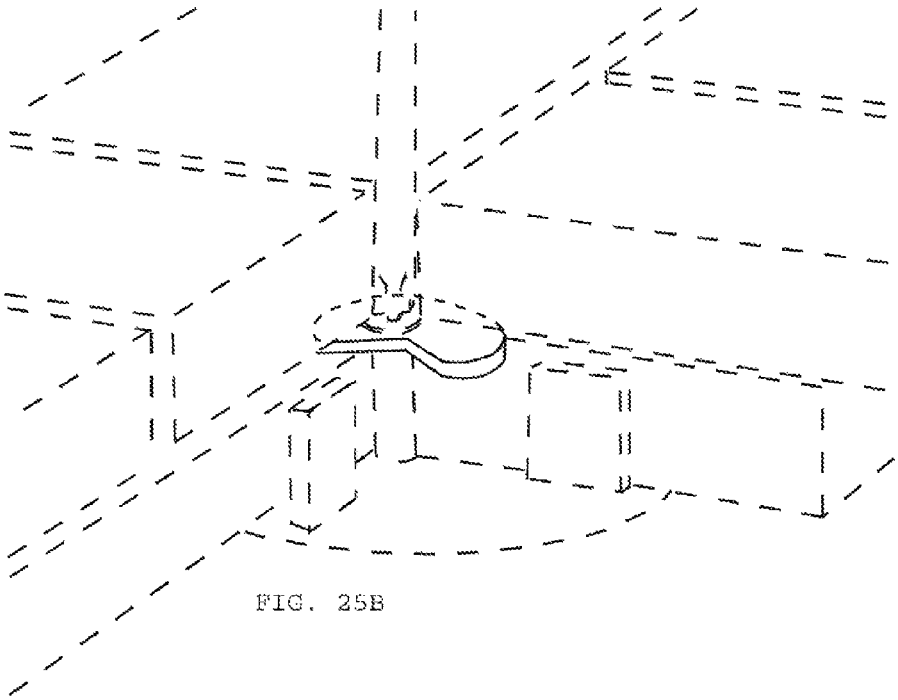
Figure 26A:
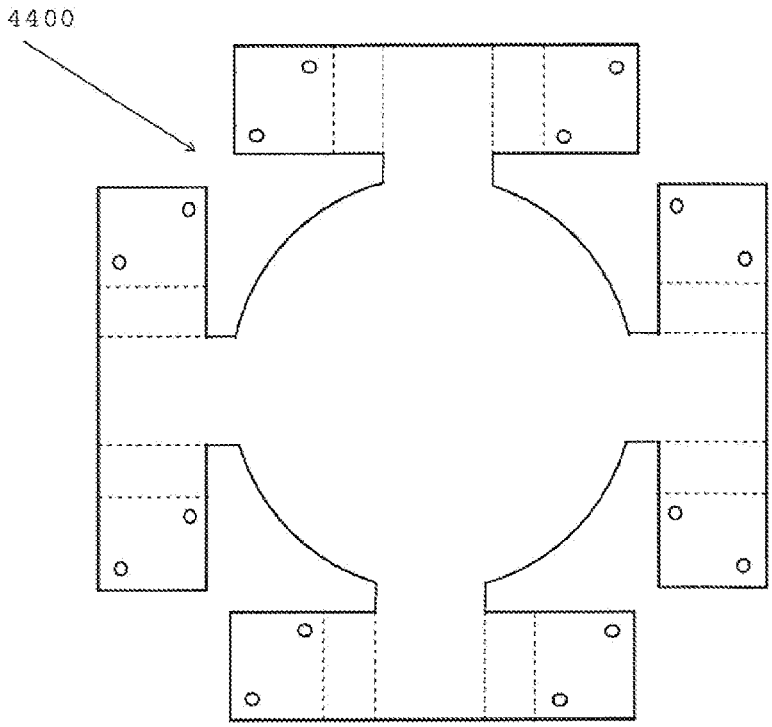
FIGS. 26A and 26B are respectively views of a top surface of a spacer 4400 and environmental views of the same.
Figure 26B:
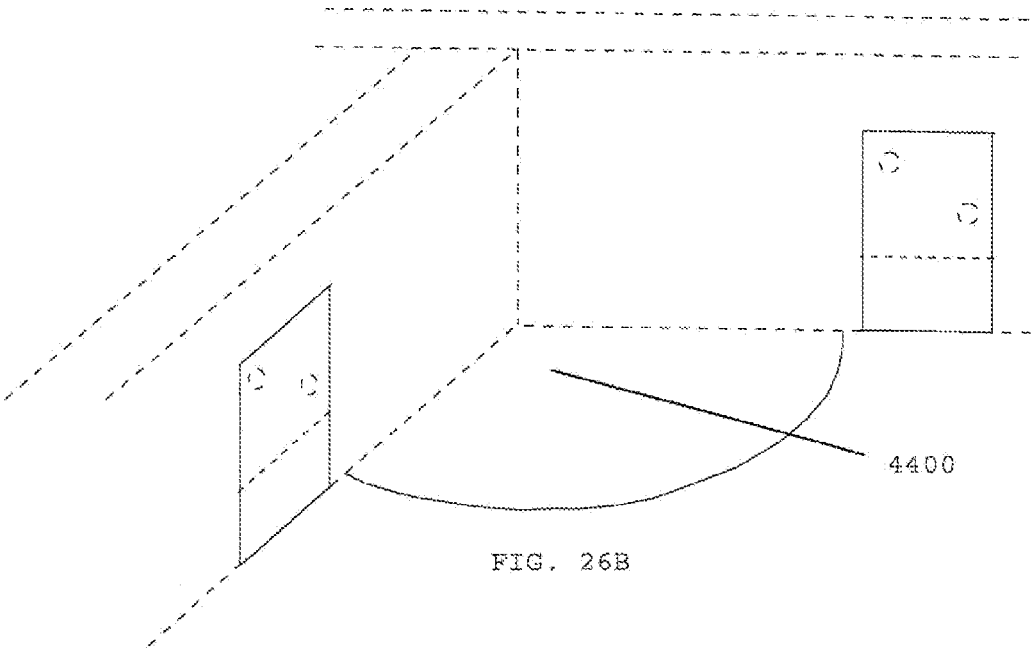
Figure 27A:
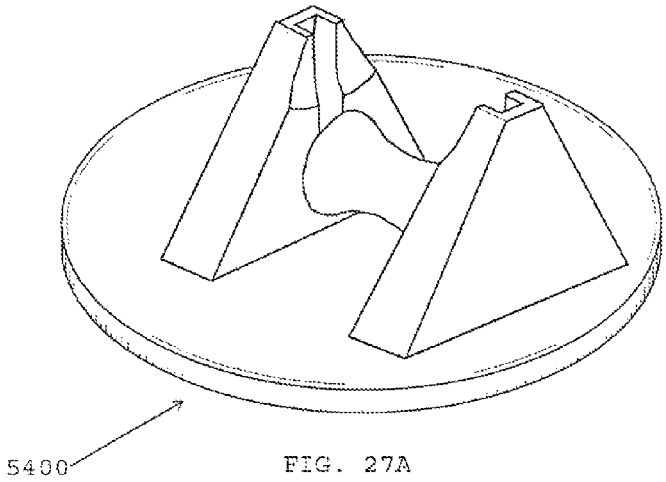
FIGS. 27A and 27B are respectively views of a top surface of a pipe riser spacer 5400.
Figure 27B:
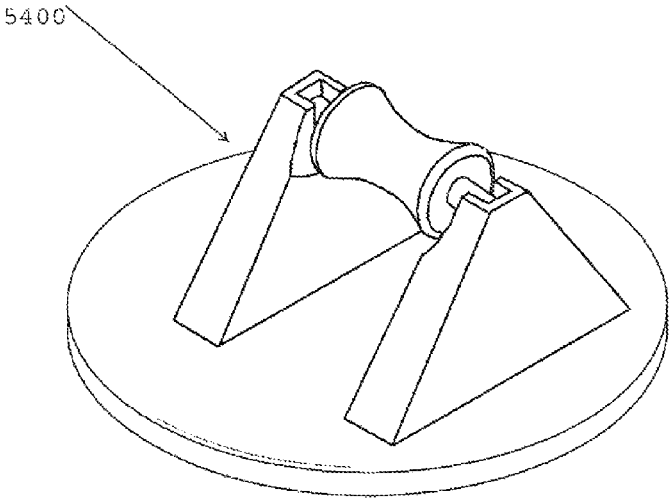
Figure 28:
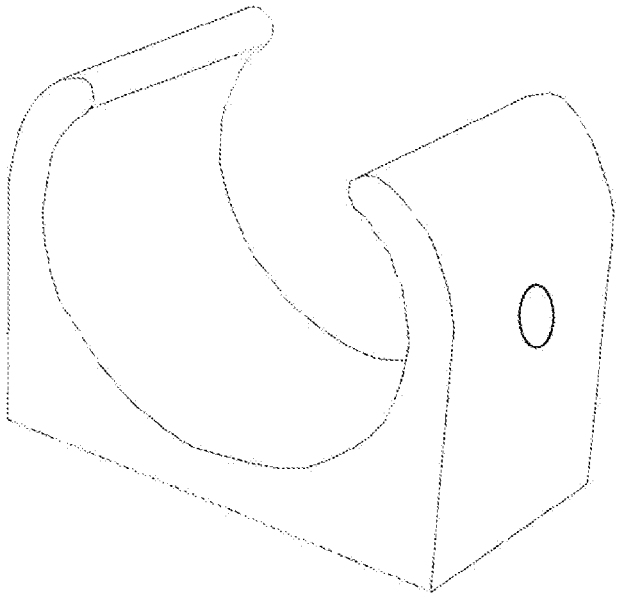
FIG. 28 is a top perspective view of a receptacle for an arm.
Figure 29B:
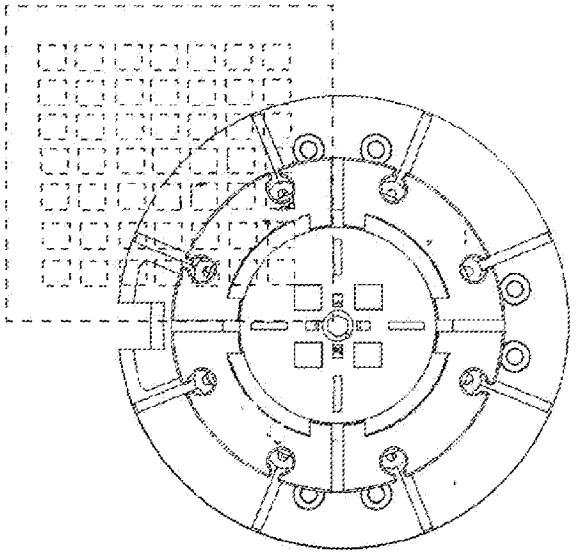
FIGS. 29A, 29B, 29C and 29D are a perspective views and top environmental views of a spacer 6400.
Figure 29A:
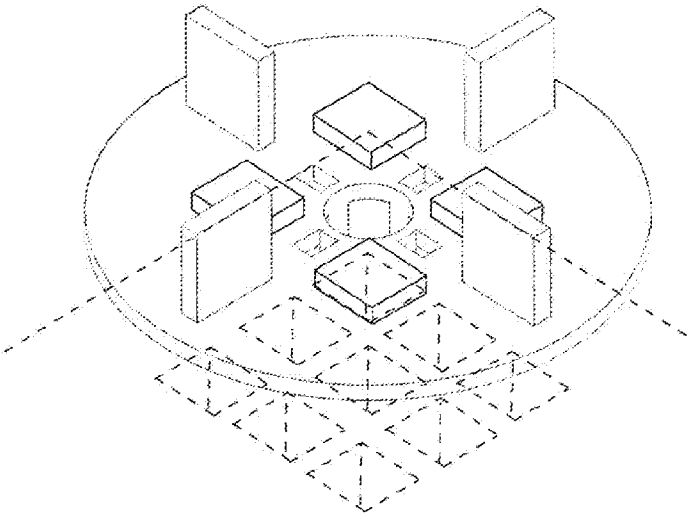
Figure 29D:
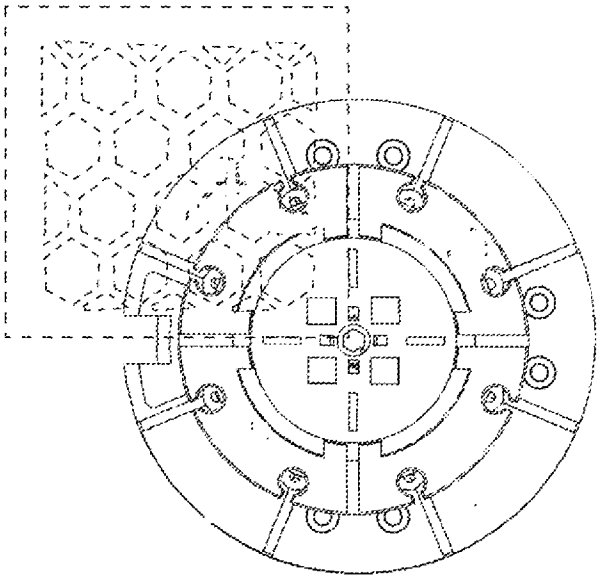
Figure 29C:
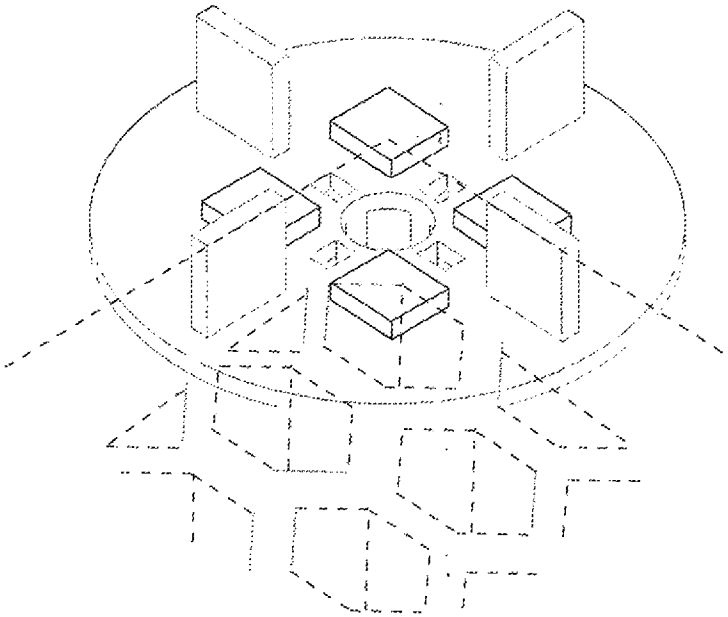

As set forth above, the pavers supported by disclosed assemblies 1000-4000 may suitably support pavers of various sizes and shapes. In order to account for such paver variation, multiple embodiments of the top surface of the attachment 1400 may be provided. FIG. 23A through 23-C are views of a top surface of a spacer 2400, wherein tiles are locked in place via a vise plate. FIG. 24 is a view of a top surface of a spacer 3400, wherein a support beam is disposed between two curved walls. FIGS. 25A and 25B are respectively a view of an anchoring washer for securing wooden tiles and an environmental view of the same. FIGS. 26A and 26B are respectively views of a top surface of a spacer 4400 and environmental views of the same. FIGS. 27A and 27B are respectively views of a top surface of an adjustable pipe riser spacer 5400.

In one embodiment, a plurality of assemblies 3000, 4000 may be used to support a paver surface. Frequently, the plurality of assemblies 3000, 4000 must be fixedly positioned at specific locations relative to one another for supporting the paver surface. To facilitate such positioning, an arm may be provided that connects to two pavers whereby their relative positions are so fixed. Such an arm may be a pipe section provided between two pipe receptacles on the foot of a base 3100 of an assembly. One embodiment, a pipe receptacle 5000 is provided in FIG. 28. Generally referring to the figures, a pipe may be provided between two pipe receptacles to establish an arm. The arm may suitably be fixedly retained within the pipe receptacles via providing a screw through the side of the pipe receptacle and into a retained pipe.

FIGS. 29A through 29D illustrate the system disclosed by U.S. Pat. No. 8,128,312 (generally disclosed at http://silca-system.com/ or http://www.pierdex.com/) might be incorporated into the above described system.

The components of the assemblies 1000-4000, being or composing a paver load bearing apparatus, should preferably be fashioned out of materials that are capable of supporting the weight of a paver. As the weight of a paver may vary from extraordinarily heavy to very light, the materials which may be acceptable for fabricating the components will typically vary according to the applicable paver to be supported thereon the assemblies 1000-4000. Depending on the circumstance, such materials will be readily known to one of skill in the art, and may include, without being limited to: plastics, polymers, PVC, polypropylene, polyethylene; metals; woods; ceramics; composites and other synthetic or natural materials whether molded, extruded, stamped or otherwise fabricated.

Similarly, the components of the assemblies 1000-4000 being or composing a paver load bearing apparatus should preferably be dimensioned to a size that renders the assemblies 1000-4000 capable of retaining a paver. As the size of a paver may vary from big to little, the physical dimensions of the components will typically vary according to the applicable paver to be supported thereon the apparatus. Depending on the circumstance, such dimensions will be readily known to one of skill in the art, and may include, without being limited to a cap having an diameter spanning of 1.36 inches. The dependence of the size and dimensions of the component apply equally well to the other aspects and parts of this disclosure An apparatus comprised of an above disclosed component may be used to compensate for variations in the slope of the undersurface with regard to the leveling of a paver surface. It should be noted that FIGS. 1 through 29D and the associated description are of illustrative importance only. In other words, the depiction and descriptions of the present invention should not be construed as limiting of the subject matter in this application. Additional modifications may become apparent to one skilled in the art after reading this disclosure.

I claim:

1. The assembly configured to self level comprising:

a base with a foot, a key receptacle, and a concave surface;

a cap with (a) a paver support surface, (b) a hole through an axis of the cap, and (c) a convex surface, wherein the cap is positioned on the base so that the concave and convex surfaces slidably and rotatably interface; and, a key with a flange, wherein the key is positioned through the hole in the cap and in the key receptacle to maintain the interface of the concave and convex surfaces.

2. The assembly of claim 1 wherein the cap features a spacer receptacle and the assembly further comprises a tile spacer provided to the spacer receptacle of the cap.

3. An assembly comprising:

a base with a foot, a key receptacle, and a riser receptacle;

a collar, generally defined by a tubiform, wherein the collar features female threads, and wherein the collar is positioned on the base so that one end of the collar is within the riser receptacle of the base;

an insert with male threads and a concave surface, wherein the male threads are threaded with female threads of the collar;

a cap with (a) a paver support surface, (b) a hole through an axis of the cap, and (c) a convex surface, wherein the cap is positioned on the insert so that the concave and convex surfaces slidably and rotatably interface; and, a key with a flange, wherein the key is positioned through the hole in the cap and in the key receptacle to maintain the interface of the concave and convex surfaces.

4. The assembly of claim 3 wherein the cap features a spacer receptacle and the assembly further comprises a tile spacer provided to the spacer receptacle of the cap.

5. An assembly configured to self level comprising:

a base with a foot, a femininely threaded support cylinder and a riser socket;

a threaded insert wherein the treaded insert is a truncated cylinder comprised of (a) a foot, (b) a male thread, (c) a concave surface; and (d) a key, wherein said key extends coaxially from the concave surface along the axis of the cylinder and is retained inside a key socket;

a cap with a convex surface on its bottom side, a tile support surface, a tile spacer receptacle, wherein said tile spacer receptacle is coaxial to the tile support surface wherein said cap is movably retained between a flange of the key and the concave surface of the threaded insert.

* * * * *